US012369703B2

(12) United States Patent
Fowler et al.

(10) Patent No.: US 12,369,703 B2
(45) Date of Patent: Jul. 29, 2025

(54) ORAL CARE SYSTEM AND PACKAGING

(71) Applicant: Sage Products, LLC, Cary, IL (US)

(72) Inventors: Paul M. Fowler, Cary, IL (US); Ronald C. Cagle, Crystal Lake, IL (US); Theresa L. Sebastian, Cary, IL (US); Timothy J. Rapinchuk, Cary, IL (US); Catherine S. Boulos, Cary, IL (US); Abhi R. Patel, Cary, IL (US)

(73) Assignee: Sage Products, LLC, Cary, IL (US)

( * ) Notice: Subject to any disclaimer, the term of this patent is extended or adjusted under 35 U.S.C. 154(b) by 764 days.

(21) Appl. No.: 17/311,012

(22) PCT Filed: Dec. 6, 2019

(86) PCT No.: PCT/US2019/065042

§ 371 (c)(1),
(2) Date: Jun. 4, 2021

(87) PCT Pub. No.: WO2020/118235

PCT Pub. Date: Jun. 11, 2020

(65) Prior Publication Data

US 2022/0015526 A1 Jan. 20, 2022

Related U.S. Application Data

(60) Provisional application No. 62/816,735, filed on Mar. 11, 2019, provisional application No. 62/776,620, filed on Dec. 7, 2018.

(51) Int. Cl.

| | |
|---|---|
| ***A45D 44/18*** | (2006.01) |
| ***A46B 17/02*** | (2006.01) |
| *A46B 5/02* | (2006.01) |

(52) U.S. Cl.
CPC ..... *A45D 44/18* (2013.01); *A46B 17/02* (2013.01); *A46B 5/021* (2013.01)

(58) Field of Classification Search
CPC ..... A46B 17/00; A46B 17/02; A46B 17/04; A46B 17/06; A46B 17/065;
(Continued)

(56) References Cited

U.S. PATENT DOCUMENTS

| | | | |
|---|---|---|---|
| 670,023 | A | 3/1901 | Jump |
| 884,256 | A | 4/1908 | Addie |

(Continued)

FOREIGN PATENT DOCUMENTS

| | | |
|---|---|---|
| CA | D189737 | 12/2022 |
| DE | 29618648 U1 | 12/1996 |

(Continued)

OTHER PUBLICATIONS

U.S. Appl. No. 29/683,163, filed Mar. 11, 2019, Sage Products, LLC.

(Continued)

*Primary Examiner* — Rachel R Steitz
*Assistant Examiner* — Karim Asqiriba
(74) *Attorney, Agent, or Firm* — FOLEY & LARDNER LLP

(57) ABSTRACT

An oral care regimen kit includes a packaging unit. The packaging unit includes an oral care system, which includes a toothbrush and an oral fluid container, and a clip configured to engage a first portion of the oral care system such that the toothbrush cannot be depressed into the oral fluid container while the oral care system is engaged by the clip.

20 Claims, 41 Drawing Sheets

(58) Field of Classification Search
CPC ..... A46B 2200/1066; A46B 2200/108; A46B 2200/1086; A46B 15/0061; A46B 11/0003; A46B 9/04; A46B 11/0086; A45D 44/18; B44D 3/123; B44D 3/125; A61C 17/16; A47K 1/09
See application file for complete search history.

(56) References Cited

U.S. PATENT DOCUMENTS 1,254,714 A 1/1918 McCombs
1,283,403 A 10/1918 Eustis
1,705,050 A 3/1929 Taylor
1,723,944 A 8/1929 Marsh
1,770,478 A 7/1930 Burnett
2,084,540 A 6/1937 Smith
2,161,854 A 6/1939 Copell
2,186,600 A 1/1940 Behrens
D143,320 S 12/1945 Horton
D145,045 S 6/1946 Plasket
D186,435 S 10/1959 Wilson
3,002,722 A 10/1961 Cote
3,220,543 A 11/1965 McCord et al.
3,275,274 A 9/1966 Hutcheon
3,286,835 A 11/1966 Crane, Jr.
3,822,783 A 7/1974 Mortensen
3,840,932 A 10/1974 Balamuth et al.
3,927,762 A 12/1975 Zdarsky et al.
4,106,621 A 8/1978 Sorenson
4,317,605 A * 3/1982 Alissandratos ..... A47K 11/10 312/305
4,324,331 A 4/1982 Ignasiak
4,328,894 A 5/1982 Edell
4,570,652 A 2/1986 Chavez
D294,805 S 3/1988 Boyer
4,750,652 A 6/1988 Grant
4,854,760 A 8/1989 Pike et al.
4,880,111 A 11/1989 Bagwell et al.
4,915,219 A 4/1990 Ottimo
4,976,379 A 12/1990 Sloan
4,995,509 A 2/1991 Kornfeind
5,022,559 A 6/1991 Condon
5,095,924 A 3/1992 Stanfield
D332,401 S 1/1993 Araujo et al.
5,246,046 A 9/1993 Schramm
5,288,047 A 2/1994 Pan
5,379,895 A 1/1995 Foslien
5,386,908 A 2/1995 Sinn
5,392,909 A 2/1995 Hackett
5,396,678 A 3/1995 Bredall et al.
5,445,631 A 8/1995 Uchida
D363,017 S 10/1995 Noble
D363,211 S 10/1995 Noble
D367,999 S 3/1996 McCallum
5,495,876 A 3/1996 Schramm
D373,823 S 9/1996 Baldwin
5,765,254 A 6/1998 O'Halloran
5,816,408 A 10/1998 Indelicato
5,862,913 A 1/1999 Chou
RE36,131 E 3/1999 Schramm
5,908,057 A 6/1999 Schramm
5,950,648 A 9/1999 Skrocki et al.
6,059,106 A 5/2000 Baker et al.
6,082,999 A 7/2000 Tcherny et al.
D429,461 S 8/2000 Rowlay
6,108,849 A 8/2000 Weihrauch
6,131,737 A 10/2000 Marshall
6,213,777 B1 4/2001 Seitzinger
6,280,112 B1 8/2001 Vieu
6,283,311 B1 * 9/2001 Lee ..... B25H 3/04 211/70.6
6,311,837 B1 11/2001 Blaustein et al.
6,402,104 B1 * 6/2002 Smith ..... A47K 1/09 248/205.8
6,418,940 B1 7/2002 Tcherny et al.
6,543,100 B1 4/2003 Finley et al.
6,595,822 B1 7/2003 Thai
6,601,699 B1 * 8/2003 Naredo ..... A46B 17/06 206/362.1
6,638,131 B1 10/2003 Thai
6,702,113 B2 3/2004 Marino
6,857,928 B2 2/2005 Thai
6,889,829 B2 5/2005 Lev et al.
D508,200 S 8/2005 Cagle
6,945,397 B2 9/2005 Brattesani et al.
D510,822 S 10/2005 Spiers et al.
D512,908 S 12/2005 Proudfit
D513,382 S 1/2006 Proudfit
D520,356 S 5/2006 Kellar et al.
D523,610 S 6/2006 Kissell
7,124,894 B1 10/2006 Dobos
RE39,443 E 12/2006 Schramm
7,244,161 B2 7/2007 Thai
7,320,398 B2 1/2008 Bertl et al.
D571,207 S 6/2008 Rozanski
D571,208 S 6/2008 Rozanski
7,399,133 B1 7/2008 Eversole
7,524,230 B2 4/2009 Thai
D597,829 S 8/2009 Ma et al.
D614,489 S 4/2010 Doster
7,784,429 B2 8/2010 Chiodo
D630,528 S 1/2011 Dombrowski et al.
7,967,519 B2 6/2011 Gueret
RE42,610 E 8/2011 Schramm
8,091,702 B1 1/2012 Keip
D654,288 S 2/2012 Lecoutre
D654,724 S 2/2012 Lecoutre
D660,690 S 5/2012 Mixides
8,181,786 B1 5/2012 Alas
8,245,844 B2 8/2012 Sorrentino et al.
8,251,076 B2 8/2012 Souza
D666,903 S 9/2012 McIntosh et al.
D681,444 S 5/2013 Oja et al.
8,506,192 B2 8/2013 Allbritton
D691,884 S 10/2013 Kwon
D698,639 S 2/2014 Fletcher et al.
8,734,420 B2 5/2014 Ariagno et al.
D715,641 S 10/2014 Spinos
D752,427 S 3/2016 Moskovich et al.
D767,393 S 9/2016 Giorgis
9,456,956 B1 10/2016 Webster et al.
D803,678 S 11/2017 Chen et al.
D803,679 S 11/2017 Chen et al.
9,833,605 B2 12/2017 Sanders et al.
D806,530 S 1/2018 Mack
D813,660 S 3/2018 Tyner
D816,478 S 5/2018 Moskovich et al.
D826,706 S 8/2018 Moskovich et al.
10,058,649 B2 8/2018 Le Maner
D829,544 S 10/2018 Kocon et al.
10,327,539 B2 6/2019 Beck et al.
D853,226 S 7/2019 Geringer et al.
D853,831 S 7/2019 Geringer et al.
10,687,612 B2 6/2020 Beck et al.
D901,312 S 11/2020 Fowler et al.
D954,551 S 6/2022 Moak et al.
D988,868 S 6/2023 Fowler et al.
D995,288 S 8/2023 Okoroafor et al.
12,029,311 B2 7/2024 Blabas et al.
2001/0032796 A1 10/2001 Rubenstein
2001/0035413 A1 11/2001 Thai
2002/0121449 A1 9/2002 Bowie
2004/0129580 A1 7/2004 Cochran et al.
2004/0211683 A1 10/2004 Barham et al.
2004/0240928 A1 12/2004 Trocino
2005/0087464 A1 4/2005 Brattesani et al.
2005/0161454 A1 7/2005 Nehren et al.
2006/0021166 A1 2/2006 Hills
2006/0048791 A1 3/2006 Mehes et al.
2006/0131189 A1 6/2006 Lee et al.
2006/0208142 A1 9/2006 Adams
2006/0260635 A1 11/2006 Dabney
2006/0289030 A1 12/2006 Pho

(56) References Cited

U.S. PATENT DOCUMENTS

| | | | | |
|---|---|---|---|---|
| 2007/0220754 | A1* | 9/2007 | Barbaro | A45D 27/29 30/41 |
| 2008/0209650 | A1 | 9/2008 | Brewer et al. | |
| 2009/0159487 | A1 | 6/2009 | Tacoma | |
| 2009/0197220 | A1 | 8/2009 | Cindrich | |
| 2011/0297574 | A1 | 12/2011 | Lecoutre | |
| 2012/0048760 | A1 | 3/2012 | Karey et al. | |
| 2012/0170967 | A1 | 7/2012 | Faison | |
| 2012/0241347 | A1 | 9/2012 | Bowers et al. | |
| 2013/0037441 | A1 | 2/2013 | Pacheco | |
| 2013/0140310 | A1 | 6/2013 | Lien et al. | |
| 2013/0230349 | A1* | 9/2013 | Dontfraid | A46B 17/02 401/123 |
| 2013/0340185 | A1 | 12/2013 | Patel et al. | |
| 2014/0008266 | A1 | 1/2014 | Lee et al. | |
| 2015/0014492 | A1* | 1/2015 | Sharpe | A61J 1/16 248/312 |
| 2015/0282603 | A1 | 10/2015 | Jimenez et al. | |
| 2016/0039393 | A1* | 2/2016 | Zhuo | B60S 3/045 15/53.1 |
| 2016/0198990 | A1 | 7/2016 | Betancur et al. | |
| 2016/0206412 | A1 | 7/2016 | Bock | |
| 2017/0095071 | A1* | 4/2017 | Osmond | A46B 17/065 |
| 2017/0311707 | A1* | 11/2017 | Beck | A46B 15/0093 |
| 2018/0071506 | A1 | 3/2018 | Sanders et al. | |
| 2018/0085515 | A1 | 3/2018 | Mide et al. | |
| 2018/0132605 | A1* | 5/2018 | Fowler | A46B 15/0061 |
| 2018/0132989 | A1 | 5/2018 | Deane et al. | |
| 2018/0161491 | A1 | 6/2018 | Sanders et al. | |
| 2018/0161492 | A1 | 6/2018 | Sanders et al. | |
| 2018/0168786 | A1 | 6/2018 | Meng et al. | |
| 2018/0352948 | A1 | 12/2018 | Bryzek et al. | |
| 2019/0307237 | A1 | 10/2019 | Beck et al. | |
| 2020/0305589 | A1 | 10/2020 | Beck et al. | |
| 2020/0390230 | A1* | 12/2020 | Fowler | A46B 15/0081 |
| 2020/0405046 | A1 | 12/2020 | Deane et al. | |
| 2021/0059393 | A1 | 3/2021 | Yang et al. | |
| 2022/0015526 | A1 | 1/2022 | Fowler et al. | |
| 2022/0177211 | A1 | 6/2022 | Beck et al. | |
| 2022/0225757 | A1* | 7/2022 | Fowler | A46B 9/04 |
| 2023/0092350 | A1* | 3/2023 | Fowler | A46B 11/0003 433/91 |
| 2023/0240436 | A1 | 8/2023 | Gross et al. | |
| 2023/0248183 | A1* | 8/2023 | McLain | A47K 1/09 211/65 |

FOREIGN PATENT DOCUMENTS

| | | | |
|---|---|---|---|
| EM | 006852877-0001 | | 9/2019 |
| EM | 006852877-0002 | | 9/2019 |
| EM | 006852877-0003 | | 9/2019 |
| FR | 2606615 | A | 5/1988 |
| GB | 9 006 852877-0001 | | 9/2019 |
| GB | 9 006 852877-0002 | | 9/2019 |
| GB | 9 006 852877-0003 | | 9/2019 |
| JP | 08-052210 | A | 2/1996 |
| JP | 3059317 | U | 7/1999 |
| JP | 2000-159266 | A | 6/2000 |
| JP | 2002-234553 | A | 8/2002 |
| JP | 2010-013186 | A | 1/2010 |
| JP | D1725082 | | 9/2022 |
| KR | 10-2009-0133048 | A | 12/2009 |
| KR | 20090133048 | A | 12/2009 |
| KR | 10-2010-0050871 | A | 5/2010 |
| KR | 20130094557 | A | 8/2013 |
| WO | WO-00/58164 | A1 | 10/2000 |
| WO | WO-2012/087317 | A1 | 6/2012 |
| WO | WO-2013/090659 | A1 | 6/2013 |
| WO | WO-2016/059035 | A1 | 4/2016 |
| WO | WO-2018/090050 | | 5/2018 |
| WO | WO-2022/001607 | A1 | 1/2022 |
| WO | WO-2022/016075 | A1 | 1/2022 |

OTHER PUBLICATIONS

International Search Report and Written Opinion for International Application No. PCT/US2019/065042, mailed Apr. 7, 2020, 11 pages.

Invitation to Pay Additional Fees for International Application No. PCT/US2019/065042, mailed Feb. 10, 2020, 2 pages.

PCT Collaborative Search and Examination Pilot, Peer ISA China National Intellectual Property, International Search Report and Written Opinion for International Application No. PCT/US2019/065042, completed Feb. 28, 2020, 13 pages.

PCT Collaborative Search and Examination Pilot, Peer ISA European Patent Office, International Search Report and Written Opinion for International Application No. PCT/US2019/065042, completed Feb. 18, 2020, 10 pages.

PCT Collaborative Search and Examination Pilot, Peer ISA Japan Patent Office, International Search Report and Written Opinion for International Application No. PCT/US2019/065042, completed Mar. 4, 2020, 9 pages.

PCT Collaborative Search and Examination Pilot, Peer ISA Korean Intellectual Property Office, International Search Report and Written Opinion for International Application No. PCT/US2019/065042, completed Mar. 6, 2020, 16 pages.

Pharmacy Counter Space Cardboard Display Box for Medicine Drugs. [online] Published on Sep. 22, 2018. Retrieved Jan. 3, 2020 from URL: http://www.cardboardpalletdisplay.com/sale-6122822-pharmacy-counter-space-cardboard-display-box-for-medicine-drugs.html.

Sage Self Oral Care Toothbrush. [online] Published on Nov. 30, 2019. Retrieved Jan. 3, 2020 from URL: https://www.stryker.com/us/en/sage/products/sage-self-oral-care.html.

Translation of KR 10-2009-0133048 A; provided by International Searching Authority for International Search Report and Written Opinion of International Application No. PCT/US2019/065042, mailed Apr. 7, 2020, 4 pages.

Sage Self Oral Care, posted date not available [retrieved Aug. 28, 2023]. Retrieved from internet, https:/Avww.stryker.com/us/en/sage/products/sage-self-oral-care.html (Year: 2023) 12 pages.

Suction Toothbrush Kit Sage, posted date not available [retrieved Aug. 28, 2023]. Retrieved from internet, https://mms.mckesson.com/product/1177792/Sage-Products-6301 (Year: 2023) 3 pages.

International Search Report and Written Opinion for International Application No. PCT/US2021/042012, mailed Oct. 28, 2021, 17 pages.

International Search Report and Written Opinion for International Application No. PCT/US2021/061716, mailed Mar. 7, 2022, 16 pages.

* cited by examiner

ORAL CARE SYSTEM AND PACKAGING

CROSS-REFERENCE TO RELATED PATENT APPLICATIONS

This application claims the benefit of and priority to U.S. Provisional Application No. 62/776,620, filed Dec. 7, 2018, and U.S. Provisional Application No. 62,816,735, filed Mar. 11, 2019, both of which are incorporated herein by reference in their entireties.

BACKGROUND

Standard toothbrush designs are not ideally suited for use in hospitals or other medical treatment facilities where patients may have compromised immune systems. In these settings, there is an increased risk of illness and infection, for example, contracting pneumonia. Accordingly, compliance with a proper oral care regimen, which includes brushing three to four times per day, is important.

Due to its repeated use, the use of standard toothbrushes in a hospital environment increase a risk of bacterial infection, or the spread of other illness or infection. Additionally, standard toothbrushes are also not suitable for some patients who are unable to spit or otherwise voluntarily remove liquids from their mouths, may not have easy access to water, or may have difficulty holding and using a toothbrush having the standard size and shape. Standard toothpaste may also be unsuitable for use by such patients, and it may be difficult for such patients to find and apply the proper amount of toothpaste to a toothbrush.

In many circumstances, hygiene practices like oral care must be repeated multiple times. For example, in oral care, a series of mouth care products must be used in a repetitious fashion, such as for periodic cleaning sessions, where there can be evacuation, brushing of the teeth, and swabbing of the mouth and gums. With the repetition of each procedure occurring after a predetermined interval, such as every few hours, it may be cumbersome for the medical care professional or the patient to gather the necessary instrument(s) repeatedly throughout the day.

Furthermore, while patients are recommended to brush their teeth a certain number of times per day in a hospital setting (e.g., four times per day), many patients do not actually brush their teeth the recommended number of times (e.g., may brush their teeth only twice per day instead of four times per day). As such, a medical care professional may provide a patient with a certain number of toothbrush units to be used in a single day, and the patient may not actually use all of them, leading to waste of toothbrush units that are already opened but unused and must be disposed to prevent contamination. Additionally, it may be difficult for a medical care professional to confirm compliance with the oral care recommendations, especially where a patient may be untruthful about his or her use or is not able to accurately recollect the activities of the day.

SUMMARY

One embodiment relates to an oral care regimen kit. The oral care regimen kit includes a packaging unit. The packaging unit includes an oral care system including a toothbrush and an oral fluid container, and a clip configured to engage a first portion of the oral care system such that the toothbrush cannot be depressed into the oral fluid container while the oral care system is engaged by the clip. In some embodiments, the clip is a component configured to engage the portion of the oral care system and prevent the toothbrush from being depressed into the oral fluid container. In some embodiments, the clip is configured to be supported by the packaging unit or a portion thereof.

One embodiment relates to an oral care regimen unit. The oral care regimen unit includes a packaging unit and a wrapper encasing the packaging unit. The packaging unit includes a panel, at least one or a plurality of clips supported by the panel, and at least one or a plurality of oral care systems. Each clip is configured to engage a portion of an oral care system. Each oral care system includes a toothbrush and an oral fluid container.

Another embodiment relates to a method of providing an oral care regimen kit. The method includes packaging an oral care system in a packaging unit. The packaging unit includes an oral care system including a toothbrush and an oral fluid container, and a clip configured to engage a portion of the oral care system such that the toothbrush cannot be depressed into the oral fluid container while the oral care system is engaged by the clip. The method also includes enclosing the packaging unit in a wrapper.

Another embodiment relates to a method of providing an oral care regimen unit. The method includes packaging at least one or a plurality of oral care systems in a packaging unit. The packaging unit includes a panel and at least one or a plurality of clips supported by the panel. Each clip is configured to engage a portion of an oral care system. Each oral care system includes a toothbrush and an oral fluid container. The method further includes enclosing the packaging unit in a wrapper.

Another embodiment relates to a packaging system for an oral care regimen kit. The packaging system includes a packaging unit. The packaging unit includes a mount, an attachment element supported by the mount, the attachment element including a pair of flat portions, and an oral care system. The oral care system includes a toothbrush including a suction port and a plunger configured to be removably inserted in the suction port, and an oral fluid container. The oral care system includes a pair of grooves configured to receive the pair of flat portions of the attachment element. The packaging system also includes a wrapper encasing the packaging unit.

Another embodiment relates to an oral care regimen unit. The oral care regimen unit includes a packaging unit and a wrapper encasing the packaging unit. The packaging unit includes a panel and at least one or a plurality of clips supported by the panel. Each clip includes a set of prongs, and each prong includes a flat portion. The packaging unit further includes at least one or a plurality of oral care systems. Each oral care system includes a set of grooves. The flat portions of each clip are configured to receive the set of grooves of an oral care system. Each oral care system includes a toothbrush, including a suction port and a plunger configured to be removably inserted in the suction port, and an oral fluid container.

Another embodiment relates to an oral care regimen kit. The oral care regimen kit includes a first packaging unit carrying at least one oral care system and a first wrapper enclosing the first packaging unit. The oral care regimen kit further includes a second packaging unit carrying at least one oral care system and a second wrapper enclosing the second packaging unit and connected to the first wrapper. The first packaging unit and the second packaging unit are enclosed such that the first packaging unit can be removed from the first wrapper and the second packaging unit can be removed from the second wrapper independently. Each oral care system includes a toothbrush and an oral fluid container.

In some embodiments, the oral care regimen kit includes a quantity of oral care systems recommended for use by a patient over a time period, and at least one of the first packaging unit or the second packaging unit contains a quantity of oral care systems expected to be used by the patient over the time period.

In some embodiments, the oral care regimen kit includes four oral care systems, and each of the first packaging unit and the second packaging unit contains two oral care systems.

In some embodiments, the oral care regimen kit includes each of the first packaging unit and the second packaging unit contains two oral care systems.

In some embodiments, the oral care regimen kit includes the second wrapper connected to the first wrapper via a frangible connection.

In some embodiments, the oral care regimen kit includes the second wrapper connected to the first wrapper such that the first packaging unit and the second packaging unit are provided back-to-back, and such that the first packaging unit and the second packaging unit can be moved to expose back surfaces of the first packaging unit and the second packaging unit.

In some embodiments, the oral care regimen kit includes the first wrapper and the second wrapper temporarily attached together with a mild adhesive on the portions of the wrappers covering the back surfaces of the first packaging unit and the second packaging unit.

In some embodiments, the oral care regimen kit includes the first packaging unit and the second packaging unit having a recess for each oral care system into which a lower portion of a respective oral care system is received.

In some embodiments, the oral care regimen kit includes each of the first packaging unit and the second packaging unit having a slot in an overhang of the packaging unit into which an upper portion of a respective oral care system is received.

In some embodiments, the oral care regimen kit includes each oral care system having a set of grooves, each groove configured to receive a portion of the overhang that surrounds the slot.

In some embodiments, the oral care regimen kit includes the oral fluid container of each oral care system containing a premeasured amount of oral fluid contained at a bottom of the oral care system, and the set of grooves configured such that the toothbrush cannot be depressed into the oral fluid while the oral care system is contained within the packaging unit.

In some embodiments, the oral care regimen kit includes the set of grooves configured such that the oral care system cannot be replaced into the packaging unit after the oral care system is used.

Another embodiment relates to a method of providing a kit of oral care systems for a patient. The method includes packaging a first oral care set including one or more oral care systems in a first packaging unit, each oral care system including a toothbrush and an oral fluid container and packaging a second oral care set including one or more oral care systems in a second packaging unit. The method further includes enclosing the first packaging unit in a first wrapper and enclosing the second packaging unit in a second wrapper. The method further includes connecting the second wrapper to the first wrapper such that the first packaging unit can be removed from the first wrapper and the second packaging unit can be separately removed from the second wrapper, and providing the first and second sets to the patient to complete an oral care regimen.

In some embodiments, the method includes the kit includes a quantity of oral care systems recommended for use by a patient over a time period, and the kit includes a quantity of oral care systems recommended for use by a patient over a time period.

In some embodiments, the method includes four oral care systems, and the kit includes a quantity of oral care systems recommended for use by a patient over a time period.

In some embodiments, the method includes the second wrapper connected to the first wrapper via a frangible connection.

In some embodiments, the method includes the kit provided such that the first packaging unit and the second packaging unit are provided back-to-back and such that the first packaging unit and the second packaging unit can be moved relative to one another to expose back surfaces of the first packaging unit and the second packaging unit.

In some embodiments, the method includes the first wrapper and the second wrapper temporarily attached together with the mild adhesive on the portions of the wrappers covering the back surfaces of the first packaging unit and the second packaging unit.

In some embodiments, the method includes the first packaging unit and the second packaging unit having a recess and a slot in an overhang of the packaging unit for each oral care system, and packaging the first set of oral care systems in the first packaging unit includes inserting a lower portion of each oral care system of the first set into a recess of the first packaging unit and sliding an upper portion of each oral care system into a corresponding slot of the first packaging unit, and packaging the second set of oral care systems in the second packaging unit includes inserting a lower portion of each oral care system of the second set into a recess of the second packaging unit and sliding an upper portion of each oral care system into a corresponding slot of the second packaging unit.

In some embodiments, the method includes each oral care system having a set of grooves, and sliding an upper portion of each oral care system into a slot includes sliding the set of grooves to receive a portion of the overhang that surrounds the slot.

In some embodiments, the method includes the oral fluid container of each oral care system containing a premeasured amount of oral fluid at a bottom of the oral care system, and the set of grooves configured such that the toothbrush cannot be depressed into the oral fluid while the oral care system is contained within the packaging unit.

In some embodiments, the method includes the set of grooves configured such that the oral care system cannot be replaced into the packaging unit after the oral care system is used.

In some embodiments, the method includes providing the first and second sets to the patient to complete an oral care regimen.

In some embodiments, the method includes separating the first wrapper from the second wrapper to provide patient access to the first oral care set.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

BRIEF DESCRIPTION OF THE DRAWINGS

The following disclosure as a whole may be best understood by reference to the provided detailed description when read in conjunction with the accompanying drawings.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Figure 29:
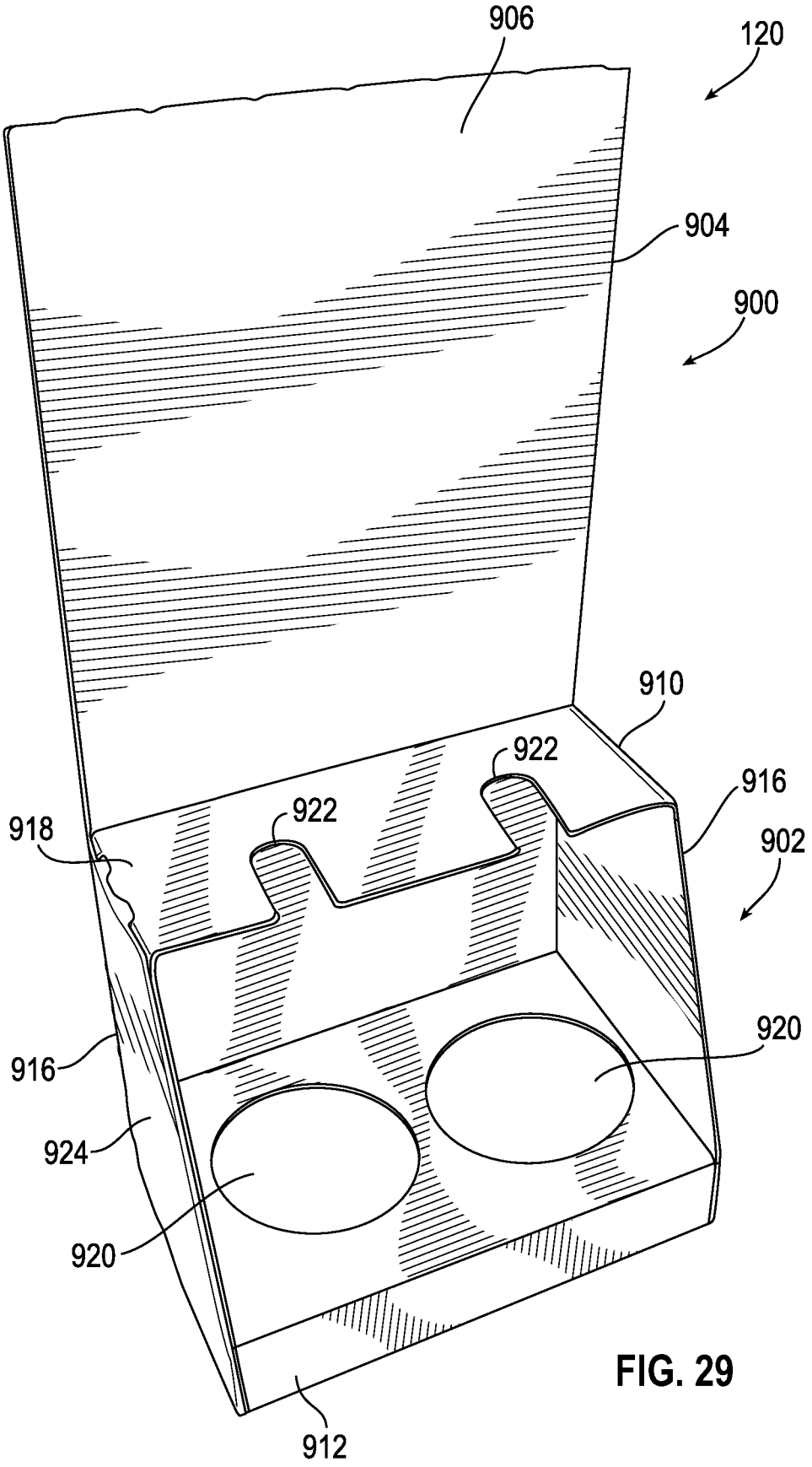
FIG. 29 is a side perspective view of a packaging unit for holding oral care systems, according to an exemplary embodiment.
Figure 37:
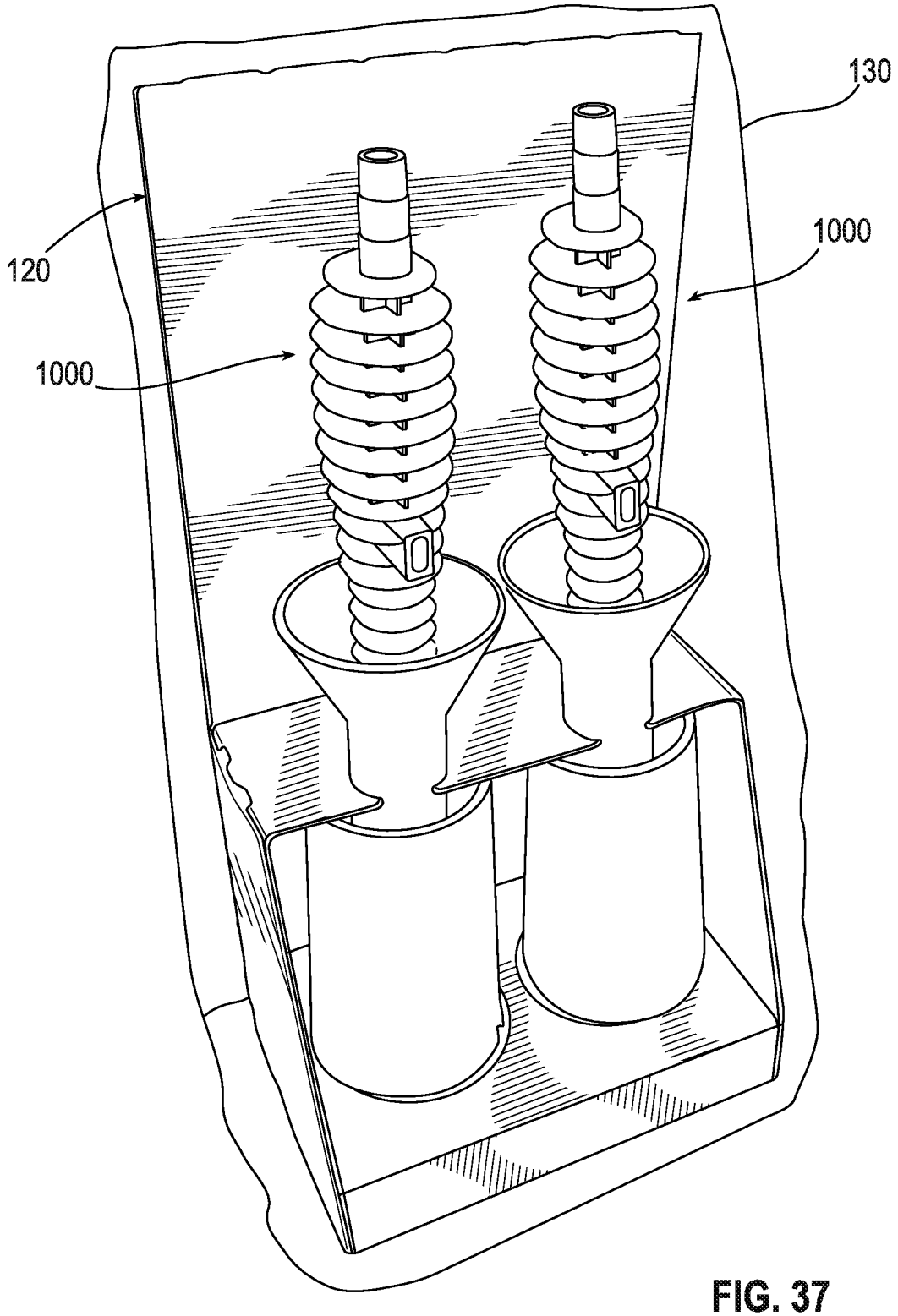
FIG. 37 is a side perspective view of the packaging unit of FIG. 33 contained within a wrapper, according to an exemplary embodiment.

According to various described embodiments, an oral care product is described that improves compliance with an oral care plan by providing all necessary tools and accessories for completing the plan, and packaging for holding the oral care product until use. According to various exemplary embodiments, an oral care system for use in a hospital setting includes an oral care device (e.g., a toothbrush) and a unit dose oral fluid container. The oral care device and/or oral care system may be intended for single use. Additionally, according to various exemplary embodiments, packaging is configured to hold one or more oral care systems (e.g., as shown in FIGS. 29 and 37). Various embodiments of oral care systems and packaging for oral care systems are described in further detail below.

Figure 1:
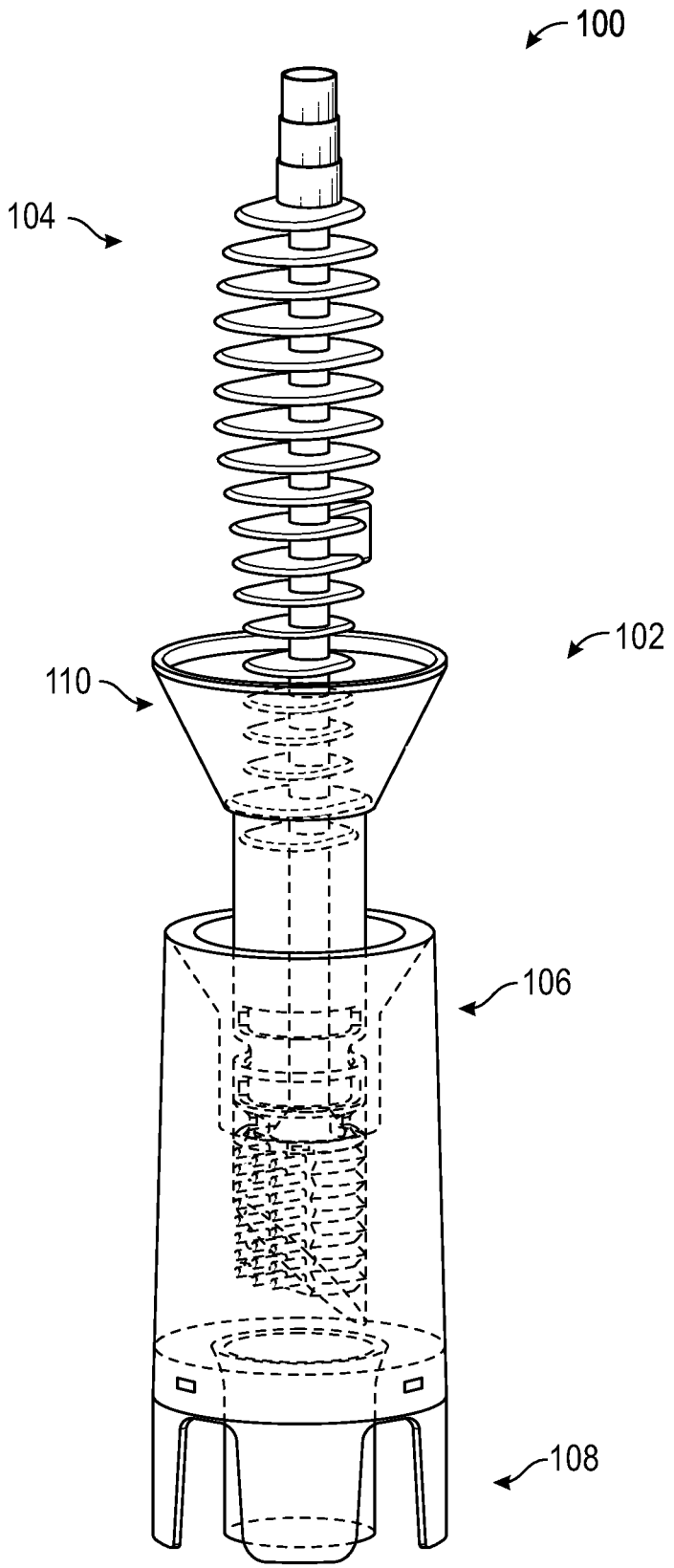
FIG. 1 is a schematic side view of an oral care system, according to an exemplary embodiment.

Referring first to FIG. 1, a schematic perspective side view of an oral care system 100 is shown, according to an exemplary embodiment. The oral care system 100 includes a unit dose oral fluid container, shown as oral fluid container 102, and a toothbrush, shown as toothbrush 104. Additionally, as shown, the unit dose oral fluid container 102 includes an oral fluid bottle 106, a cylinder solution cup 108, and a spittoon straw 110.

Figure 2:
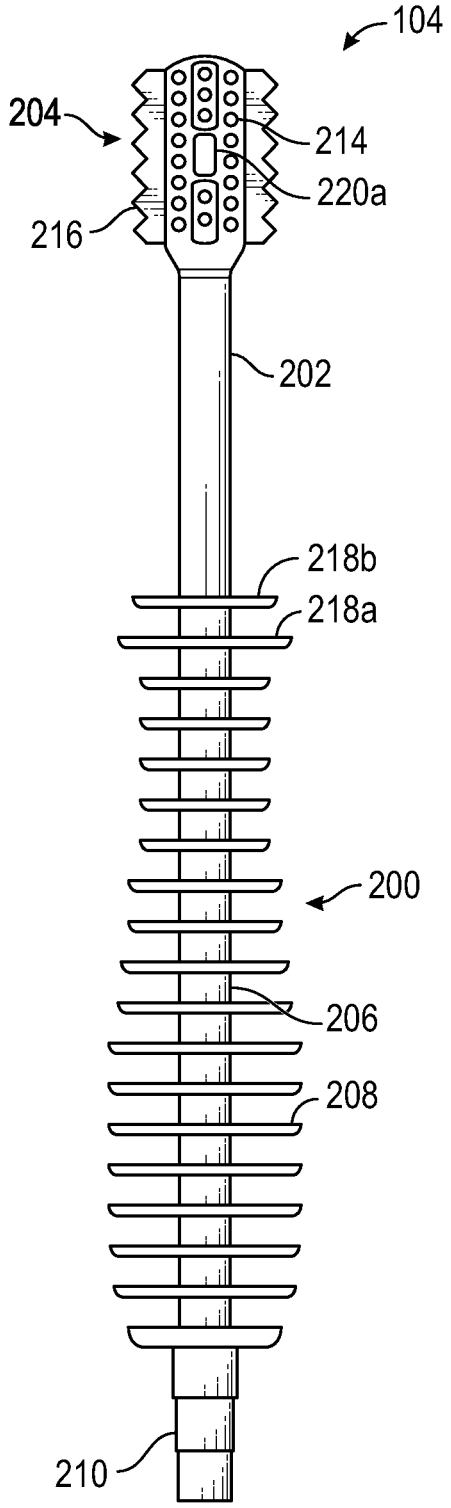
FIG. 2 is a side view of a toothbrush, according to an exemplary embodiment.
Figure 3:
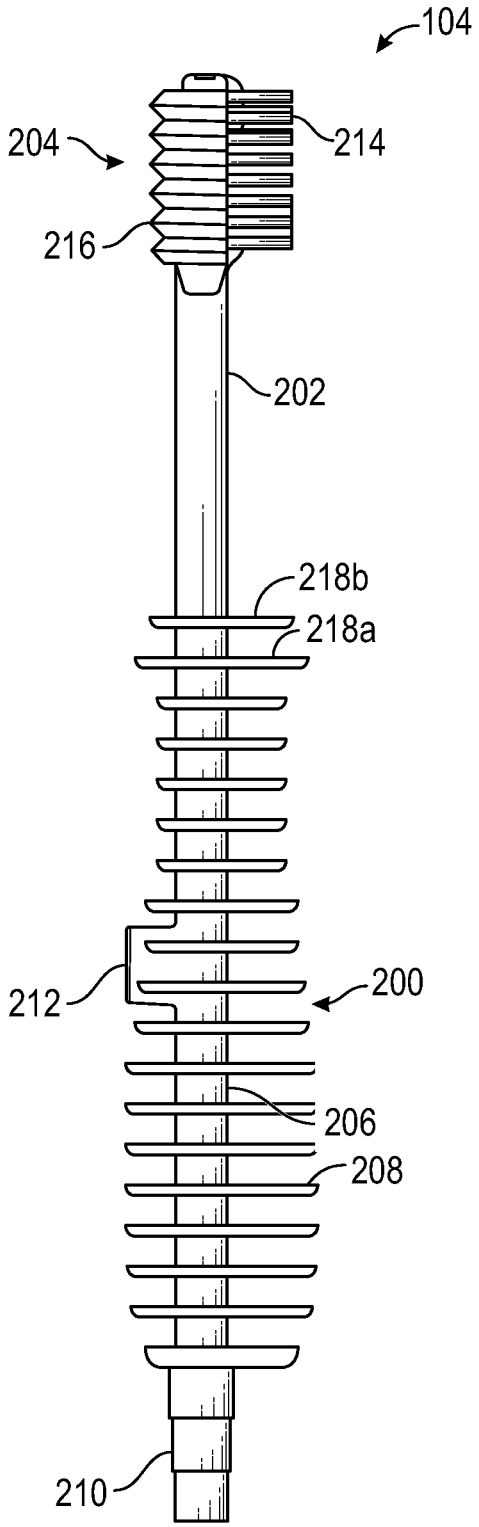
FIG. 3 is a side view of the toothbrush of FIG. 2, according to an exemplary embodiment.
Figure 4:
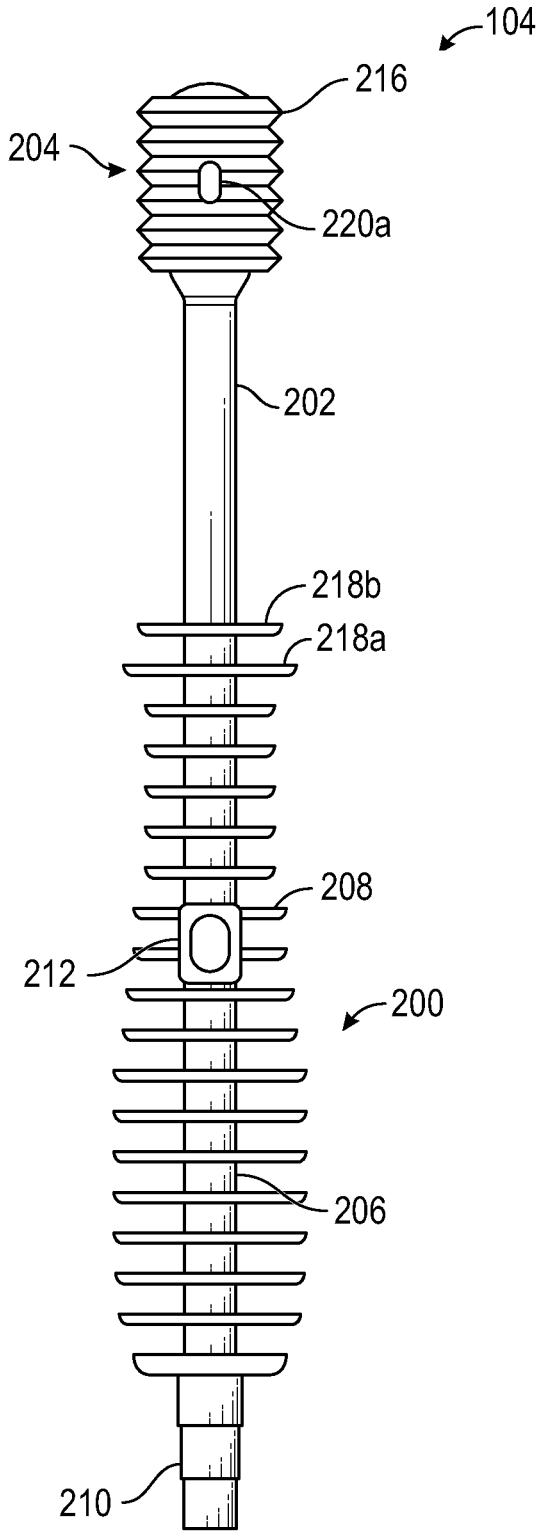
FIG. 4 is a side view of the toothbrush of FIG. 2, according to an exemplary embodiment.

Referring to FIGS. 2-4, side views of the toothbrush 104 are shown, according to an exemplary embodiment. The toothbrush 104 includes a handle 200 coupled to a lower stem 202, which in turn is coupled to a head 204. The head 204 includes bristles 214 and a foam section 216. The handle 200 includes an upper stem 206 with disk-like projections 208 extending from the upper stem 206. The diameters of the projections 208 vary along the length of the upper stem 206 to provide an ergonomically beneficial design. For example, the projections 208 provide a wider handle for the toothbrush 104 so that patients with less gripping force or ability have an easier time gripping the toothbrush 104. As shown in FIGS. 2-4, in some embodiments, the projections 208 are wider near the bottom of the toothbrush 104 and narrower near the location where the lower stem 202 and upper stem 206 meet. As further shown in FIGS. 2-4, in certain embodiments, the projections 208 are also narrower near the center of the upper stem 206.

Furthermore, the centers of the projections 208 are offset from the upper stem 206 such that the projections 208 extend past the upper stem 206 of the handle 200 more in the direction of the front of the head 204 (e.g., the side of the head 204 with the bristles 214) than in the direction of the back of the head 204 (e.g., the side of the head 204 with the foam section 216 and opposite the bristles 214), as shown in FIG. 3. Because the projections 208 are offset from the upper stem 206, the toothbrush 104 can be inserted into the spittoon straw 110 as shown in FIG. 1 without crushing the bristles 214. Additionally, the projections 208 include a projection seal 218*a* and a projection seal 218*b*. The projection seals 218*a* and 218*b* are configured to block a center conduit of the spittoon straw 110 to prevent contaminants (e.g., dust) from entering the interior of the oral fluid container 102, as described in further detail below.

Figure 5:
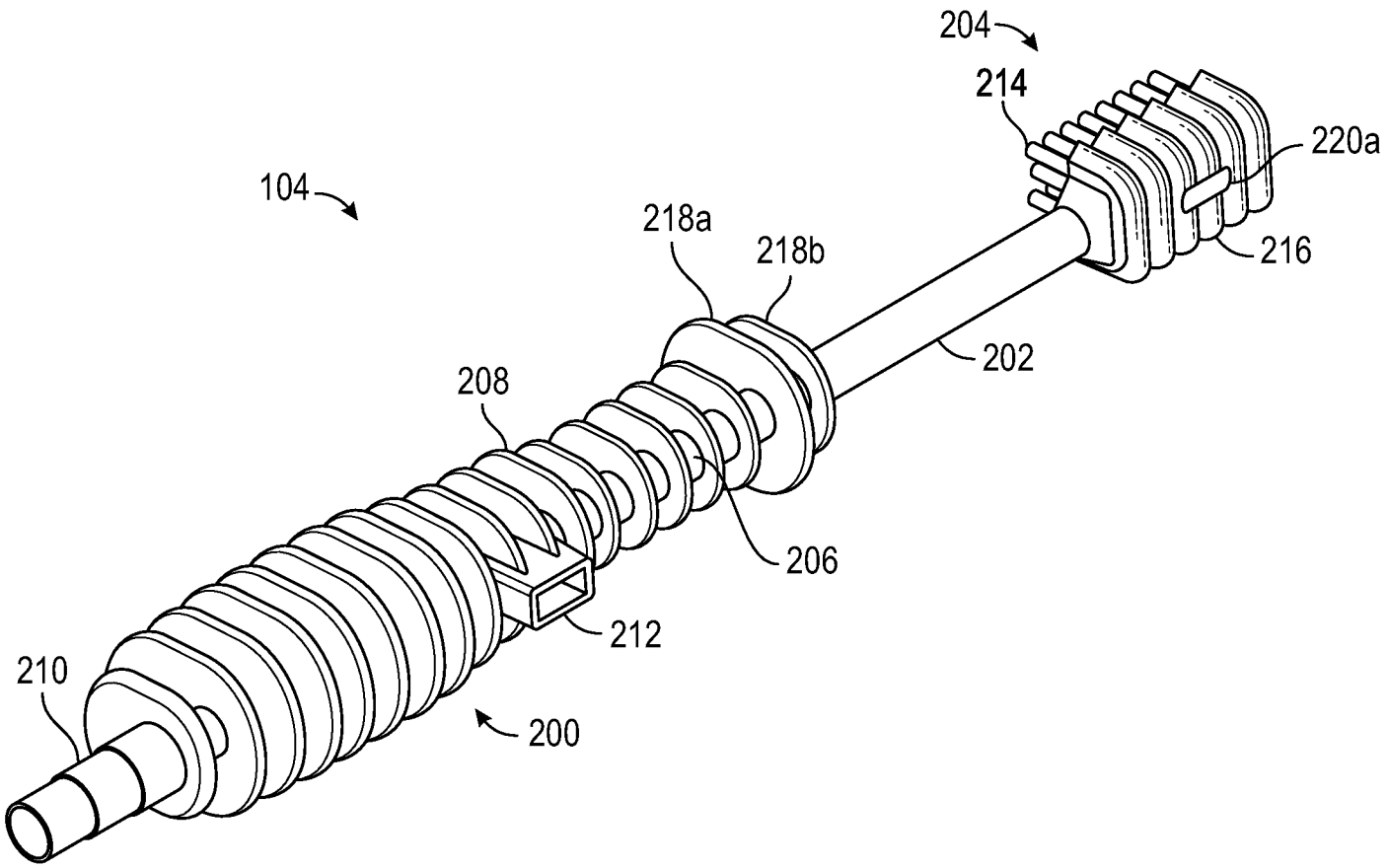
FIG. 5 is a side perspective view of the toothbrush of FIG. 2, according to an exemplary embodiment.

In various arrangements, the upper stem 206 is hollow to provide suction therethrough. Accordingly, the upper stem 206 includes a suction port 210 configured to couple to a suction mechanism, as shown in more detail in FIG. 5 illustrating a side perspective view of the toothbrush 104. Further, the upper stem 206 includes a projecting suction opening 212. The projecting suction opening 212 is positioned and extends beyond the projections 208 so that the patient can place a finger over the opening to activate suction through the upper stem 206. The lower stem 202, which extends between the upper stem 206 and the head 204, is hollow to allow suction to travel between the head 204 and the suction port 210.

Figure 6:
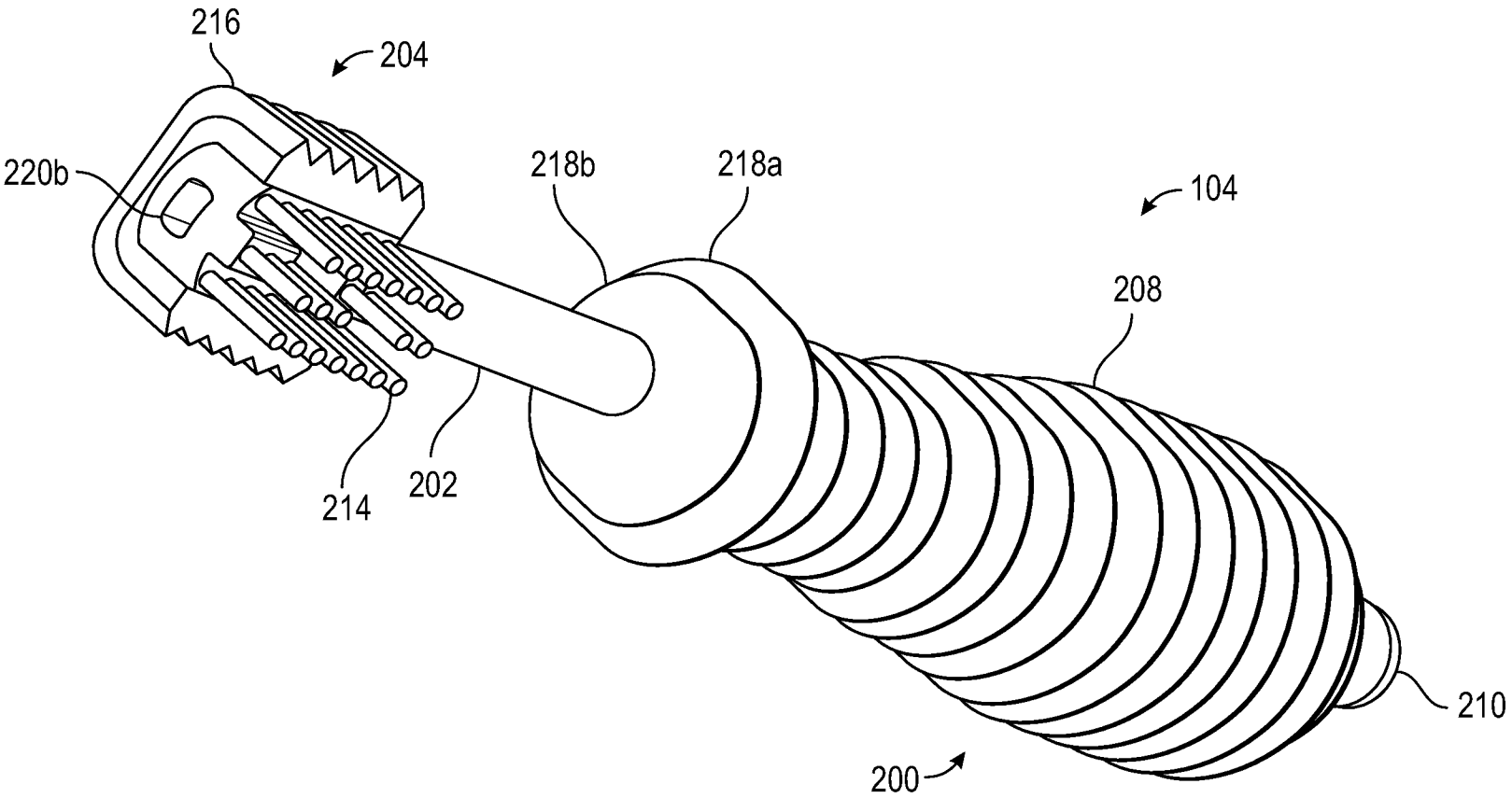
FIG. 6 is a top perspective view of the toothbrush of FIG. 2, according to an exemplary embodiment.

As noted above, the head 204 includes bristles 214 and a foam section 216. In some embodiments, the foam section 216 is located on both the back and sides of the head 204, as shown in FIG. 6 illustrating a top perspective view of the toothbrush 104. In other embodiments, the foam section 216 is located on only one of the back or sides of the toothbrush head 204. Further, in some embodiments, the foam section 216 is glued to the head 204 of the toothbrush 104, while in other embodiments the foam section 216 is attached to the head 204 through another mechanism (e.g., through an interference fit). As shown, in some embodiments, the foam section 216 has ridges to aid in cleansing. In various arrangements, the head 204 also includes one or more suction holes to provide for suction of fluids (e.g., saliva, antiseptic or other oral care fluid, etc.) from the mouth of the user. The suction hole(s) are located on a top, front, and/or back of the head 204. In the embodiment shown in FIGS. 2-6, the toothbrush 104 includes a suction hole 220*a* formed transversely through the center of the head 204 and a suction hole 220*b* formed on a top end of the toothbrush 104.

In various arrangements, the toothbrush 104 is manufactured using cored out injection molding. In some embodiments, the toothbrush 104 is a unitary, single injection-molded piece forming the upper stem 206, projections 208, lower stem 202, and head 204. In other embodiments, the toothbrush 104 is manufactured in separate pieces and assembled to form the completed toothbrush 104. For example, the upper stem 206 and the lower stem 202 are formed together as a single injection-molded piece or formed as separate pieces that are later connected together. It should be understood, however, that the toothbrush 104 is intended to be exemplary and that the oral care system 100 may be used with a differently designed toothbrush in other embodiments.

Figure 7:
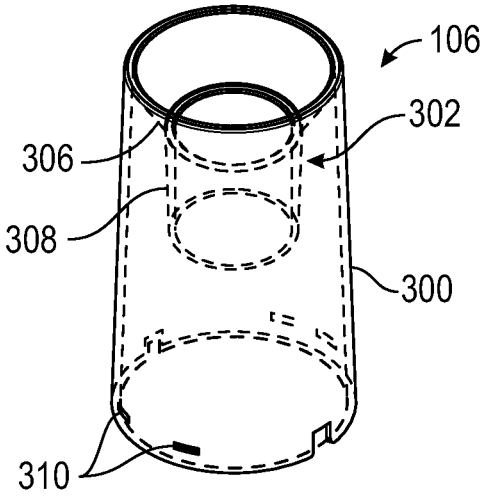
FIG. 7 is a schematic side perspective view of an oral fluid bottle of FIG. 1, according to an exemplary embodiment.
Figure 8:
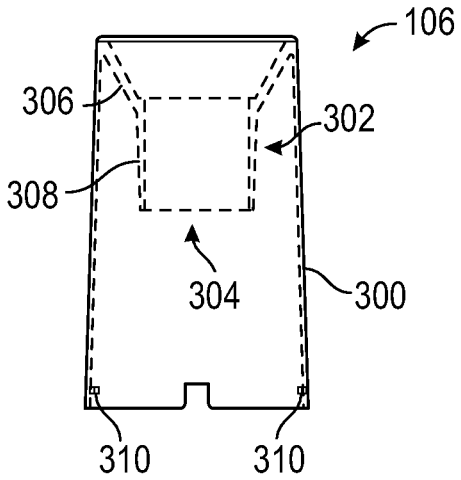
FIG. 8 is a schematic side view of the oral fluid bottle of FIG. 7, according to an exemplary embodiment.
Figure 9:
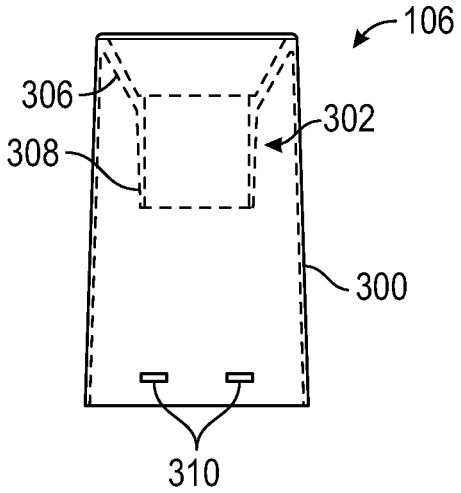
FIG. 9 is a schematic side view of the oral fluid bottle of FIG. 7, according to an exemplary embodiment.

Referring now to FIGS. 7-9, schematic side views of the oral fluid bottle 106 are shown, according to exemplary embodiments. The oral fluid bottle 106 includes a receptacle 300 and an internal chamber 302 defined within an interior portion of the oral fluid bottle 106, where the internal chamber 302 includes an outlet 304. As shown in FIGS. 7-9, the internal chamber 302 includes a funnel portion 306 that narrows to a neck portion 308. The internal chamber 302 thus provides a channel for receiving the spittoon straw 110, as discussed in further detail below. The funnel portion 306 also provides additional spill resistance to the oral fluid container 102. In the embodiment shown, the receptacle 300 of the oral fluid bottle 106 is configured as a hollow, circular cylinder, though in other embodiments the receptacle 300 has another shape (e.g., a rectangular shape). Further, the oral fluid bottle 106 is configured to be relatively tall compared to the other components of the oral care system 100 and to widen from a top of the oral fluid bottle 106 to the bottom, which provides stability for the oral fluid bottle 106 and the oral fluid container 102 as a whole.

The receptacle 300 is configured to receive the cylinder solution cup 108 through a lower portion of the receptacle 300. As shown in FIG. 7, the receptacle 300 has an open bottom portion for receiving the cylinder solution cup 108, though in other embodiments the receptacle 300 is structured to receive the cylinder solution cup 108 differently (e.g., include a slot for sliding in the cylinder solution cup 108). In various embodiments, the receptacle 300 includes apertures 310 for locking the cylinder solution cup 108 into the receptacle 300. The apertures 310 may have various arrangements on the receptacle 300. For example, in some embodiments, the receptacle 300 includes two sets of two apertures 310, opposite one another, near the bottom portion of the receptacle 300, as illustrated in FIG. 7.

Figure 10:
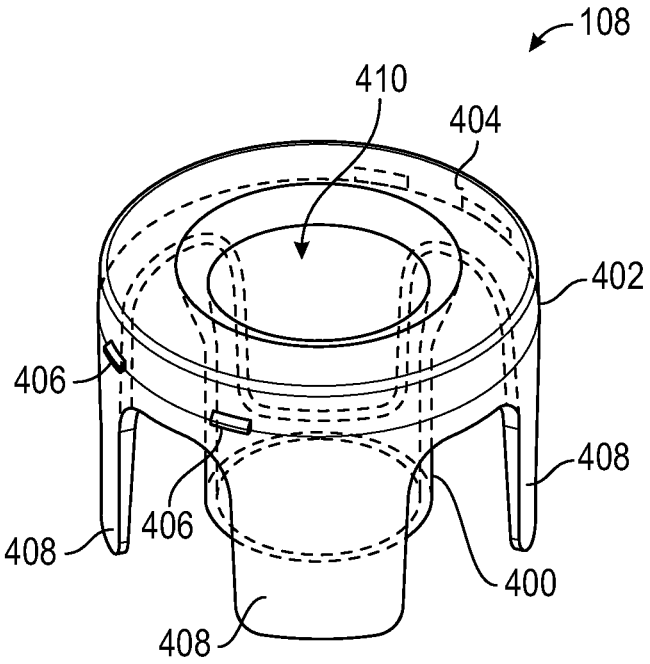
FIG. 10 is a schematic side perspective view of a cylinder solution cup configured to snap into the oral fluid bottle of FIG. 7, according to an exemplary embodiment.
Figure 11:
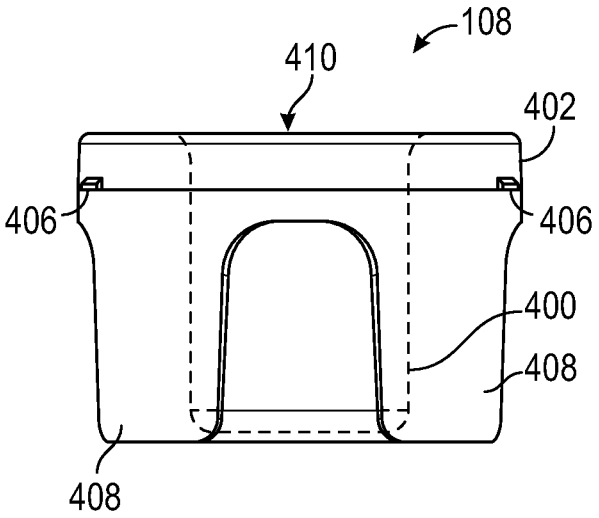
FIG. 11 is a schematic side view of the cylinder solution cup of FIG. 10, according to an exemplary embodiment.
Figure 12:
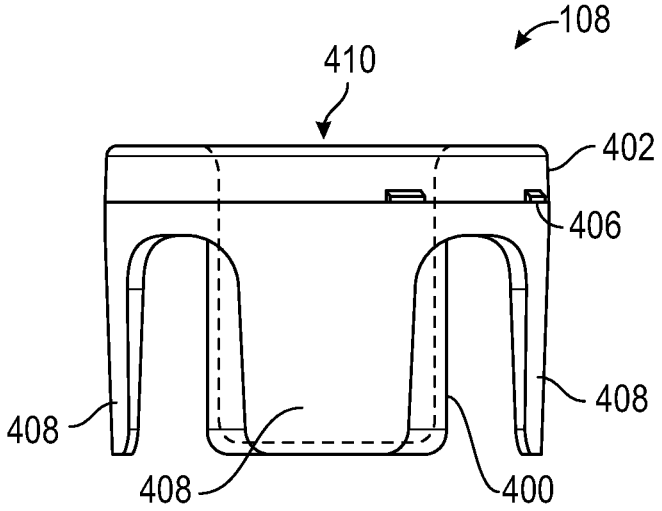
FIG. 12 is a schematic side view of the cylinder solution cup of FIG. 10, according to an exemplary embodiment.

FIG. 10 shows a schematic side perspective view of the cylinder solution cup 108, according to an exemplary embodiment. FIGS. 11 and 12 show schematic side views of the cylinder solution cup 108, according to exemplary embodiments. The cylinder solution cup 108 includes a base 400 configured to serve as a repository for a premeasured amount of oral fluid at the bottom of the oral care system 100. Further, the cylinder solution cup 108 receives brushing waste from a patient brushing his or her teeth. The base 400 is configured to be wide enough to receive the end of the spittoon straw 110, as well as deep enough that the head 204 of the toothbrush 104 provided in the spittoon straw 110 can be at least partially submerged in the oral fluid contained therein, as described in further detail below. Moreover, the cylinder solution cup 108 is configured to hold a sufficient amount of oral fluid such that when the toothbrush 104 and spittoon straw 110 are dipped into the oral fluid, the volume change in the oral fluid due to displacement allows, for example, the head 204 of the toothbrush 104 to be substantially submerged in the oral fluid while at the same time not spilling any of the oral fluid out of the top of the cup 108. In some embodiments, the cylinder solution cup 108 is configured to hold approximately 7.5 mL of oral fluid.

The cylinder solution cup 108 includes a rim 402 that defines a ledge 404 and carries projections 406. The projections 406 are spaced to align with the apertures 310 of the oral fluid bottle 106 such that the projections 406 can snap into the apertures 310 to lock the cylinder solution cup 108 into the receptacle 300 of the oral fluid bottle 106. Additionally, the rim 402, and the cylinder solution cup 108 overall, are configured such that when the projections 406 are snapped into the apertures 310, the receptacle 300 of the oral fluid bottle 106 and the rim 402 can contain a liquid.

Furthermore, the cylinder solution cup 108 includes legs 408 defining an internal space into which the base 400 projects. The legs 408 are spaced apart so as to provide the cylinder solution cup 108 and, once the cylinder solution cup 108 is snapped into the oral fluid bottle 106, the oral fluid container 102 as a whole a stable base. The cylinder solution cup 108 may include any number of legs 408 that provide a stable base, though in the embodiment shown in FIGS. 10-12 the cylinder solution cup 108 has four legs 408.

Figure 13:
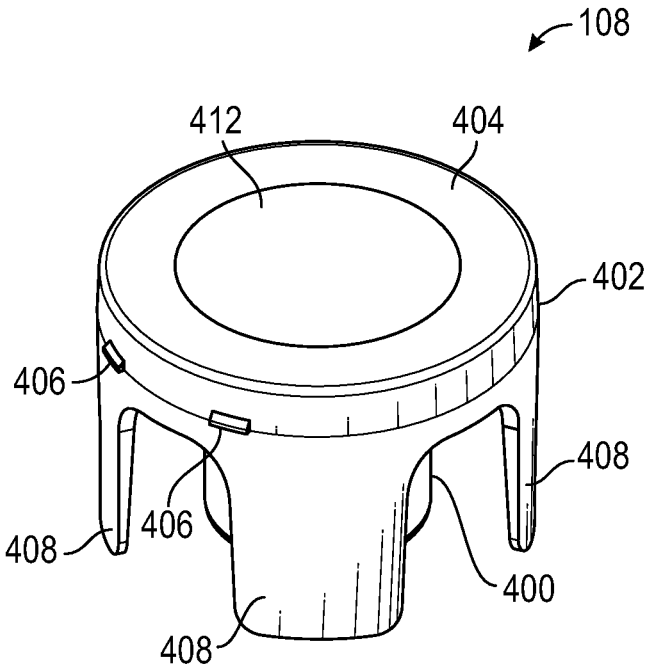
FIG. 13 is a side perspective view of the cylinder solution cup of FIG. 10 with a seal, according to an exemplary embodiment.

The rim also defines an opening 410 at a top of the cylinder solution cup 108 that feeds into the base 400. In various embodiments, the opening 410 is covered by a seal 412, as illustrated in FIG. 13. The seal 412 is formed of a foil, plastic, or another frangible material that can be pierced or breached. The seal 412 is configured to contain the oral fluid inside the base 400 until the oral care system 100 is to be used. However, the seal 412 is also configured to be breached, such as by being pierced by the spittoon straw 110 when a patient uses the oral care system 100, as described in further detail below. After the seal 412 has been breached or pierced, the head 204 of the toothbrush 104 is at least partially submerged in the oral fluid contained within the base 400. Alternatively, in other embodiments, the opening 410 is instead sealed through another penetrable barrier, such as a cover made of foam, rubber, or a similar flexible material with a cross cut.

Figure 14:
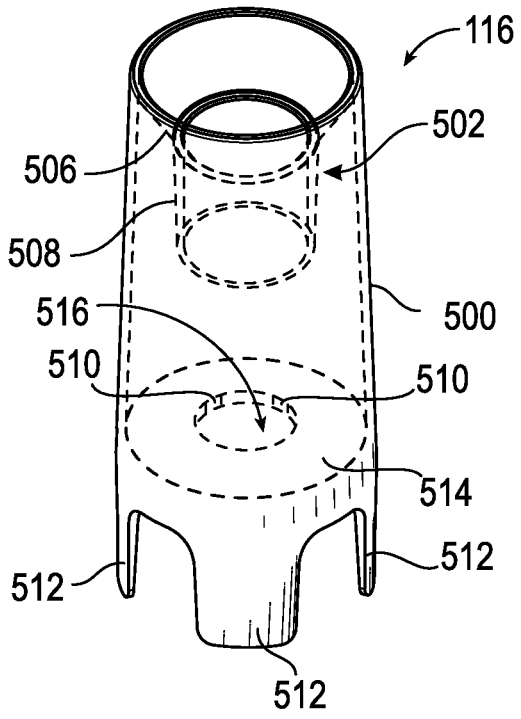
FIG. 14 is a schematic side perspective view of an oral fluid bottle, according to another exemplary embodiment.
Figure 15:
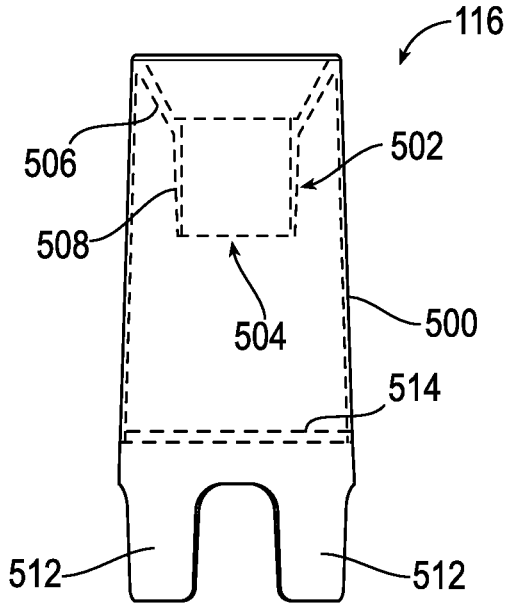
FIG. 15 is a schematic side view of the oral fluid bottle of FIG. 14, according to an exemplary embodiment.

Referring now to FIGS. 14 and 15, schematic side views of an oral fluid bottle 116 are shown, according to exemplary embodiments. Similar to the oral fluid bottle 106, the oral fluid bottle 116 includes a receptacle 500 and an internal chamber 502 defined within an interior portion of the oral fluid bottle 116, where the internal chamber 502 includes outlet 504. The internal chamber 502 also includes a funnel portion 506 that narrows to a neck portion 508 and provides a channel for receiving the spittoon straw 110, as well as providing spill resistance. In the embodiment shown, the receptacle 500 of the oral fluid bottle 106 is configured as a cylindrical cylinder, though in other embodiments the receptacle 500 has another shape (e.g., a rectangular shape). The oral fluid bottle 116 is further configured to widen from a top of the oral fluid bottle 116 to the bottom, which provides stability for the oral fluid bottle 116. However, unlike the oral fluid bottle 106, the oral fluid bottle 116 also includes legs 512 that provide a stable base for the oral fluid container 102. The oral fluid bottle 116 may include any number of legs 512 that provide a stable base, though in the embodiment shown in FIGS. 14 and 15, the oral fluid bottle 116 has four legs 512.

Figure 16:
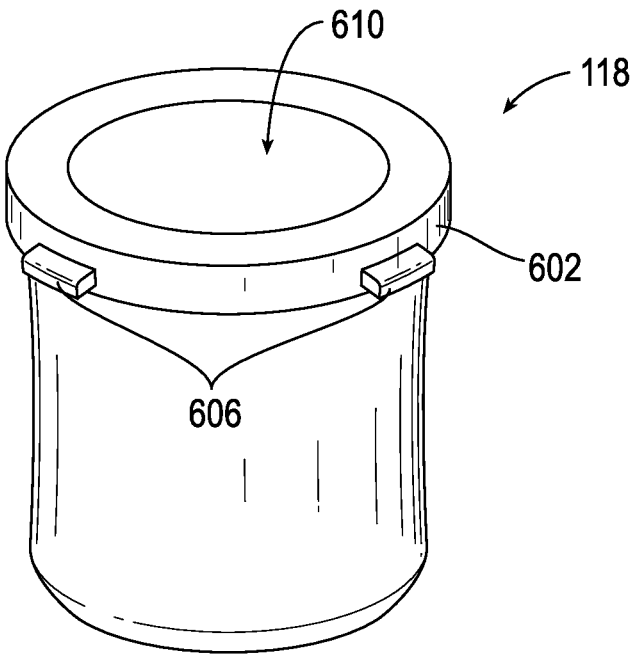
FIG. 16 is a side perspective view of a cylinder solution cup, according to another exemplary embodiment.
Figure 17:
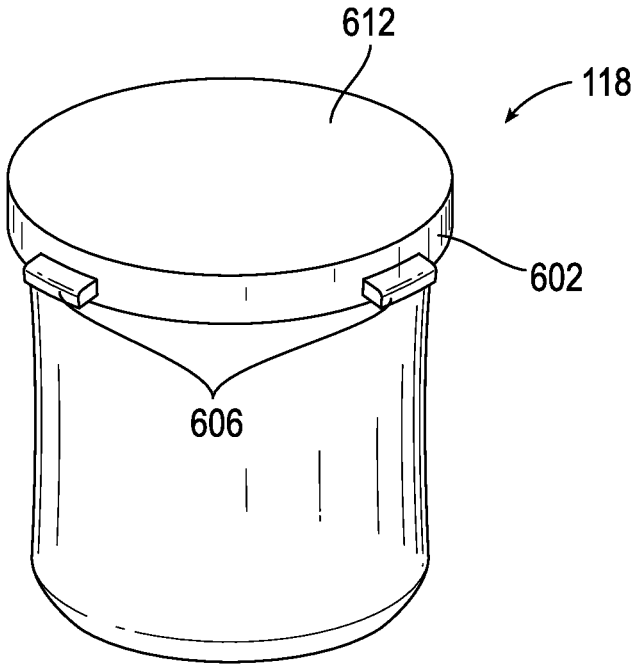
FIG. 17 is a side perspective view of a cylinder solution cup, according to another exemplary embodiment.

Additionally, rather than including an open bottom portion like oral fluid bottle 106, a lower portion of the oral fluid bottle 116 includes a bottom ledge 514 including an opening 516 configured to receive a cylinder solution cup (e.g., the cylinder solution cup shown in FIGS. 16 and 17). In various embodiments, the opening 516 includes apertures 510 for locking a cylinder solution cup onto the oral fluid bottle 116 that extend transversely into the bottom ledge 514. The apertures 510 may have various arrangements along the opening 516. For example, in some embodiments, the opening 516 includes apertures 510 positioned opposite the spaces between the legs 512. In other embodiments, the opening 516 may include a different mechanism for locking a cylinder solution cup into the oral fluid bottle 116, such as a rim around the opening 516 configured to receive a corresponding ridge on the circumference of the cylinder solution cup. Moreover, in some embodiments, the oral fluid bottle 106 does not include the bottom ledge 514, which is instead provided on the cylinder solution cup. In such embodiments, the oral fluid bottle 106 includes, for example, apertures 510 on receptacle 500 configured to receive the cylinder solution cup with the ledge, similar to the apertures 310 on the oral fluid bottle 106.

Referring now to FIG. 16, a side perspective view of a cylinder solution cup 118 is shown, according to an exemplary embodiment. As shown in FIG. 16, the cylinder solution cup 118 is similar to the base 400 of the cylinder solution cup 108. As such, the cylinder solution cup 118 is also configured to serve as a repository for an oral fluid and receive brushing waste. Further, the cylinder solution cup 118 is configured to be wide enough to receive the end of the spittoon straw 110, as well as deep enough that the head 204 of the toothbrush 104 can be at least partially submerged in the oral fluid contained therein. The cylinder solution cup 118 includes a rim 602 that carries projections 606. The projections 606 are spaced to align with the apertures 510 to lock the cylinder solution cup 108 into the opening 516 of the oral fluid bottle 106. For example, the projections 606 are positioned on the rim 602 to align with the apertures 510 on the oral fluid bottle 116, which are positioned opposite the spaces between the legs 512. Accordingly, an individual assembling an oral fluid container from the oral fluid bottle 116 and the cylinder solution cup 118 is able to align the cylinder solution cup 118 with the oral fluid bottle 116 by aligning the projections 606 with the spaces between the legs 512. Additionally, the rim 602, and the cylinder solution cup 118 overall, are configured such that when the projections 606 are snapped into the apertures 510, the receptacle 500 of the oral fluid bottle 106 and the rim 602 can contain a liquid.

The rim 602 also defines an opening 610 at a top of the cylinder solution cup 118 that feeds into the body of the cylinder solution cup 118. In various embodiments, the opening 610 is covered by a seal 612, as illustrated in FIG. 17. In various arrangements, the seal 612 is configured similarly to the seal 412 of the cylinder solution cup 108.

Figure 18:
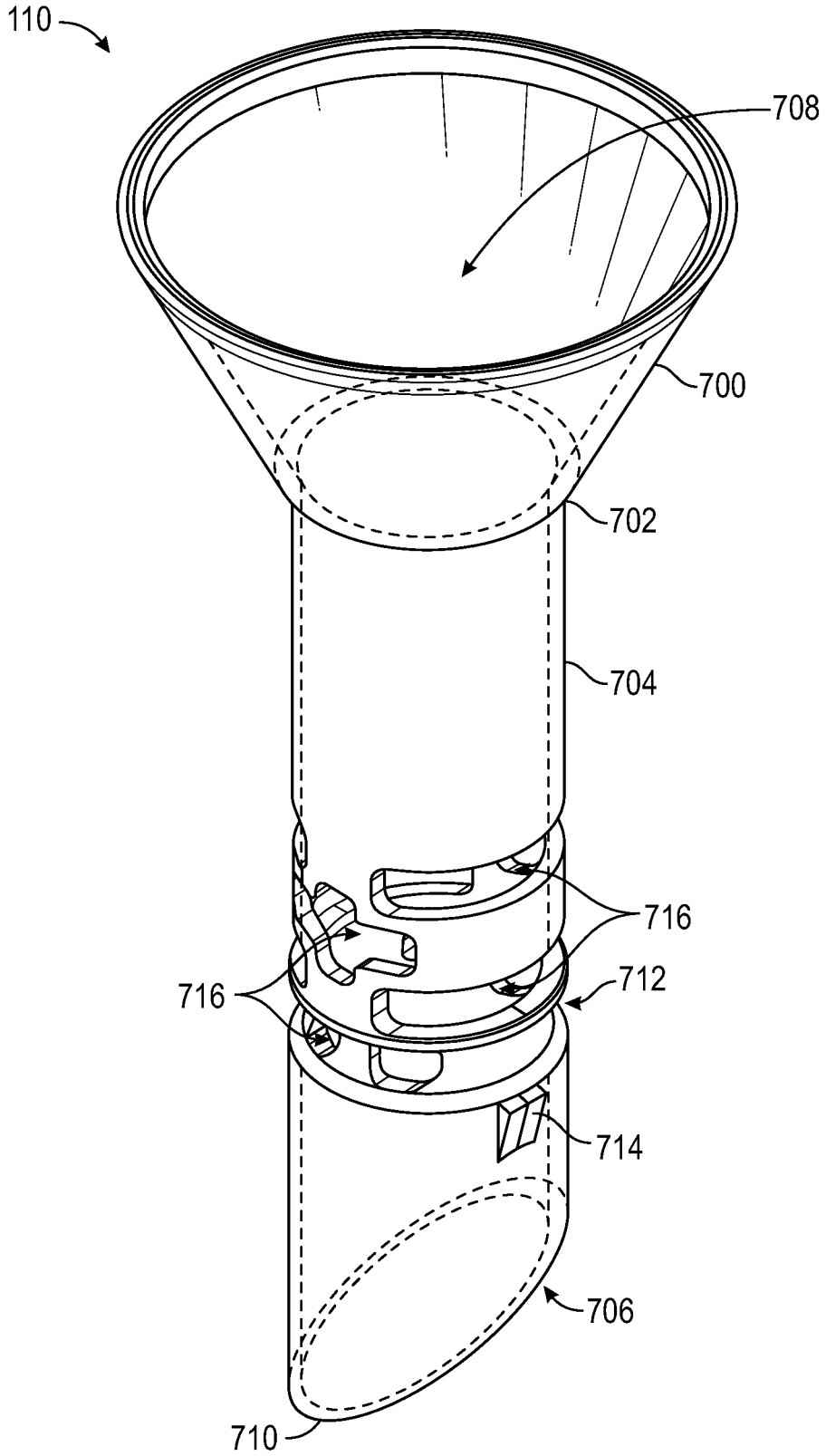
FIG. 18 is a schematic side perspective view of a spittoon straw of FIG. 1, according to an exemplary embodiment.

Referring now to FIG. 18, a schematic side perspective view of the spittoon straw 110 is shown, according to an exemplary embodiment. The spittoon straw 110 includes a funnel 700 that connects at a base 702 of the funnel 700 to a tube 704 with an opening 706 at the end thereof. The funnel 700 and the tube 704 are configured to be inserted into the internal chamber 302 of the oral fluid bottle 106 such that the tube 704 protrudes into the receptacle 300. Accordingly, the spittoon straw 110 facilitates the passage of brushing waste into an internal portion of the receptacle 300 during or after the use of a toothbrush (e.g., the toothbrush 104) by the patient. The funnel 700 provides a larger area for the patient to deposit the brushing waste into while brushing to minimize any mess associated with spitting into the unit dose oral fluid container 102. The funnel 700 and the tube 704 then channel the brushing waste into the receptacle 300 via an inlet 708 of the spittoon straw 110 and the opening 706. Additionally, the end of the spittoon straw 110 is cut at a diagonal, such that the plane of the opening 706 lies at an angle relative to the axis of the straw 110. In this way, the end of the straw 110 at the opening 706 comprises a leading edge that forms a cutting portion 710 on one side. The cutting portion 710 can be used, for example, to break or breach the seal 412 on the cylinder solution cup 108 snapped onto the oral fluid bottle 106 or the seal 612 on the cylinder solution cup 118 snapped onto the oral fluid bottle 116.

Figure 19:
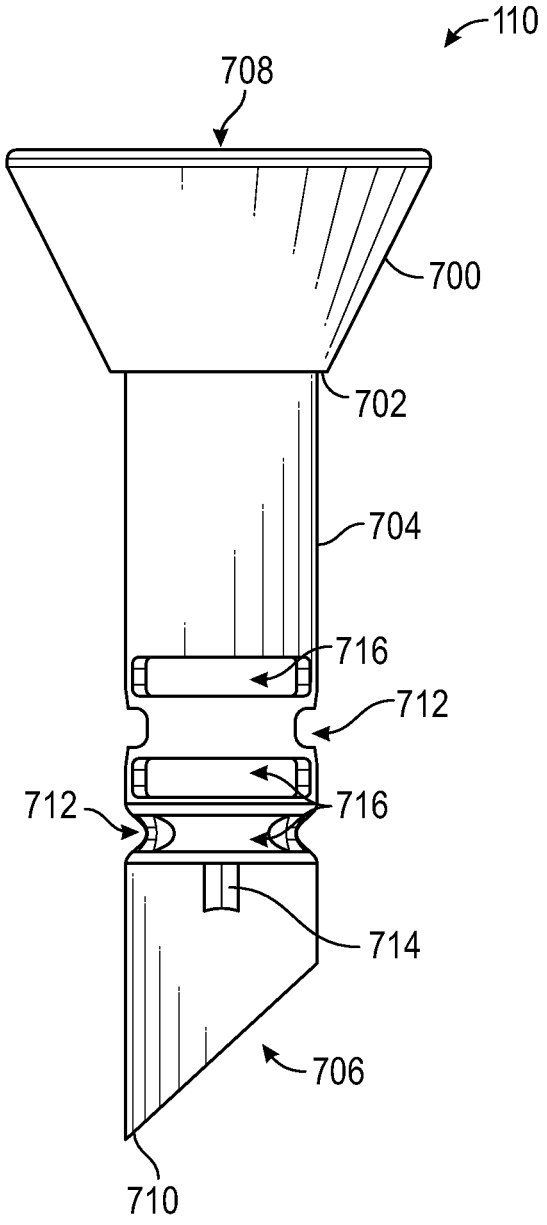
FIG. 19 is a side view of the spittoon straw of FIG. 16, according to an exemplary embodiment.
Figure 20:
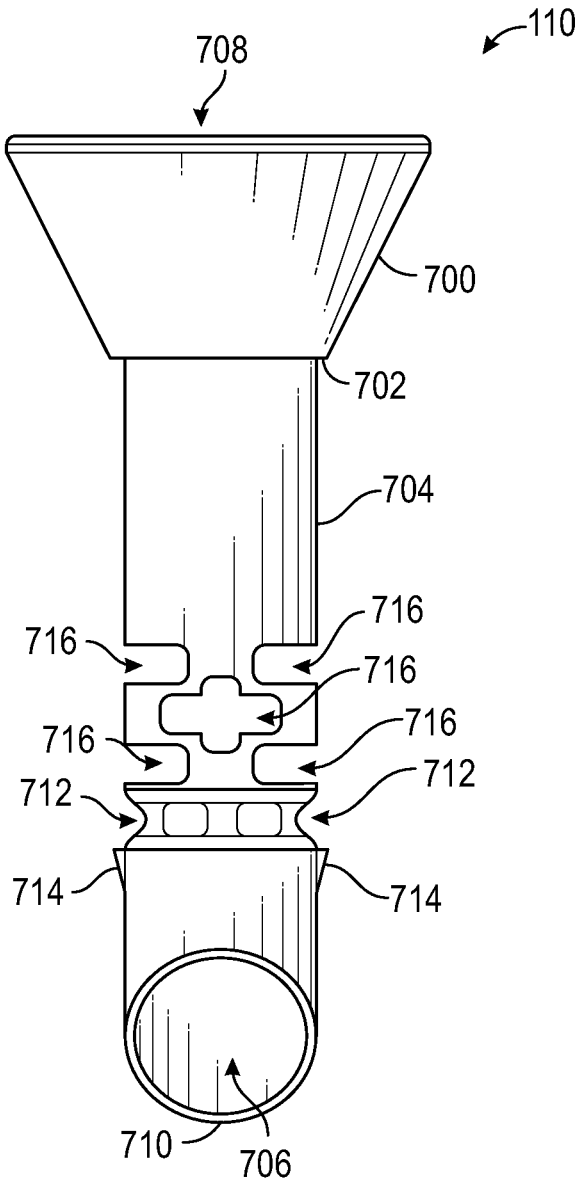
FIG. 20 is a side view of the spittoon straw of FIG. 16, according to an exemplary embodiment.

Referring now to FIGS. 19 and 20, side views of the spittoon straw 110 are shown, according to an exemplary embodiment. As shown in FIGS. 19 and 20, the funnel base 702 includes a lip such that the base 702 is wider than the top of the tube 704 of the spittoon straw 110. Accordingly, the spittoon straw 110 is configured to receive the toothbrush 104 in a central channel of the spittoon straw 110 formed in the funnel 700 and the tube 704 such that the projection seal 218*a* rests on the base 702, thereby sealing the oral care system 100 from outside contaminants once assembled. Additionally, the tube 704 is sized with a diameter wide enough to snugly fit the projection seal 218*b* therein, further sealing the oral care system 100 from outside contaminants. Furthermore, as shown, the tube 704 includes an indentation 712. The indentation 712 is configured to rest below the head 204 of the toothbrush 104 such that once the toothbrush 104 is inserted into the tube 704, a small force must be applied to remove the toothbrush 104 from the spittoon straw 110.

As shown in FIGS. 19 and 20, the tube 704 of the spittoon straw 110 also includes projections 714. The projections 714 are angled such that the spittoon straw 110 can be inserted into the internal chamber 302 of the oral fluid bottle 106 but are configured to, once inserted, abut against the outlet 304 of the oral fluid bottle 106 to prevent spittoon straw 110 from being pulled out from the internal chamber 302. As such, the projections 714 prevent the spittoon straw 110 from being pulled out of the oral fluid bottle 106 once inserted. In the embodiment shown in FIGS. 19 and 20, the spittoon straw 110 includes two projections 714, though in other embodiments, the spittoon straw 110 may include more projections 714.

Alternatively, in other embodiments, the spittoon straw 110, the oral fluid bottle 106, and/or the cylinder solution cup 108 include a different mechanism for preventing the spittoon straw 110 from sliding out of the oral fluid bottle 106. In one example, the spittoon straw 110 includes projections 714 further down the length of the tube 704, and the top of the cylinder solution cup 108 includes notches that engage with the projections 714. Accordingly, one the spittoon straw 110 is pushed into the cup 108, the engagement between the projections 714 and the notches prevent the spittoon straw 110 from being subsequently pulled out from the cup 108. In another example, the funnel 700 includes projections, and the top of the oral fluid bottle 106 includes notches that engage with the projections such that once the spittoon straw 110 is pushed far enough into the oral fluid bottle 106, the notches engage with the projections and the spittoon straw 110 cannot subsequently be pulled back beyond the notches.

Furthermore, the spittoon straw 110 includes apertures 716 formed into a side wall of the tube 704 of the spittoon straw 110. The apertures 716 allow the oral fluid container 102, including the oral fluid bottle 106, cylinder solution cup 108, and spittoon straw 110, to be spill-resistant. For example, when the oral fluid container 102 is tipped, liquids contained within the receptacle 300 (e.g., unused oral fluid, brushing waste) may flow into the tube 704 of the spittoon straw 110 but subsequently flow out through the apertures 716 in the side wall of the tube 704 and back into the receptacle 300. The apertures 716 are designed to provide a maximum amount of flow out of the tube 704 without compromising the structural integrity of the tube 04.

Additionally, in some embodiments, the spittoon straw 110 includes projections configured to prevent the spittoon straw 110 from being pulled upward once the spittoon straw 110 is depressed into the oral fluid bottle 106 (e.g., to submerge the head 204 of the toothbrush in the oral fluid in the cylinder solution cup 108). As an example, the spittoon straw 110 includes projections provided on the tube 704 of the spittoon straw 110 above the apertures 716 (e.g., two projections on opposite sides of the tube 704). The projections sit above the neck portion 308 of the oral fluid bottle 106 before the spittoon straw 110 is depressed into the oral fluid bottle 106. To press the spittoon straw 110 into the oral fluid bottle 106, a user must apply a small downward force to push the projections through the neck portion 308. Then, once the spittoon straw 110 is depressed into the oral fluid bottle 106, the projections lie below the outlet 304 and cannot be pulled back into the neck portion 308. As such, the spittoon straw 110 cannot be pushed upwards once the spittoon straw 110 is depressed into the oral fluid bottle 106 and the cylinder solution cup 108. As such, these projections aid a user in pulling the toothbrush 104 out of the oral fluid bottle 106 and the spittoon straw 110.

Referring back to FIG. 1, the assembled oral care system 100 is shown. Accordingly, the cylinder solution cup 108 has been snapped into the oral fluid bottle 106 such that the projections 406 of the cylinder solution cup 108 fit into the apertures 310 of the oral fluid bottle 106. Additionally, the spittoon straw 110 has been inserted into the internal chamber 302 of the oral fluid bottle 106 such that the projections 714 prevent the spittoon straw 110 from being pulled out of the oral fluid container 102. As shown, in the embodiment of FIG. 1, the components of the oral fluid container 102 (i.e., the oral fluid bottle 106, the cylinder solution cup 108, and the spittoon straw 110) are configured to have circular cross sections, though in other embodiments, the components may have different cross sections (e.g., elliptical, oblong, square, rectangular, hexagonal, octagonal, or other multisided cross section). Alternatively, in other embodiments, an assembled oral care system is formed from the cylinder solution cup 118 snapped into the oral fluid bottle 116 such that the projections 606 of the cylinder solution cup 118 fit into the apertures 510 of the oral fluid bottle 116 and the spittoon straw 110 inserted into the internal chamber 502 of the oral fluid bottle 116.

The toothbrush 104 has also been inserted into the tube 704 of the spittoon straw 110 in FIG. 1. The head 204 of the toothbrush 104 is positioned below the indentation 712 such that the indentation 712 holds the toothbrush 104 within the spittoon straw 110 and a small force must be applied to remove the toothbrush 104 from the spittoon straw 110. Accordingly, the projection seal 218*a* rests on the base 702 of the spittoon straw 110, and the projection seal 218*b* sits inside the tube 704. Together, the projection seals 218*a* and 218*b* seal the interior of the oral care system 100 from outside contaminants. Additionally, the projection seal 218*a* resting on the base 702 prevents the toothbrush 104 from sliding completely into the tube 704 and into the receptacle 300. Similarly, the projection seal 218*b* fits snugly into the tube 704 such that the circumference of the projection seal 218*b* abuts the wall of the tube 704, further sealing the oral fluid container 102. Furthermore, the fact that the projections 208 are offset from the center of the toothbrush 104 allows the toothbrush 104 to be inserted into the spittoon straw 110 without crushing the bristles 214 of the toothbrush head 204.

In some embodiments, the oral care system 100 is packaged as a pre-assembled unit as shown in FIG. 1. In other embodiments, the oral care system 100 is packaged as separate components (e.g., the oral fluid bottle 106, toothbrush 104, cylinder solution cup 108, and spittoon straw 110 are packaged separately) such that a user, such as a medical care professional or a patient, must assemble the oral care system 100. Additionally, the components of the oral care system 100 are manufactured from any type of appropriate spill-resistant and sanitary materials. For example, in some embodiments, the seal 412 is made from a polyethylene film, and the cylinder solution cup 108 is a polyethylene cup. Additionally, in some embodiments, the oral fluid bottle 106 and the spittoon straw 110 are made of polypropylene.

Figure 21:
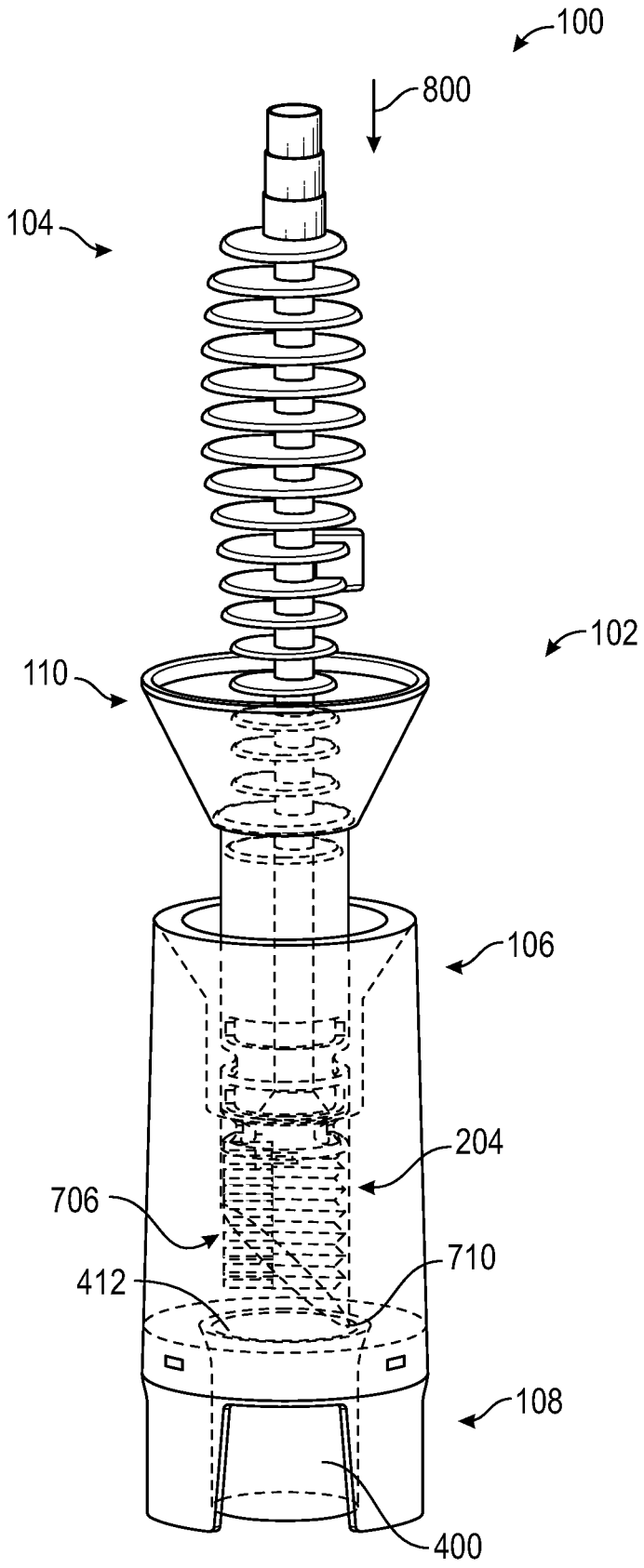
FIG. 21 depicts a step of using the oral care system of FIG. 1, according to an exemplary embodiment.
Figure 22:
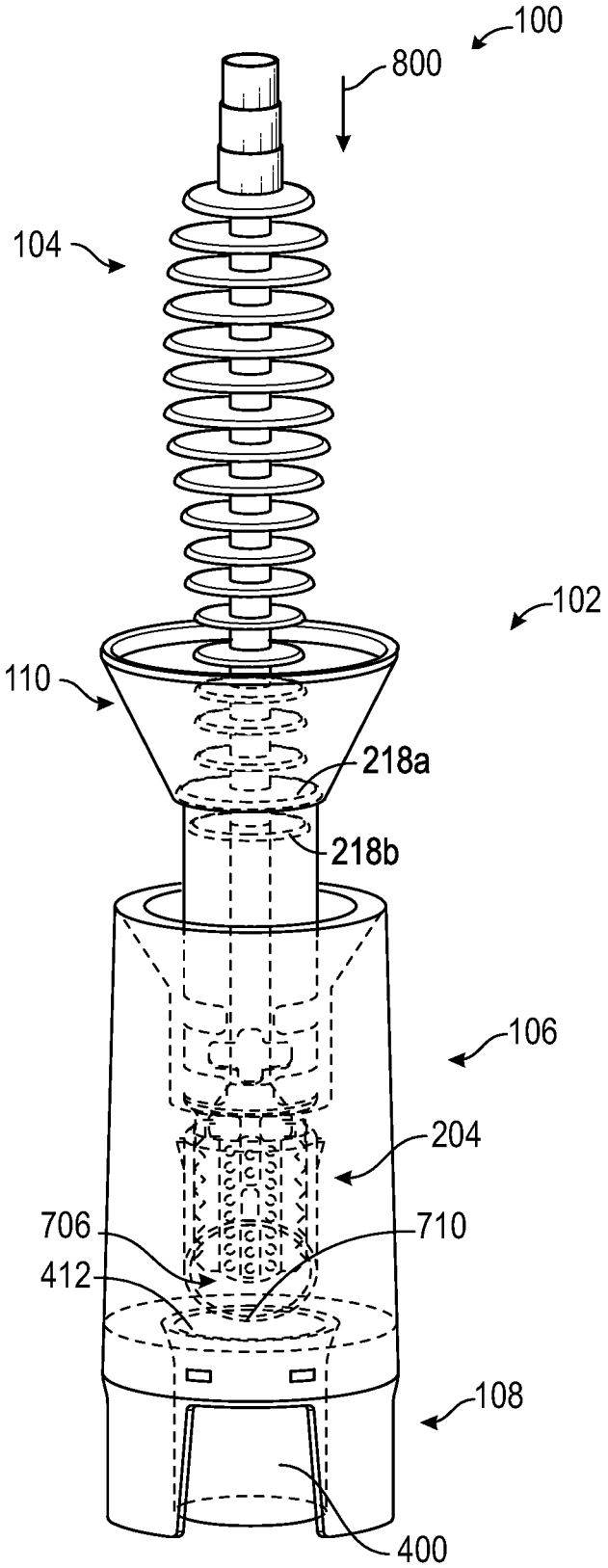
FIG. 22 depicts a step of using the oral care system of FIG. 1, according to an exemplary embodiment.

Referring now to FIGS. 21-28, side views of the oral care system 100 are shown during steps of use. To begin with FIGS. 21 and 22 depict side views of the assembled oral care system 100 before use. As shown, the point 710 of the spittoon straw 110 rests proximal the seal 412 of the cylinder solution cup 108. To use the oral care system 100, a patient or medical care professional thus pushes on the toothbrush 104 and/or the spittoon straw 110 as depicted by arrow 800 until the point 710 of the spittoon straw 110 breaches the seal 412. In some embodiments, the spittoon straw 110 can be moved approximately 0.64 cm (0.25 inches) within the receptacle 300. Accordingly, the patient or medical care professional can move the spittoon straw 110 in a first direction and subsequently push the spittoon straw 110 in an opposite direction towards the seal 412 to facilitate breaching, such as breaking, of the seal 412.

Figure 23:
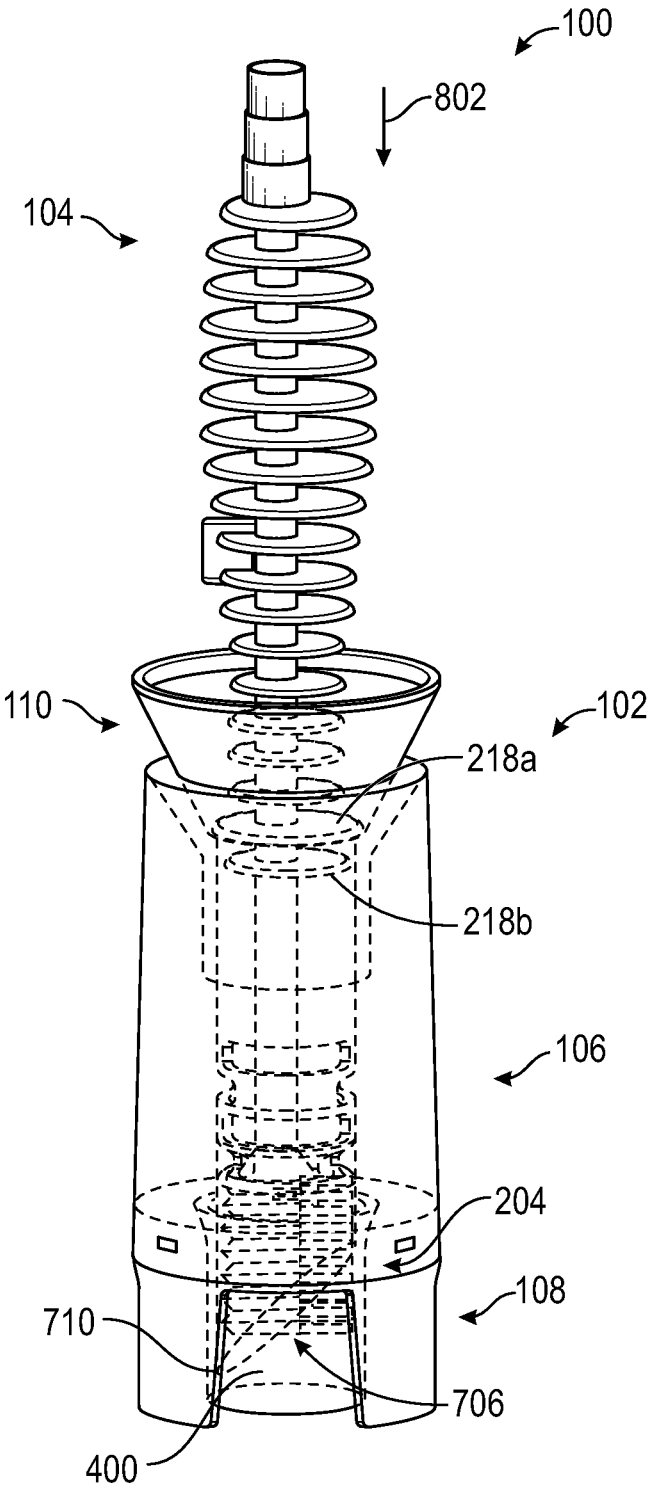
FIG. 23 depicts a step of using the oral care system of FIG. 1, according to an exemplary embodiment.
Figure 24:
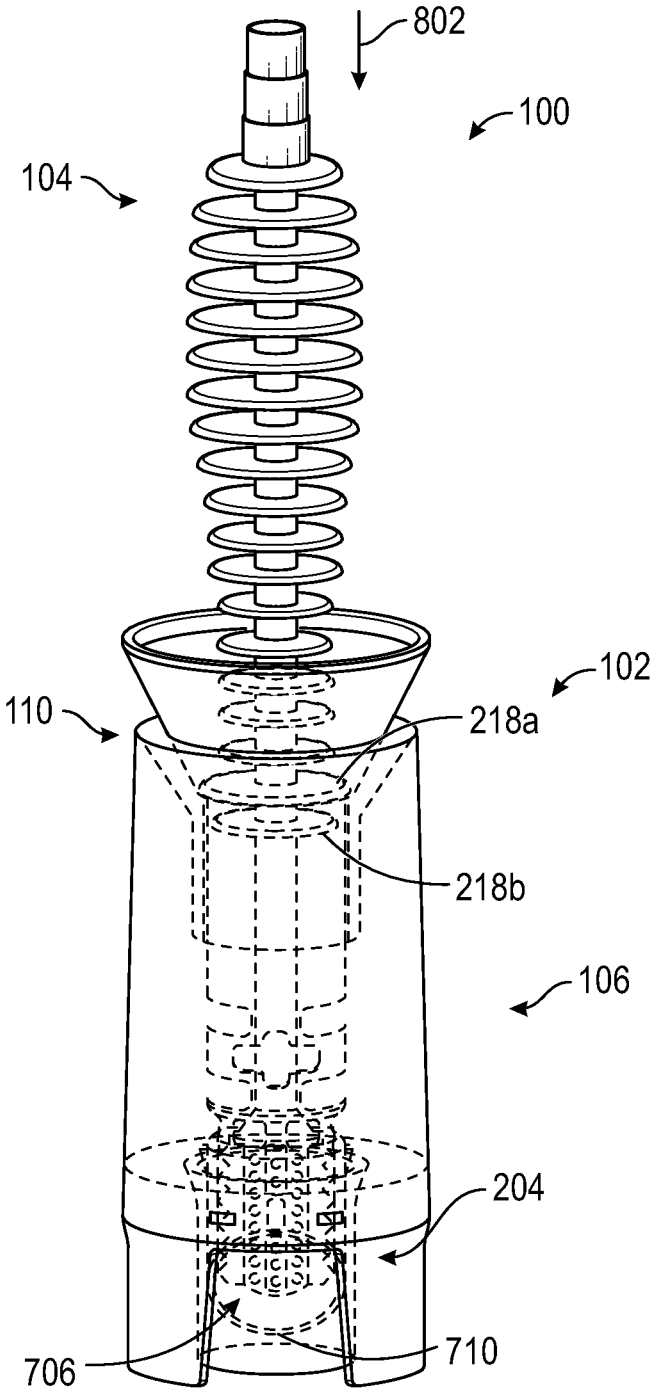
FIG. 24 depicts a step of using the oral care system of FIG. 1, according to an exemplary embodiment.

The patient or care provider then continues to press the toothbrush 104 and/or the spittoon straw 110 in a direction depicted by arrow 802 such that the opening 706 of the spittoon straw 110 and the head 204 of the toothbrush 104 become substantially submerged in the oral fluid contained within the base 400 of the cylinder solution cup 108. The patient or medical care professional presses until the point 710 of the spittoon straw 110 reaches proximal the bottom of the cylinder solution cup 108 as shown in FIGS. 23 and 24. Doing so ensures that the head 204 of the toothbrush 104 is substantially submerged in the oral fluid. Additionally, in some embodiments, pushing the spittoon straw 110 into the base 400 of the cylinder solution cup 108 presses projections provided on the tube 704 of the spittoon straw 110 through the neck portion 308 of the oral fluid bottle 106 such that the spittoon straw 110 cannot be pulled substantially upwards out of the oral fluid bottle 106.

Figure 25:
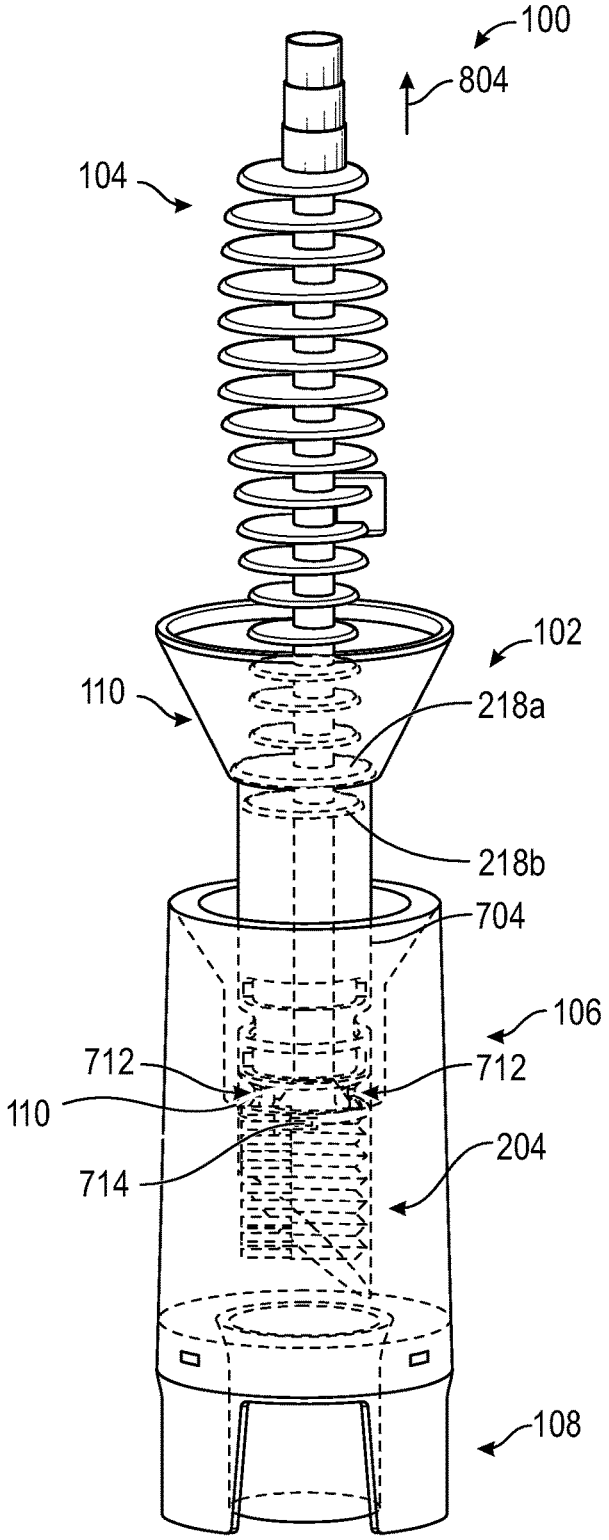
FIG. 25 depicts a step of using the oral care system of FIG. 1, according to an exemplary embodiment.
Figure 26:
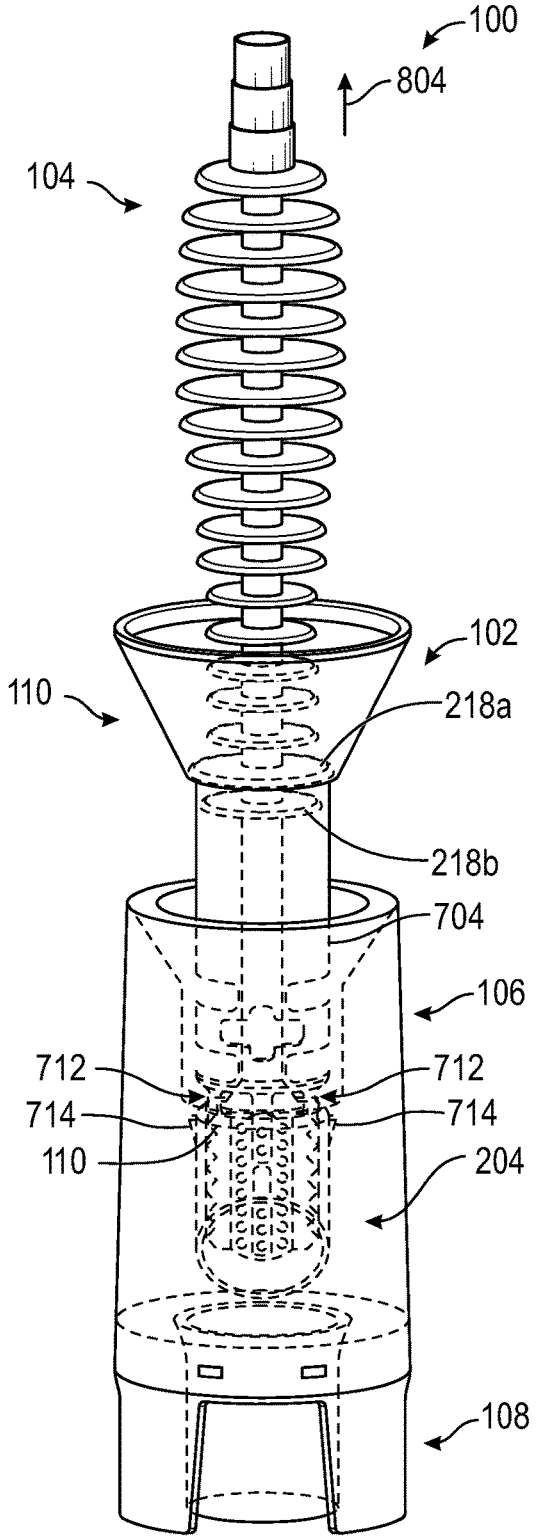
FIG. 26 depicts a step of using the oral care system of FIG. 1, according to an exemplary embodiment.
Figure 27:
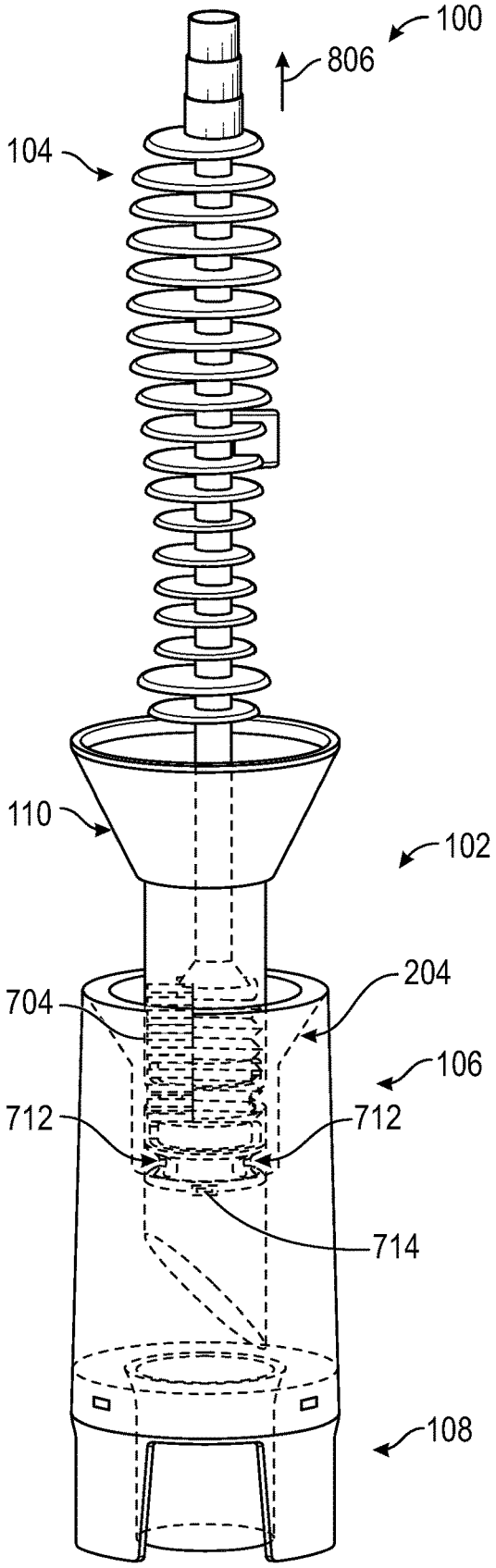
FIG. 27 depicts a step of using the oral care system of FIG. 1, according to an exemplary embodiment.
Figure 28:
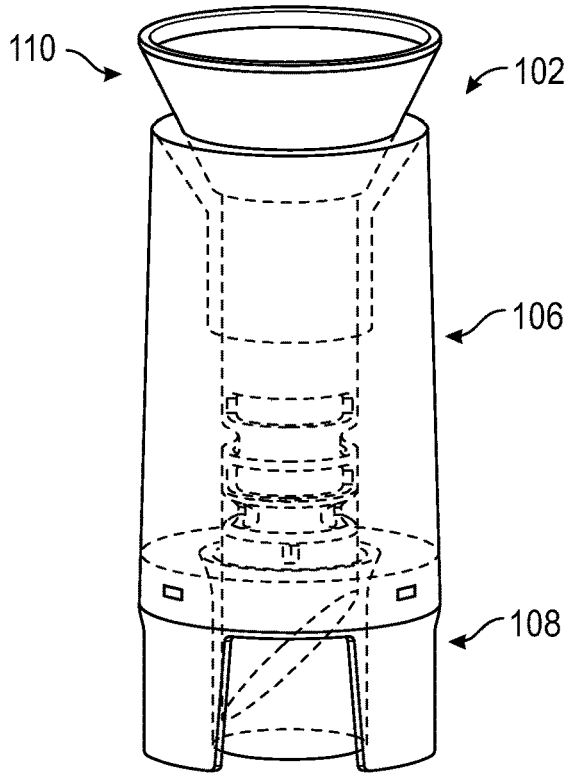
FIG. 28 depicts a step of using the oral care system of FIG. 1, according to an exemplary embodiment.

Once the toothbrush head 204 is substantially submerged in the oral fluid, the patient or medical care professional pulls on the toothbrush 104 and/or the spittoon straw 110 in a direction depicted by arrow 804. Doing so withdraws the spittoon straw 110 and the toothbrush 104 contained therein. The spittoon straw 110 continues to be withdrawn until the projections 714 on the tube 704 of the spittoon straw 110 contact the outlet 304 of the oral fluid container 102, as shown in FIGS. 25 and 26. The projections 714 thus prevent the spittoon straw 110 from being withdrawn further. Alternatively, in some embodiments, the spittoon straw 110 includes projections provided on the tube 704 of the spittoon straw 110 that engage with the outlet 304 and prevent the spittoon straw 110 from being pulled substantially upwards out of the oral fluid bottle 106 once the projections have been pushed through the neck portion 308 of the oral fluid bottle 106.

At this point, the patient or medical care professional continues to pull the toothbrush 104 in a direction depicted by arrow 806 until the head 204 of the toothbrush 104 slides past the indentation 712 and out of the spittoon straw 110, as shown in FIG. 25. In some embodiments, the tube 704 is configured to squeeze excess oral fluid from the head 204 of the toothbrush 104 as the toothbrush 104 is pulled out of the spittoon straw 110. Once the toothbrush 104 is removed from the oral care system 100, the spittoon straw 110 falls back into the oral fluid bottle 106 and/or into the cylinder solution cup 108 as shown in FIG. 26. Alternatively, if the spittoon straw 110 includes projections that engage with the outlet 304 once pushed through the neck portion 308, the spittoon straw 110 remains in the oral fluid bottle 106 and/or the cylinder solution cup 108. As such, a medical care professional can easily check that the patient has used the oral care system 100 by looking to see whether the spittoon straw 110 is in its original position with respect to the oral fluid container 102 or whether it is further inside the oral fluid bottle 106, as shown in FIG. 26, indicating use.

Once the patient has pulled the toothbrush 104 out of the oral care system 100, the patient can use the toothbrush 104 in a standard fashion to brush the patient's teeth. During or after brushing, the patient spits into the funnel 700 of the spittoon straw 110 to remove oral fluid from the patient's mouth. When the patient has finished the oral care treatment, the oral care system 100 is to be disposed. In some arrangements, the patient reinserts the toothbrush 104 into the tube 704 of the spittoon straw 110 before disposing of the oral care system 100.

Figure 44:
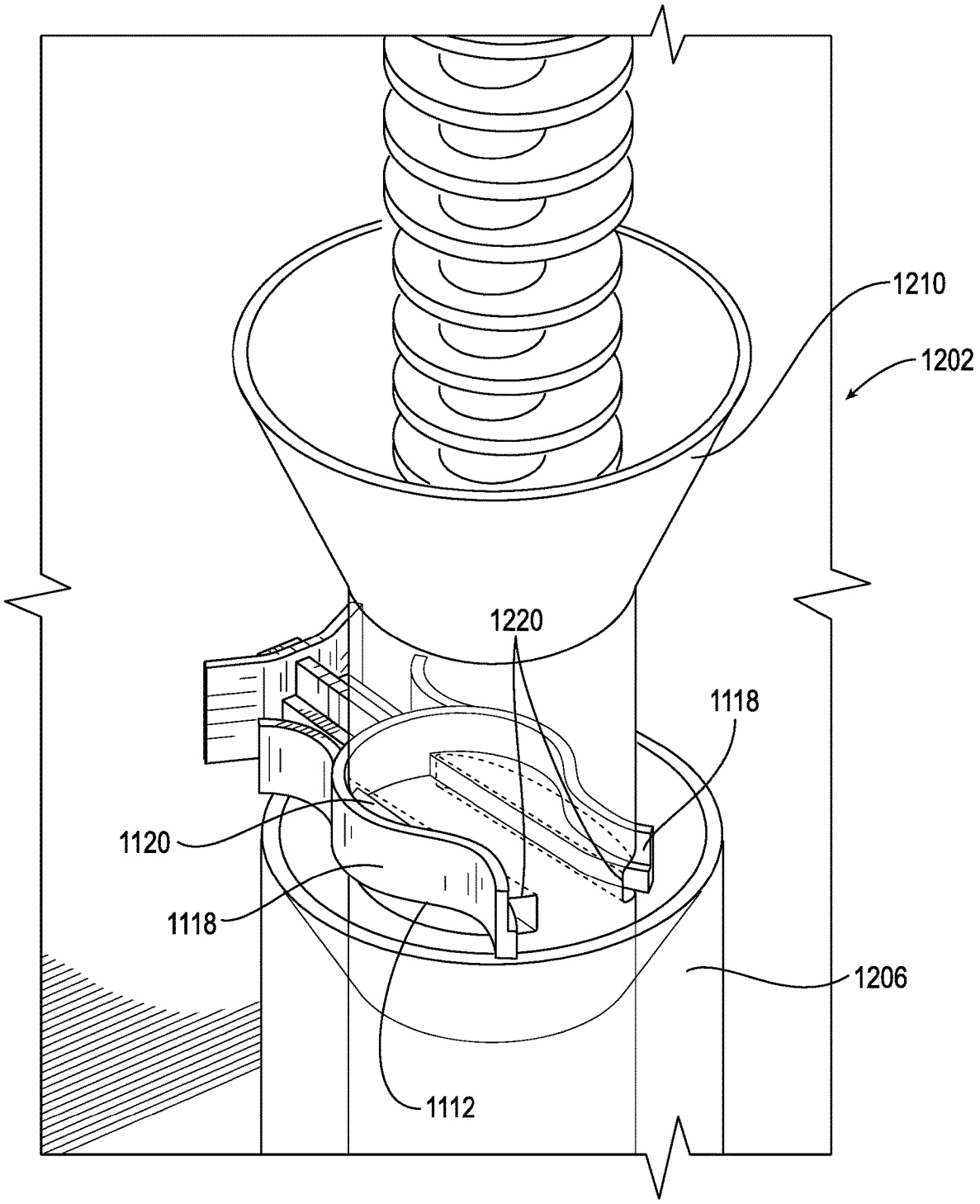
FIG. 44 is a side perspective view of the packaging unit of FIG. 40 holding oral care systems, according to an exemplary embodiment.

It should be understood that the oral care system 100 illustrated in use in FIGS. 21-28 is intended to be exemplary and that other oral care systems and configurations may instead be used in other embodiments. For example, in some embodiments, the oral fluid bottle 116 shown in FIGS. 14 and 15 is used instead of the oral fluid bottle 106 and the cylinder solution cup 118 shown in FIGS. 16 and 17 is used instead of the cylinder solution cup 108. Additionally, an oral care system may include additional or different components, such as a removable plunger configured to fit within the suction port 210 of the toothbrush 104 to prevent fluid from backing up through the suction port 210 and the projecting suction opening 212 when the suction port 210 and the projecting suction opening 212 are not in use (e.g., as shown in FIG. 44).

Figure 30:
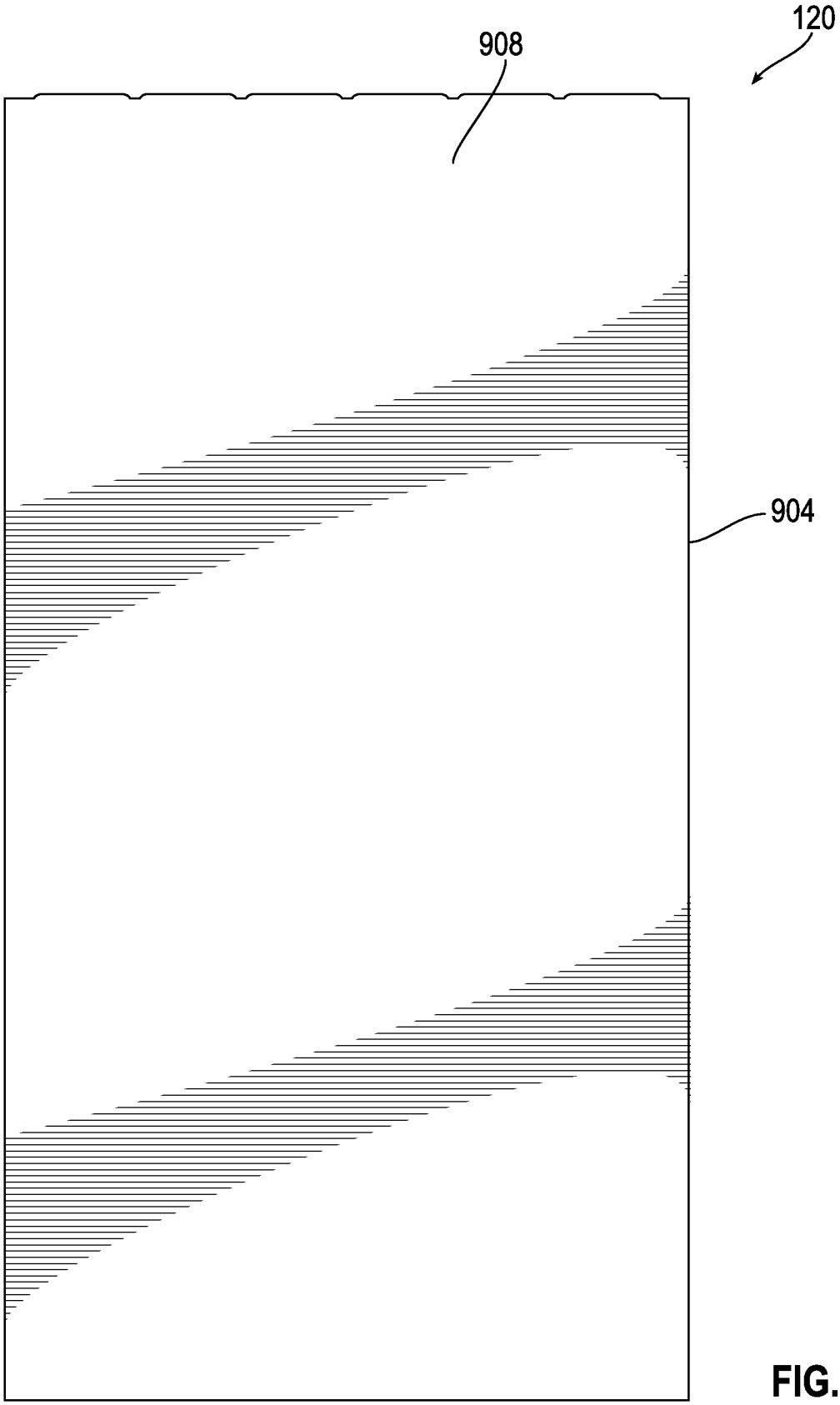
FIG. 30 is a back view of the packaging unit of FIG. 29, according to an exemplary embodiment.

Referring now to FIGS. 29-33, views of a packaging unit 120 for holding oral care systems, such as the oral care system 100, are shown, according to exemplary embodiments. FIG. 29 shows a side perspective view of the packaging unit 120. As shown in FIG. 29, the packaging unit 120 includes a top section 900 and a bottom section 902. The top section 900 includes a panel 904 that forms the back of the packaging unit 120. The panel includes a front surface 906 and, as shown in FIG. 30 illustrating a back view of the packaging unit 120, a back surface 908.

Figure 31:
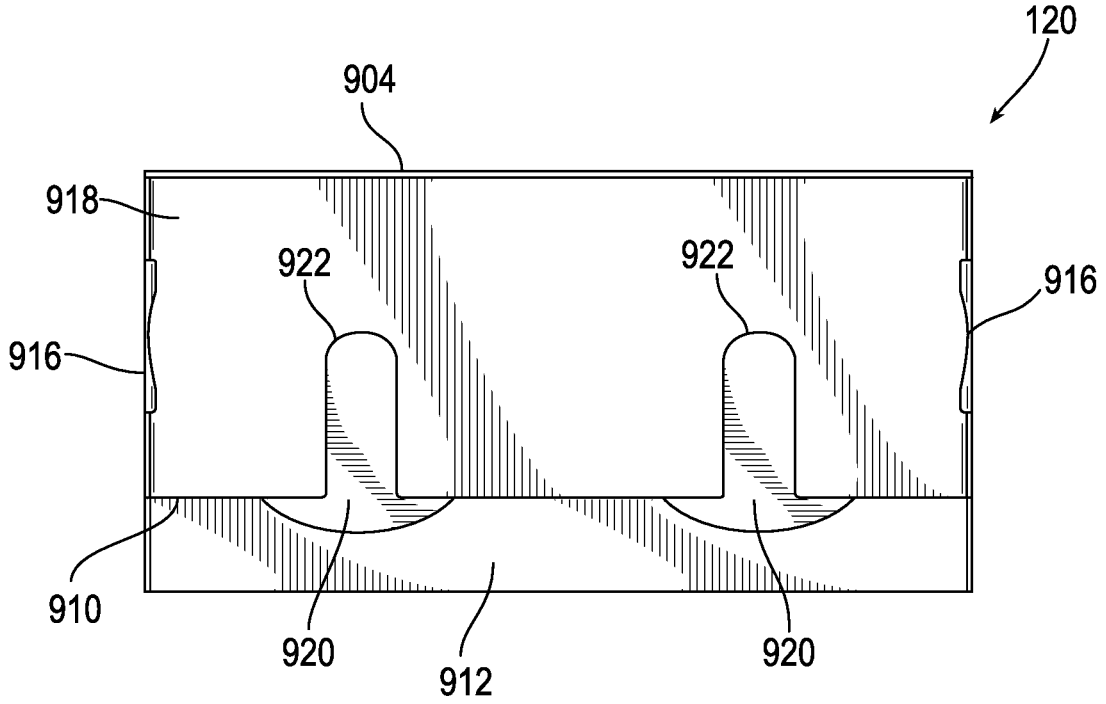
FIG. 31 is a top view of the packaging unit of FIG. 29, according to an exemplary embodiment.
Figure 32:
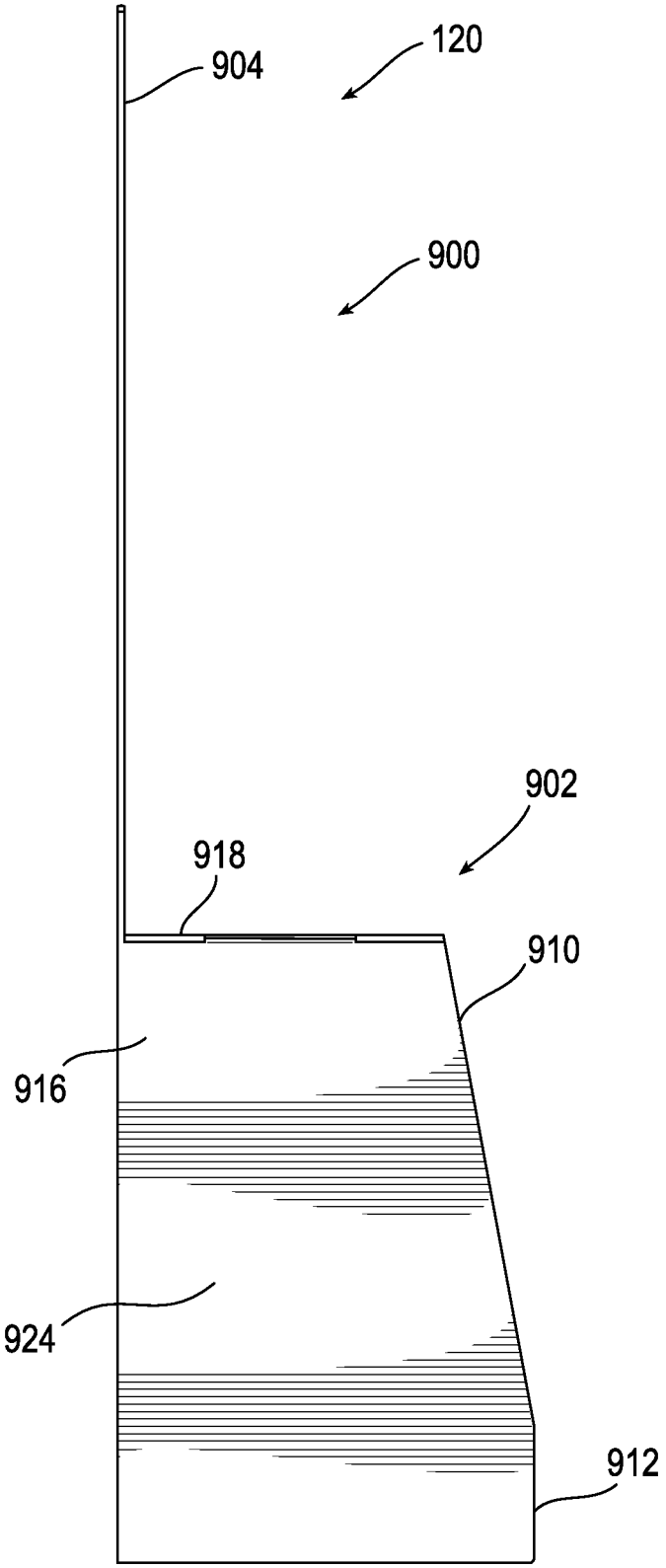
FIG. 32 is a side view of the packaging unit of FIG. 29, according to an exemplary embodiment.

The bottom section 902 includes an oral care system container 910 formed from the panel 904, a base 912, side flaps 916, and a top overhang 918. As shown in FIG. 29, the base 912 includes a recess 920 for each of the oral care systems that the packaging unit 120 is configured to hold. Each recess 920 is configured to receive and hold a lower portion of an oral care system. For example, the recess 920 is configured to receive the base 400 and legs 408 of the cylinder solution cup 108 or the cylinder solution cup 118 and the legs 512 of the oral fluid bottle 116. Additionally, the top overhang 918 includes a slot 922 for each of the oral care systems that the packaging unit 120 is configured to hold. Each slot 922 is positioned over the corresponding recess 920 in the packaging unit 120, as illustrated in FIG. 31, which shows a top view of the packaging unit 120. Each slot 922 is configured to receive and secure an upper portion of the oral care system, such as the toothbrush 104 and/or the spittoon straw 110. As an illustration, in some embodiments, the spittoon straw 110 includes grooves configured to receive the sides of the slot 922 to secure the oral care system 100 to the packaging unit 120, as described in further detail below. FIG. 32 shows a left side view of the packaging unit 120. As shown in FIG. 32, each side flap 916 includes a side surface 924.

In various embodiments, the packaging unit 120 is fabricated of a flexible, pliable material such as cardboard, cardstock, or a plastic sheet. Additionally, in some embodiments, the packaging unit 120 is formed as a flat sheet (e.g., a flat sheet of cardboard) and is configured to fold into the configuration shown in FIGS. 29-32, including the oral care system container 910. Accordingly, in such embodiments, the packaging unit 120 includes tabs and inserts, tabs and adhesive, or another mechanism for assembling the packaging unit 120 from the flat sheet.

Additionally, in various embodiments, the configuration of the packaging unit 120 provides a small footprint for packaging and providing oral care systems. For example, the packaging unit 120 takes up little or minimal table surface space, which is beneficial because in many hospital situations, patients may have access to limited table surfaces. At the same time, the packaging unit 120 itself includes a large amount of surface space that can be used, in various arrangements, for marketing, for providing use instructions for the oral care system, for providing drug facts, and so on. For example, in one embodiment, the front surface 906 includes brief instructions for using the oral care system. The back surface 908 includes information on why using oral care systems in a hospital setting is beneficial, detailed instructions for using an oral care system, drug facts, and manufacturer information. The side surfaces 924 include additional brief information on using the oral care system and why using the oral care system is beneficial. Additionally, further surfaces of the packaging unit 120 may also be used, such as the front portion of the base 912.

Figure 33:
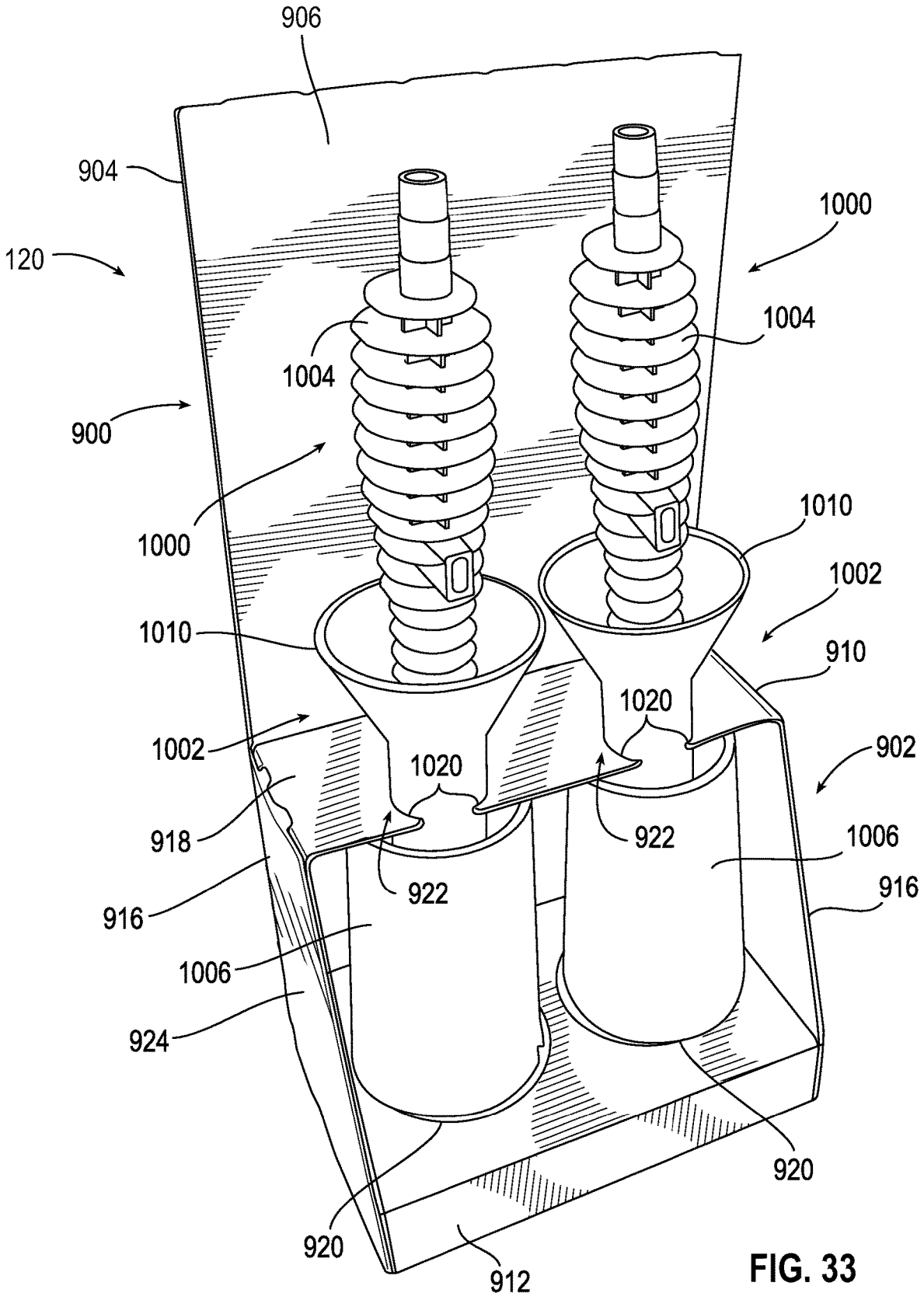
FIG. 33 is a side perspective view of the packaging unit of FIG. 29 holding oral care systems, according to an exemplary embodiment.

Referring now to FIG. 33, a side perspective view of a packaging unit 120 holding oral care systems 1000 is shown, according to an exemplary embodiment. In various embodiments, the oral care systems 1000 are configured similarly to the oral care system 100, with each oral care system 1000 including an oral fluid container 1002 (e.g., including an oral fluid bottle 1006, a cylinder solution cup (not visible), and a spittoon straw 1010) and a toothbrush 1004. Additionally, in various embodiments, these components of each oral care system 1000 are configured similarly to the oral fluid container 102, toothbrush 104, oral fluid bottle 106 or 116, cylinder solution cup 108 or 118, and spittoon straw 110 discussed above. As shown in FIG. 33, each recess 920 of the packaging unit 120 is shaped to receive the lower portion of an oral care system 1000 (e.g., shaped to receive the legs 408 or the legs 512). Moreover, each slot 922 is shaped to receive an upper portion of the oral care system 1000, such as the spittoon straw 1010.

Figure 34:
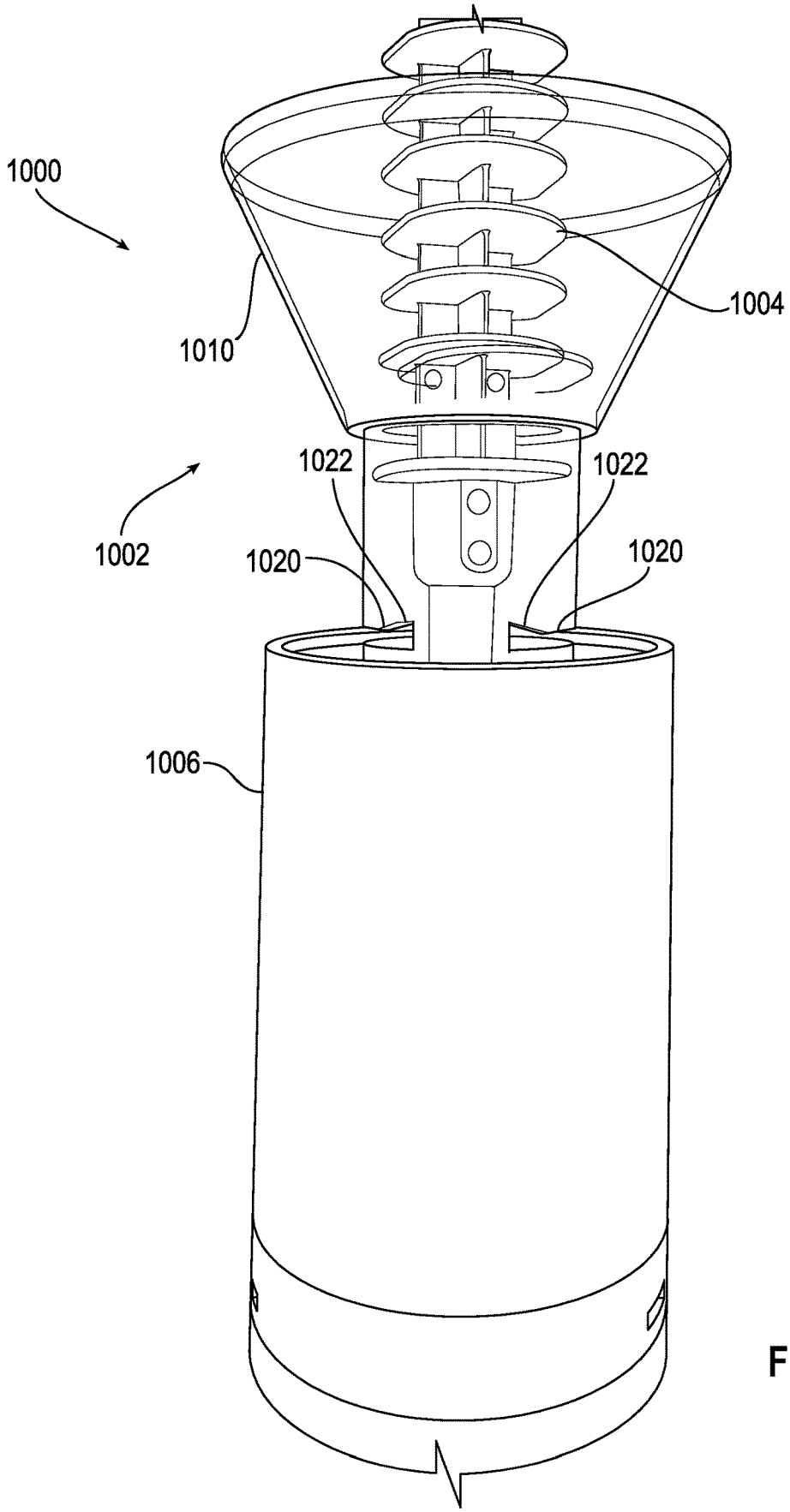
FIG. 34 is a side view of an oral care system of FIG. 33, according to an exemplary embodiment.
Figure 35:
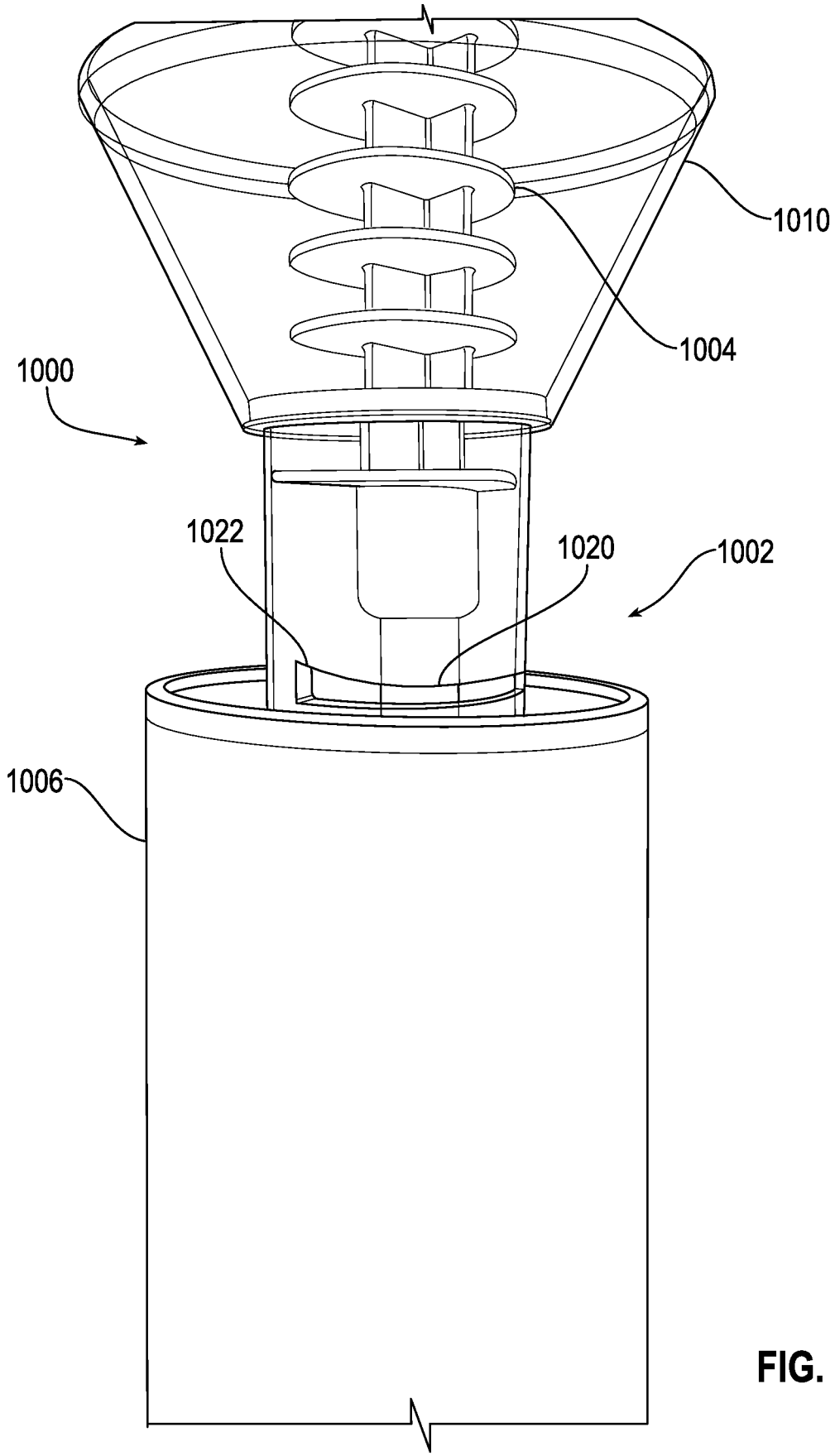
FIG. 35 is a side view of an oral care system of FIG. 33, according to an exemplary embodiment.
Figure 36:
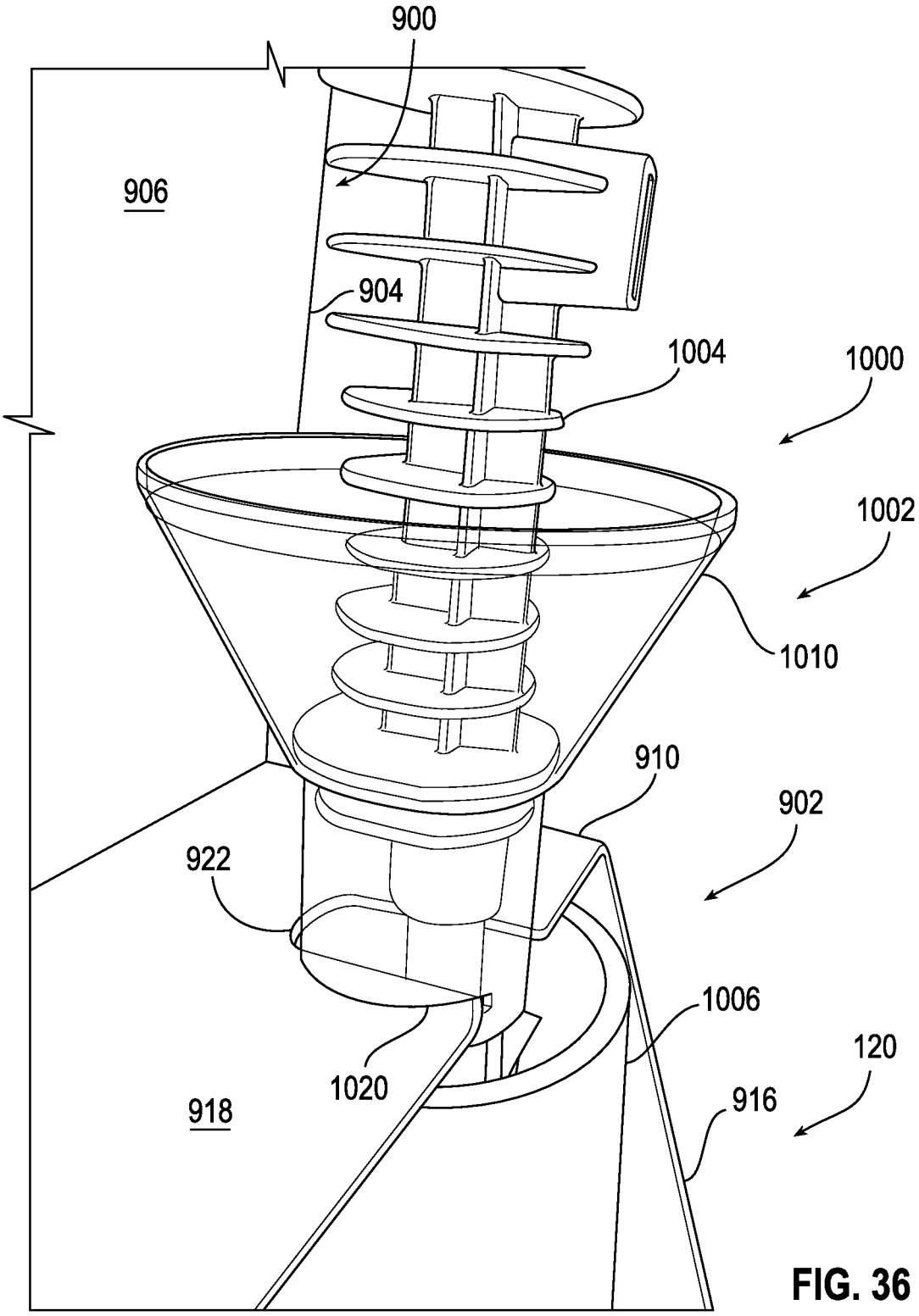
FIG. 36 is a side perspective view of the packaging unit of FIG. 29 holding an oral care system of FIG. 33, according to an exemplary embodiment.

Furthermore, in some embodiments, the spittoon straw 1010 is provided with grooves 1020 configured to fit around the sides of the slot 922. FIGS. 34 and 35 show side views of the oral care system 1000, according to exemplary embodiments. As shown in FIGS. 34 and 35, the spittoon straw 1010 includes a set of grooves 1020 provided on opposite sides of the spittoon straw 1010. Each groove 1020 is configured to fit around a portion of sides forming the slot 922. Additionally, as illustrated in FIG. 35, each groove 1020 includes a wider end 1022. The wider end 1022 is configured to receive the side of the slot 922 and, based on its wider size, aid an individual placing the oral care system 1000 in the packaging unit 120 by making it easier for the individual to align the groove 1020 with the side of the slot 922. The side of one of the slots 922 inserted into one of the grooves 1020 of the spittoon straw 1010 is shown in FIG. 36, which illustrates a side perspective of the packaging unit 120 holding the oral care system 1000.

Once the portions of the sides forming the slot 922 are received into the grooves 1020, the grooves 1020 help contain the oral care system 1000 in the packaging unit 120. Moreover, in various arrangements, the grooves 1020 also help medical professionals in determining patient compliance with an oral care regimen. To begin with, in some arrangements, the grooves 1020 are configured such that the spittoon straw 1010 and the toothbrush 1004 cannot be pushed downward into the cylinder solution cup 1008 until the oral care system 1000 is removed from the packaging unit 120. For example, the grooves 1020 engage with the slot 922 to prevent downwards movement of the spittoon straw 1010 and the toothbrush 1004. As such, the grooves 1020 help the oral care system 1000 from premature ingress into the cylinder solution cup 1008, for example, during assembly and distribution of the oral care system 1000 such that the oral care system 1000 must be discarded due to the premature ingress.

Additionally, in some arrangements, the grooves 1020 are configured on the spittoon straw 1010 such that once a patient has used the oral care system 1000, the oral care system 1000 cannot be reinserted into the packaging unit 120. For example, the grooves 1020 are aligned with the top of the oral fluid container 1002. Accordingly, once the patient uses the oral care system 1000 by depressing the toothbrush 1004 and spittoon straw 1010 into the cylinder solution cup 1008, the grooves are moved permanently below the top of the oral fluid bottle 1006 (e.g., because the spittoon straw 1010 includes projections that prevent the spittoon straw 1010 from being pulled up and out of the oral fluid bottle 1006 once the spittoon straw 1010 is depressed into the oral fluid bottle 1006). The grooves 1020 thus help a medical care professional determine, without requiring close inspection of the device, whether a patient has actually used an oral care system 100 because the patient cannot put the oral care system 1000 back into the packaging unit 120 once it has been used. If a patient claims to have used an oral care system 1000, but the oral care system 1000 is still in the packaging unit 120, the medical care professional knows that the patient has not actually used the oral care system 1000. In turn, this helps the medical care professional determine whether the patient is complying with an oral care regimen.

Referring to FIG. 37, a side perspective view of the packaging unit 120 holding oral care systems 1000 therein and contained within a wrapper 130 is shown, according to an exemplary embodiment. In various arrangements, the packaging unit 120 is configured to be encased in the wrapper 130 for sanitary reasons (e.g., to keep contaminants away from the oral care systems 1000). Accordingly, when the oral care systems 1000 are ready to be used, the packaging unit 120 is removed from the wrapper 130.

In some embodiments, the packaging unit 120 may be provided individually in the wrapper 130 (e.g., as a single oral care regimen unit), as shown in FIG. 37. This may be due to a special one-time patient need for the oral care system such as prior to surgery. However, in many hospital situations, patients are recommended to brush their teeth a certain number of times per day, but many patients may brush their teeth less than the recommended number of times per day. For example, patients may be recommended to brush their teeth four times per day, but many patients may only brush their teeth twice a day. As such, medical care professionals provide patients with toothbrush units that many patients will not use. If the toothbrush units are opened (e.g., if a packaging unit 120 is removed from the wrapper 130 to expose the oral care systems 1000), they may have to be discarded regardless of whether they are used for sanitary reasons, such as to prevent contamination of the opened toothbrush units. This may lead to waste of toothbrush units by the hospital.

Accordingly, in various embodiments, a packaging unit contained within a wrapper is configured to hold the number of oral care systems that a patient is expected to actually use over a time period. For example, while patients may be recommended to brush their teeth four times per day, many patients may only brush their teeth twice a day. As such, the packaging unit 120 is configured to contain two oral care systems 1000, as shown in FIGS. 33 and 37. The patient can thus be provided with multiple packaging units containing the total number of oral care systems recommended for use over the time period (e.g., two packaging units 120, each containing two oral care systems 1000, for use in brushing the patient's teeth four times in one day). However, the patient is able to remove each packaging unit separately from the wrapper enclosing the respective packaging unit such that if the patient does not use the full recommended number of oral care systems over the time period, the remaining unwrapped oral care systems may be preserved for future use. For example, referring to the embodiment of the packaging unit 120 shown in FIGS. 29-33, 36, and 37, a patient may be provided with two separate, wrapped packaging units 120 together containing four oral care systems 1000 for use in brushing the patient's teeth four times in one day. However, if the patient only brushes his or her teeth twice in one day instead of the recommended four times in one day, the patient only uses the two oral care systems 1000 contained within one packaging unit 120 in one wrapper 130. The remaining, unopened packaging unit 120 can then be kept for future use.

Figure 38:
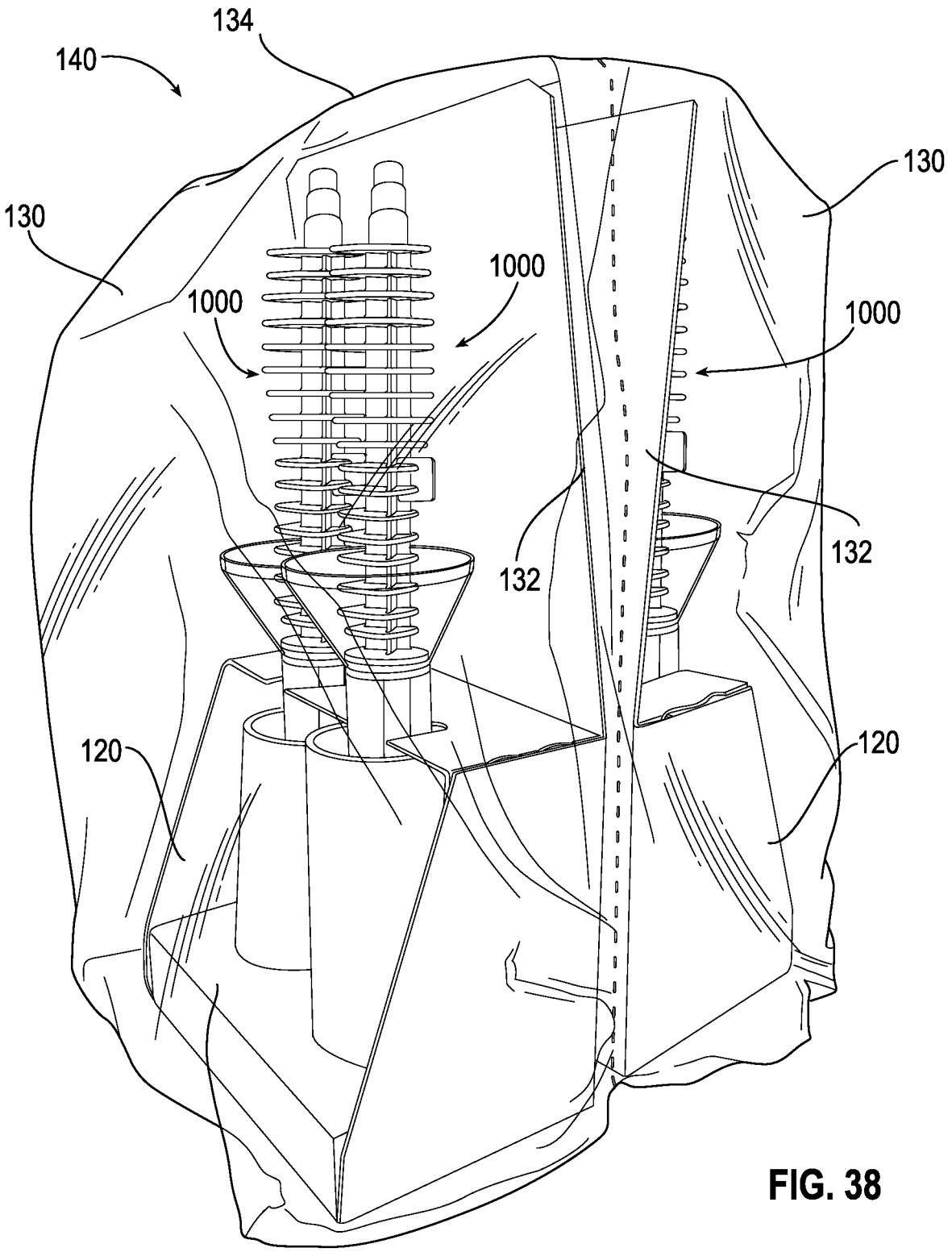
FIG. 38 is a side perspective view of two wrapped packaging units of FIG. 37 attached together as a kit, according to an exemplary embodiment.
Figure 39:
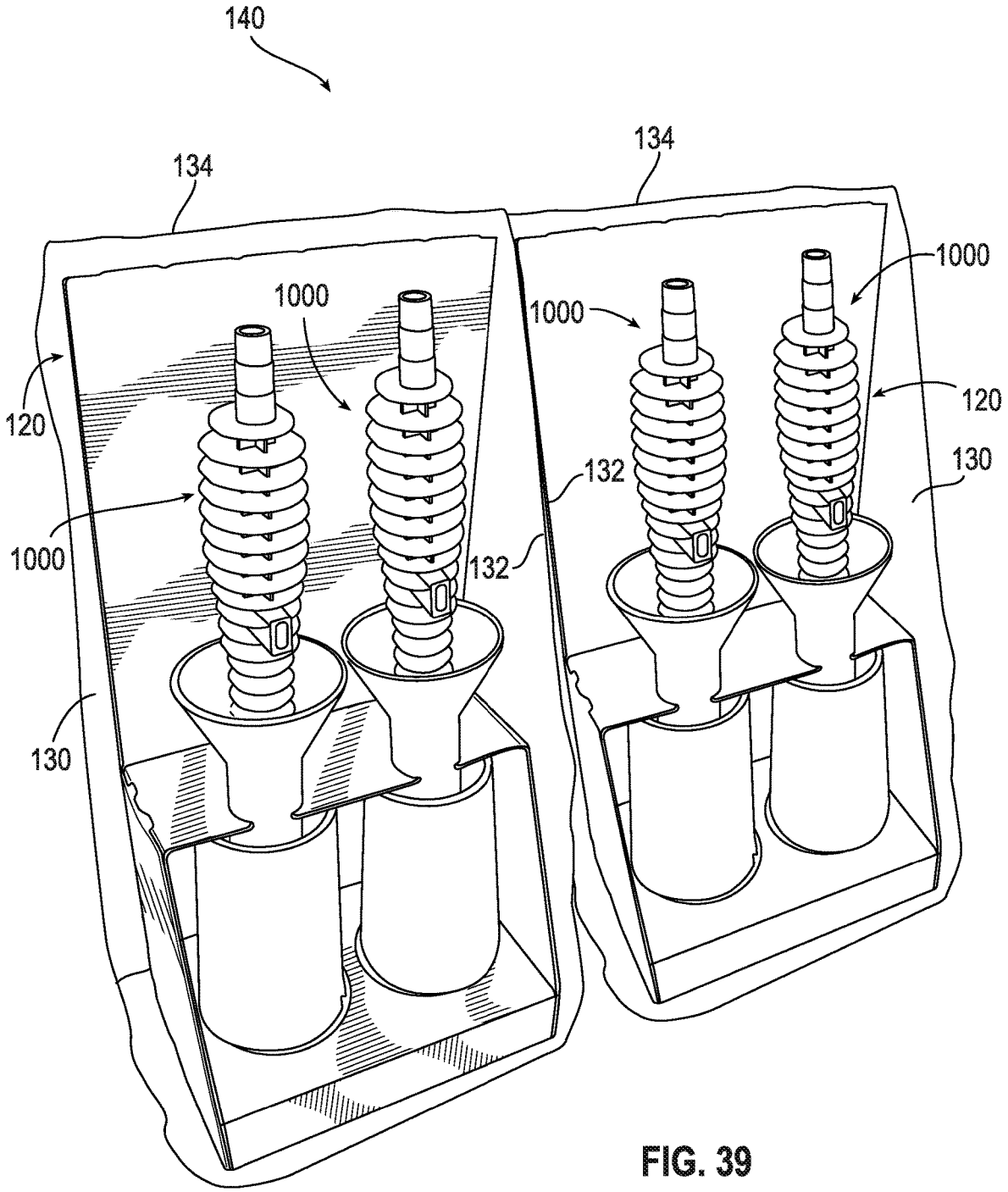
FIG. 39 is a side perspective view of two wrapped packaging units of FIG. 37 attached together as a kit, according to an exemplary embodiment.

Additionally, in some embodiments, packaging units containing oral care systems are configured to be bundled together such that each kit contains the number of oral care units recommended for use in one day. As an illustration, each kit contains at least two packaging units, which a first set of oral care systems packaged in the first packaging unit and a second set of oral care systems packaged in the second packaging unit. For example, FIGS. 38 and 39 show side perspective views of two wrapped packaging units 120 attached together as a kit 140. Each packaging unit 120 contains two oral care systems 1000 such that, as a whole, the kit 140 includes four oral care systems 1000. The patient is recommended to use all four oral care systems 1000 in one day, but it is expected that many patients will only use two oral care systems 1000 in one day. As such, each packaging unit 120 is separately enclosed in the wrapper 130 and includes a frangible connection to the other packaging unit 120 such that the packaging units 120 in the kit 140 can be separated and unwrapped individually. Thus, if the patient only uses two oral care systems 1000, the patient will only unwrap one packaging unit 120, leaving the other packaging unit 120 safely enclosed in the wrapper 130 for future use. Further, in some arrangements, the packaging units 120 connected together through, for example, a frangible, perforated connection between the wrappers 130. This connection holds the two wrappers together 130 but allows the two wrappers, and thus the two packaging units 120, to be pulled apart by applying a force to the perforated connection.

In some embodiments, the packaging units 120 in a kit 140 are provided back-to-back (e.g., with the back surfaces 908 of the two packaging units 120 provided together), as shown in FIG. 38. This configuration for the kit 140 is beneficial because the two packaging units 120 can be handled at once by an individual picking up the panels 904 of the two packaging units 120 together. Additionally, this configuration for the kit 140 allows the two packaging units 120 to be provided together in a compact fashion (e.g., such that the two packaging units 120 take up a small surface area of a table). However, in such embodiments, the packaging units 120 in the kit 140 may be separable such that an individual may view the back surface 908 of each packaging unit 120, as shown in FIG. 39. For example, the back surface 908 may include drug fact information, which, for compliance reasons, must be observable without needing to open the wrapper(s) 130.

In one arrangement, the wrappers 130 of the packaging units 120 include a frangible connection on one vertical edge 132 of each respective wrapper, as illustrated in FIG. 39. Accordingly, the packaging units 120 can be provided back-to-back as shown in FIG. 38 but can also be rotated around the hinge-like frangible connection on the vertical edges 132 such that the packaging units 120 are side-by-side as shown in FIG. 39. Further, in another arrangement, the wrappers 130 are provided with a mild adhesive on the portions of the wrappers 130 covering the back surfaces 908 of the packaging units 120. As such, the packaging units 120 are provided back-to-back as shown in FIG. 38 and the wrappers 130 of each packing unit are temporarily attached together with the mild adhesive on the portions of the wrappers 130 covering the back surfaces 908. However, the packaging units 120 can be moved apart by applying a small force to pull apart the adhesive and rotate the packaging units 120 until the packaging units 120 are side-by-side as shown in FIG. 39. In yet another arrangement, the wrappers 130 are provided with a frangible connection on top edges 134 of the two wrappers 130. The wrappers 130 are thus connected together such that the packaging units 120 are back-to-back as shown in FIG. 38, but the back surfaces 908 of the packaging units 120 can be separated (e.g., by rotating one packaging unit 120 clockwise and the other packaging unit 120 counterclockwise) such that the back surfaces 908 are observable. In yet a further arrangement, the wrappers 130 are provided with a frangible connection on bottom edges 135 of the two wrappers 130.

However, it should be understood that the above embodiments of oral care systems 1000 and packaging units 120 are intended to be exemplary and that the oral care systems 1000 and packaging units 120 described herein may be provided and configured differently in other embodiments. For example, in some alternative embodiments, each packaging unit 120 is configured to hold one oral care system 1000 and is wrapped separately. As such, a patient is provided with four separate packaging units 120 daily, with each packaging unit 120 holding one oral care system 1000. In other example, each packaging unit 120 is configured to hold one oral care system 1000 and is wrapped separately, but the wrappers of four packaging units 120 are connected together (e.g., through frangible connections provided along vertical sides of the wrappers) to form a kit of four packaging units 120. A patient is thus provided with one kit daily. Alternatively, in other embodiments, each packaging unit 120 is configured to hold more than two oral care systems 1000 and/or each kit includes more than two packaging units 120. In one example, a large number of packaging units 120 are connected together with frangible connections along the wrappers of the packaging units 120, and a medical care professional separates the number of packaging units 120 needed for a patient from the large number of packaging units 120 connected together. In a further embodiment, each packaging unit 120 is configured to hold four oral care systems 1000 so that each packaging unit 120 holds enough oral care systems 1000 for the recommended brushing the patient's teeth four times in one day. This would encourage the medical care professional to make sure the patient brushes their teeth four times in one day or risk wasting oral care systems 1000 by the hospital. Further, in other embodiments, a patient is provided with a different number of oral care systems 1000 per day, such as three oral care systems 1000 or five oral care systems 1000. As such, packaging units 120 may be configured to hold different number of oral care systems. For example, if a patient is recommended to brush his or her teeth three times a day, a bundle provided to the patient may include a packaging unit 120 holding two oral care systems 1000 and a packaging unit 120 holding one oral care system 1000.

Figure 40:
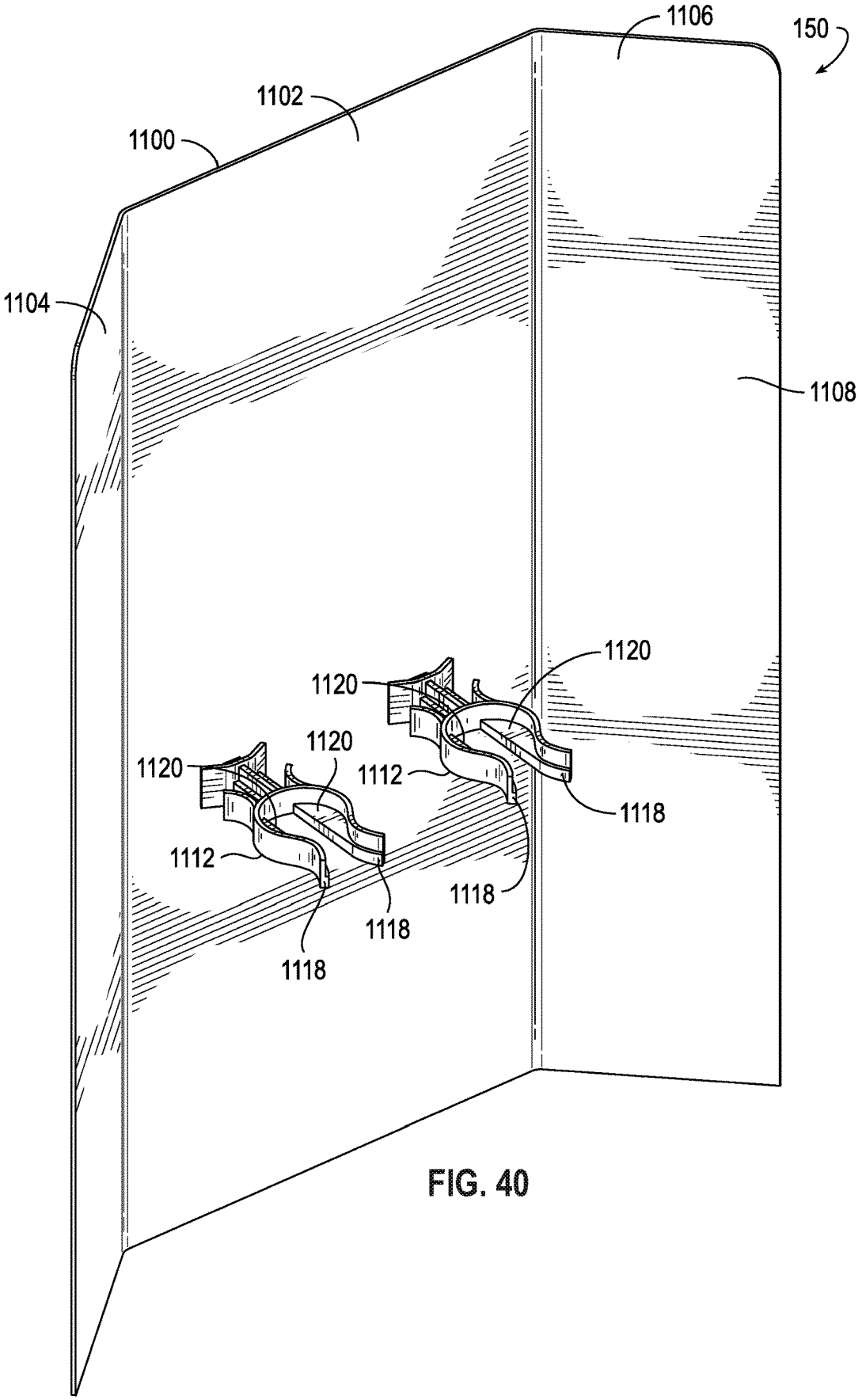
FIG. 40 is a side perspective view of another packaging unit for holding oral care systems, according to an exemplary embodiment.
Figure 41:
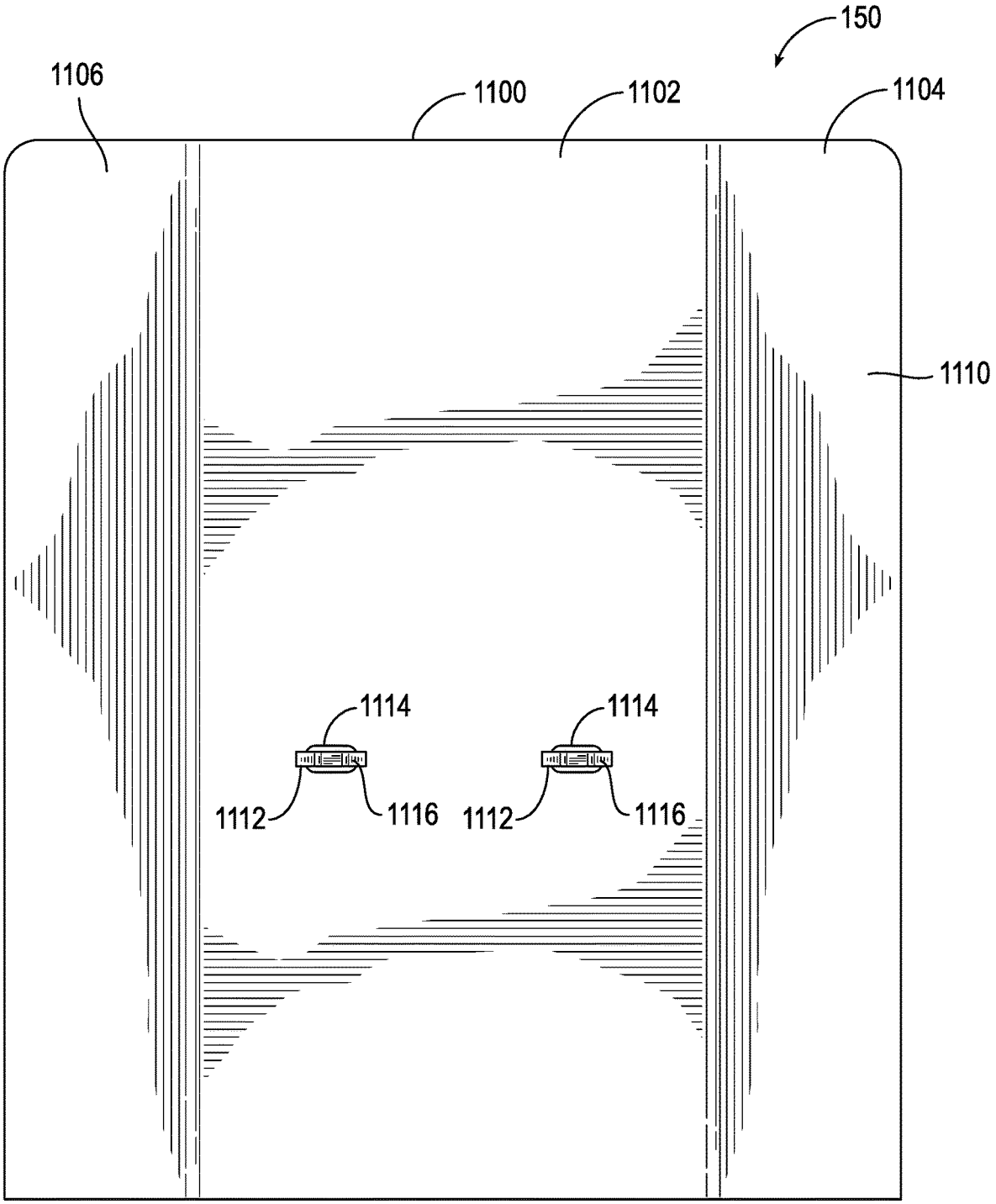
FIG. 41 is a back view of the packaging unit of FIG. 40, according to an exemplary embodiment.

Referring now to FIGS. 40-45, views of another packaging unit 150 for holding oral care systems, such as the oral care system 100 or the oral care system 1000, are shown, according to exemplary embodiments. FIG. 40 shows a side perspective view of the packaging unit 150. As shown in FIG. 40, the packaging unit 150 is formed of a mount, for example panel 1100 having a backing portion 1102. The backing portion 1102 may be further connected to a left flap 1104 and a right flap 1106 (e.g., through folds in the panel 1100 between the middle portion 1102 and the left flap 1104 and right flap 1106). For example, the left flap 1104 and right flap 1106 allow the packaging unit 150 to stand upright without further supports. However, a single backing portion 1102, not including left flap 1104 and right flap 1106, used in conjunction with the bottom of the oral care system, also allow the packaging unit to stand upright. The panel 1100 also includes a front surface 1108 and, as shown in FIG. 41 illustrating a back view of the packaging unit 150, a back surface 1110.

Figure 42:
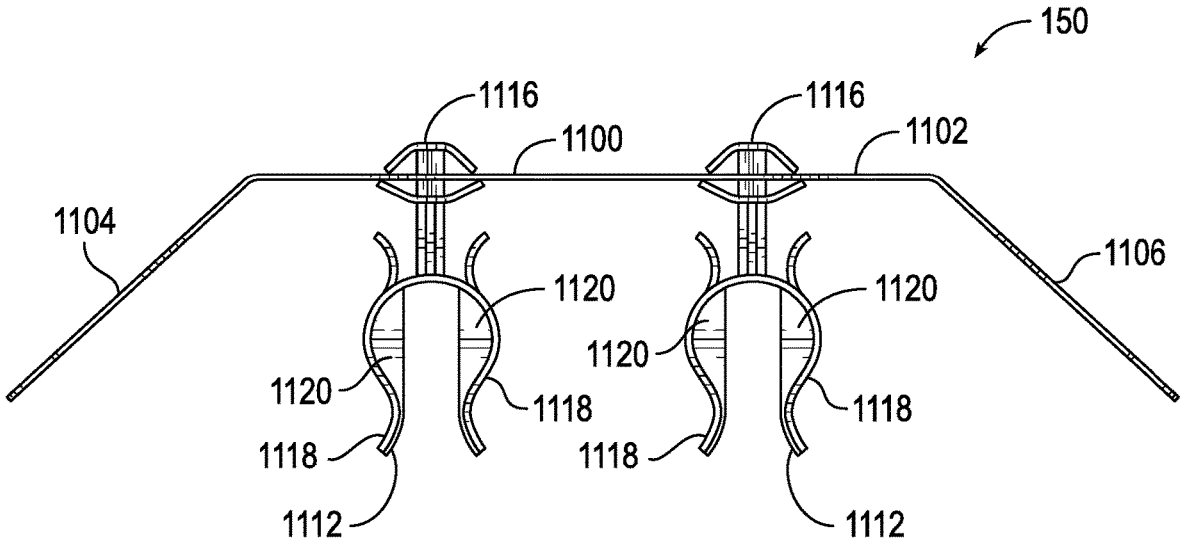
FIG. 42 is a top view of the packaging unit of FIG. 40, according to an exemplary embodiment.

Referring back to FIG. 40, the packaging unit 150 further includes one or more attachment elements for coupling the oral care system(s) to the mount, such as panel 1100. In the embodiments shown, attachment elements are clips 1112, where each clip 1112 is configured to hold an oral care system. For example, the packaging unit 150 shown in FIG. 40 includes two clips 1112, though it should be understood that in other embodiments, a packaging unit may include one clip 1112 or may include more than two clips. Each clip 1112 attaches to the panel 1100 through a hole 1114 in the panel 1100 through which a projection 1116 at the back of the clip 1112 fits, supporting the clip 1112 on the panel 1100, as illustrated in FIG. 41. As shown in FIG. 42, which illustrates a top view of the packaging unit 150, each clip 1112 includes a set of prongs 1118 together configured to fit around and engage a portion of an oral care system. In some embodiments, as illustrated in FIGS. 40 and 42, each prong 1118 also includes a flat portion 1120. The flat portion 1120 is configured to receive a set of grooves, e.g., grooves 1020, (see FIGS. 43 and 44) of an oral care system to better hold the oral care system in place in the packaging unit, as well as to prevent movement of the oral care system during transport or otherwise prior to use. Additionally, the flat portion 1120 may not be able to receive the grooves after the oral care system has been used (e.g., because the grooves have been depressed below the spittoon straw, as described above with reference to oral care system 1000). As such, the oral care system cannot be properly replaced into the clip 1112 once used. However, the clips 1112 may also or alternatively be configured to otherwise engage an oral care system. For example, the clips 1112 may be formed of a pliable or semi-pliable plastic and may thus bend to receive and engage a portion of the oral care system. In some embodiments, the clip 1112 may not be coupled or attached to the panel 1100 but rather arranged independent from the panel 1100 within the packaging unit 150. For example, while not attached to the panel 1110, the clip 1112 may be similarly configured to engage a portion of an oral care system in order to prevent movement of the oral care system (e.g., prevent the toothbrush 1004 from being depressed into oral fluid bottle 1006 as described above with reference to oral care system 1000). Additionally, the clip 1112 may be configured to engage a portion of the oral care system other than the grooves 1020 after the oral care system has been used. For example, the clip 1112 may be configured to engage a portion of the spittoon straw 1010, or another portion of the oral care system after the oral care system has been used. In some embodiments, the clip 1112 may be configured otherwise to prevent the toothbrush 1004 from being depressed into the oral fluid container 1006. For example, the clip 1112 may be configured as a linear component (e.g., a bar, etc.). The clip 1112 may further be configured to be removably coupled to the oral care system or actuated about the oral care system so as to prevent and/or permit depression of the toothbrush 1004 into the oral fluid container 1006.

Figure 43:
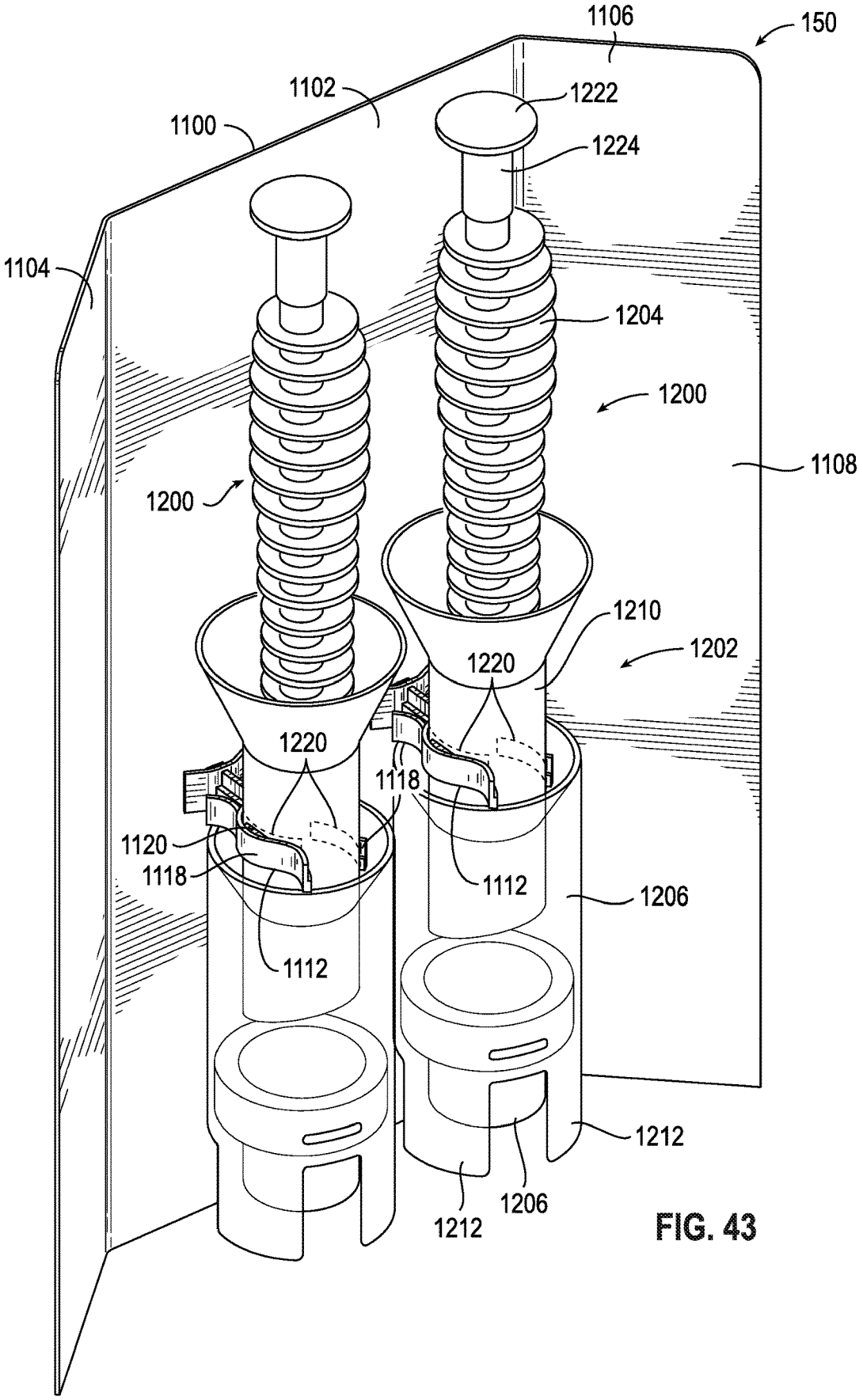
FIG. 43 is a side perspective view of the packaging unit of FIG. 40 holding oral care systems, according to an exemplary embodiment.

Accordingly, FIG. 43 illustrates a side perspective view of the packaging unit 150 holding oral care systems 1200, according to an exemplary embodiment. In various embodiments, the oral care systems 1200 are configured similarly to the oral care system 100, with each oral care system 1200 including an oral fluid container 1202 (e.g., including an oral fluid bottle 1206, a cylinder solution cup 1208, and a spittoon straw 1210) and a toothbrush 1204. Additionally, in various embodiments, the components of each oral care system 1200 are configured similarly to the oral fluid container 102, toothbrush 104, oral fluid bottle 106 or 116, cylinder solution cup 108 or 118, and spittoon straw 110 discussed above. Each oral care system 1200 also includes grooves 1220 similar to grooves 1020 of the oral care system 1000, discussed above. Further, the oral care system 1200 includes a plunger 1222 configured to be removably inserted to fit within a suction port 1224 of the toothbrush 1204. For example, the plunger 1222 may prevent oral fluid from backing out of the suction port 1224 or the projecting suction opening 212 when the suction port 1224 or the projecting suction opening 212 is not in use and, specifically, while the toothbrush 1204 is depressed into the cylinder solution cup 1208, as described above with reference to FIGS. 23-29. However, the plunger 1222 is removable such that the user may remove the plunger 1222 to attach the toothbrush 1204 to a suction device. It is understood that there can be other embodiments of the packaging unit that could include other removable elements configured to obstruct the suction port 210 and the projecting suction opening 212 to prevent oral fluid from backing out when the toothbrush is depressed into the cylinder solution cup. For example, a removable cap may cover and/or otherwise obstruct the suction port 210 and the projecting suction opening 212. These removable elements may be coupled to parts of the oral care system such as the brush or attached to the packaging unit, or be independent elements.

As shown in FIGS. 43 and 44, the prongs 1118 of each clip 1112 hold an oral care system 1200, with the flat portion 1120 of each prong 1118 fitting into the groove 1220 of the oral care system 1200. Additionally, the panel 1100 is sized such that, when the oral care systems 1200 are inserted into the clips 1112, the lower portion of each oral care system 1200 is configured to end flush with the panel 1100. For example, as shown in FIG. 43, the bottom of legs 1212 on the oral fluid bottle 1206 (e.g., configured similarly to legs 512) are flush with the bottom of the panel 1100 such that the panel 1100 and the oral care systems 1200 stand upright together (e.g., via the left flap 1104 and the right flap 1106 of the panel 1100 and the legs 1212 of the oral care system 1200).

In various embodiments, similar to the packaging unit 120, the packaging unit 150 is fabricated of a flexible, pliable material such as cardboard, cardstock, or a plastic sheet. For example, the packaging unit 150 may be formed as a flat sheet (e.g., a flat sheet of cardboard) that is configured to fold into the configuration shown in FIGS. 40-45 (e.g., along lines and/or scoring on the flat sheet). Additionally, in various embodiments and similar to the packaging unit 120, the configuration of the packaging unit 150 provides a small footprint for packaging and providing oral care systems. As an example, the packaging unit 150 takes up little or minimal table surface space. However, the packaging unit 150 provides a large amount of surface space that can be used, in various arrangements, for marketing, for providing use instructions for the oral care system, for providing drug facts, and so on. For example, in one embodiment, the front surface 1108 on the left flap 1104 and middle portion 1102 includes a label or logo for the oral care system and brief instructions on using the oral care system. Additional space on the front surface 1108 on the left flap 1104 and the front surface 1108 on the right flap includes facts on using oral care systems and information on why using oral care systems in a hospital setting is beneficial. The back surface 1110 of the middle portion 1102 includes drug facts, the back surface 1110 of the right flap 1106 includes detailed instructions for using an oral care system, and the back surface 1110 of the left flap 1104 includes additional facts on using the oral care systems and information on why using the oral care systems in a hospital setting is beneficial.

In other embodiments, the mount for the oral care systems may not be a flat panel such as panel 1100. The mount may be any element or structure capable of directly or indirectly securing and/or holding one or more oral care systems together, preferably in an upright stance. In some examples, the mount may be a cylindrical mount with one or more of the attachment elements around the circumference. In other embodiments, a plurality of attachment elements, such as clips 1112, but not limited thereto, are connected together to form an array of attachment elements, and the mount does not include any additional elements to which the attachment elements are coupled. Furthermore, attachment elements may be provided in configurations other than as clips 1112, so long as the attachment elements are capable of securing the oral care system(s) 1200 and have an extended and substantially flat portion configured to be received by the groove 1220 of the oral care system 1200 to prevent premature activation of the toothbrush 1204 relative to the oral fluid bottle 106.

Figure 45:
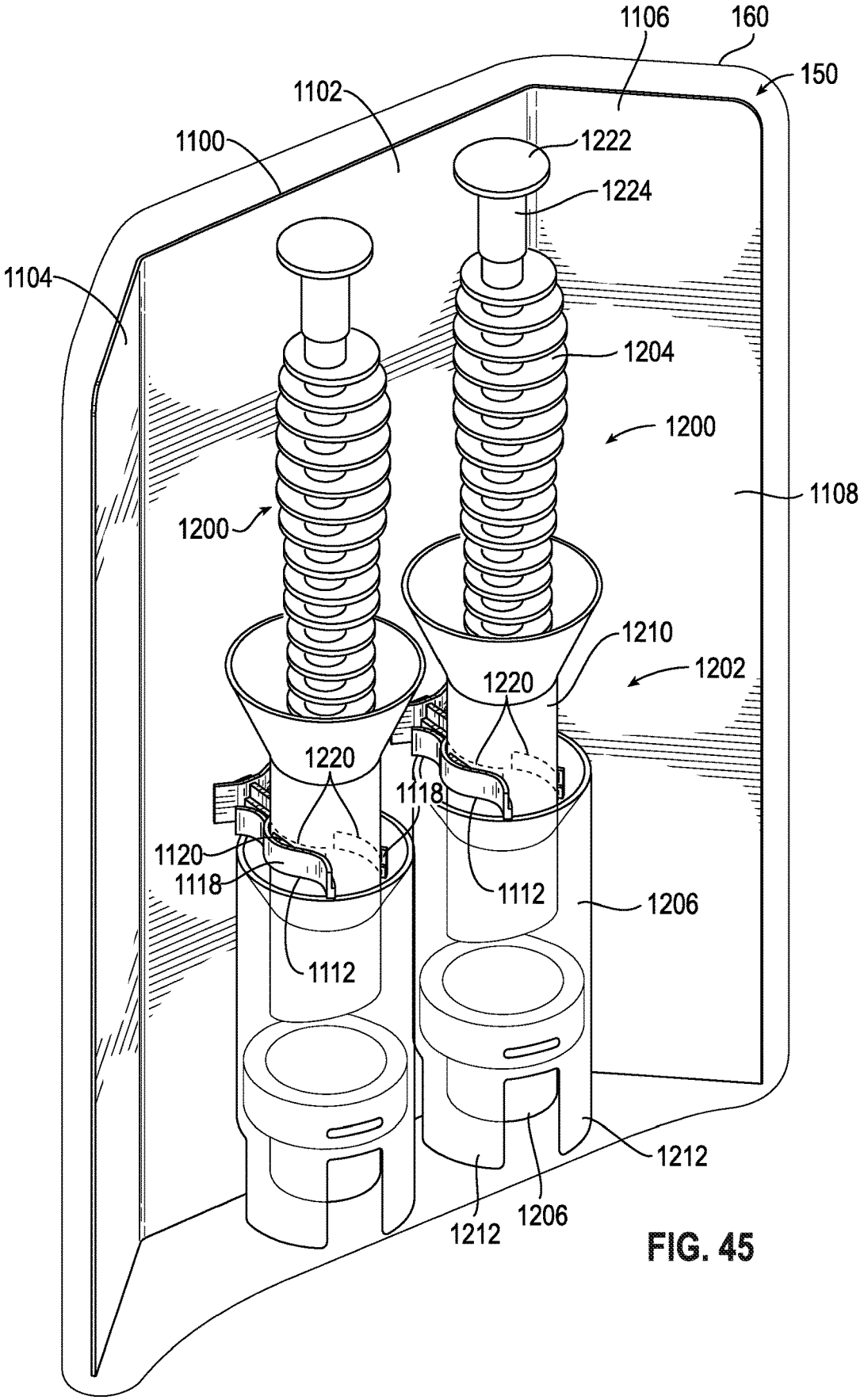
FIG. 45 is a side perspective view of the packaging unit of FIG. 43 contained within a wrapper, according to an exemplary embodiment.

Referring to FIG. 45, a side perspective view of the packaging unit 150 holding oral care systems 1200 therein and contained within a wrapper 160 is shown, according to an exemplary embodiment. Similar to the packaging unit 120, in various arrangements, the packaging unit 150 is configured to be encased in the wrapper 160 for sanitary reasons (e.g., to keep contaminants away from the oral care systems 1200). Accordingly, when the oral care systems 1200 are ready to be used, the packaging unit 150 is removed from the wrapper 160. In some embodiments, the packaging unit 150 is provided individually in the wrapper 160 as shown in FIG. 44 (e.g., as an oral care regimen unit). In other embodiments, the packaging unit 150 may be provided in a kit similar to the kit 140, including multiple packaging units 150 with frangible connections between the wrappers 160 enclosing the packaging units 150.

Figure 46:
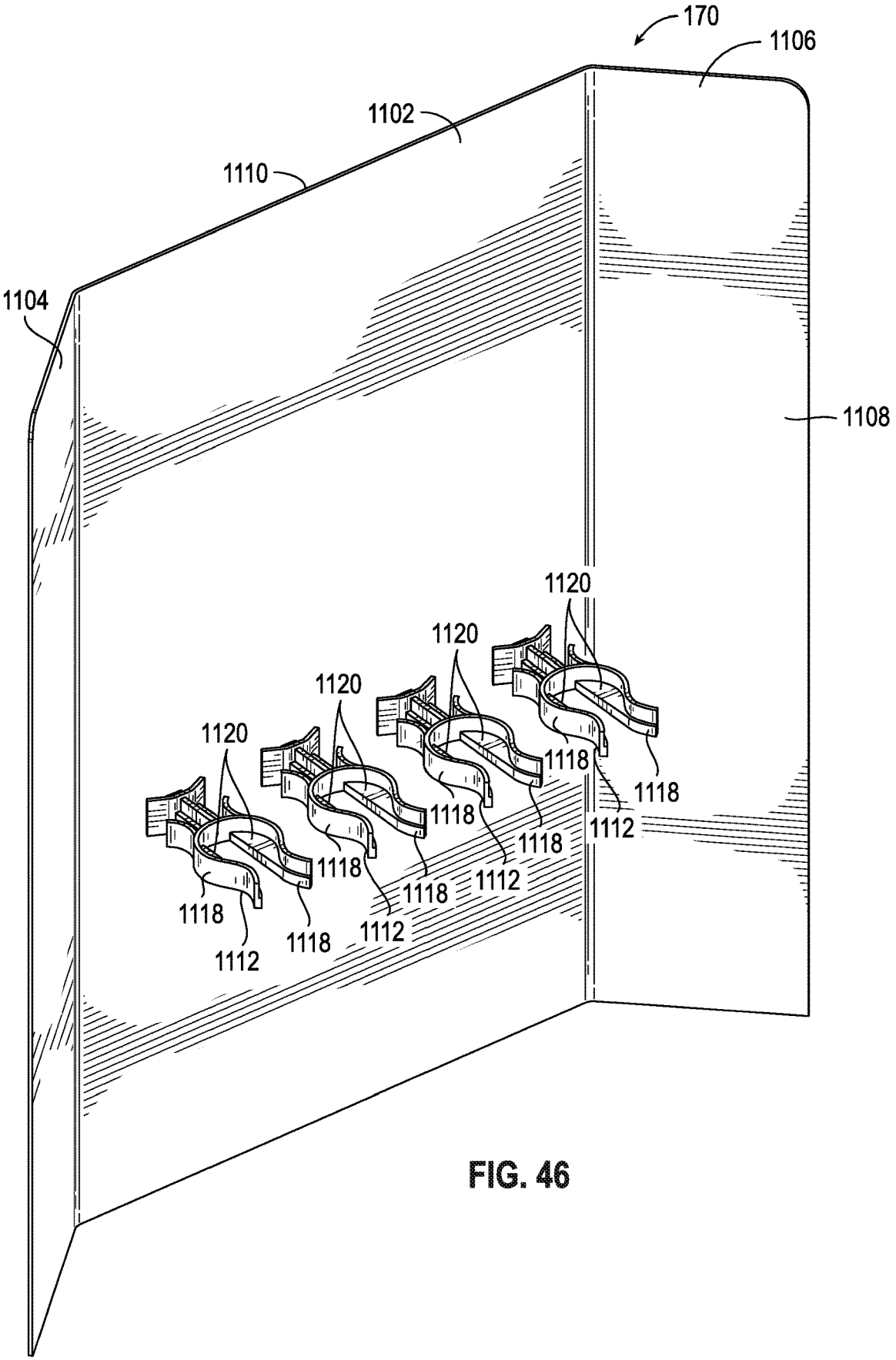
FIG. 46 is a side perspective view of another packaging unit for holding oral care systems, according to an exemplary embodiment.
Figure 47:
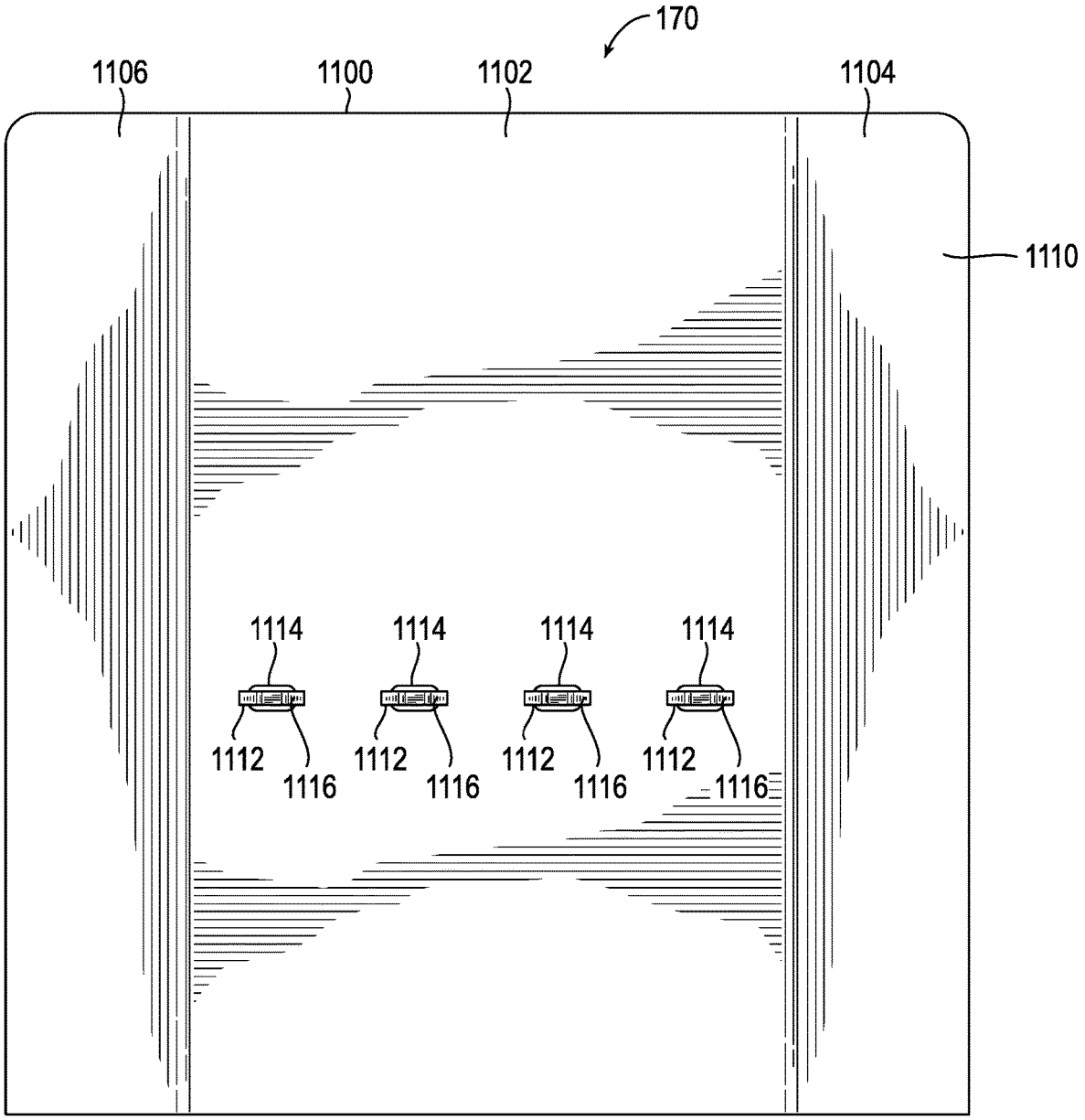
FIG. 47 is a back view of the packaging unit of FIG. 46, according to an exemplary embodiment.
Figure 48:
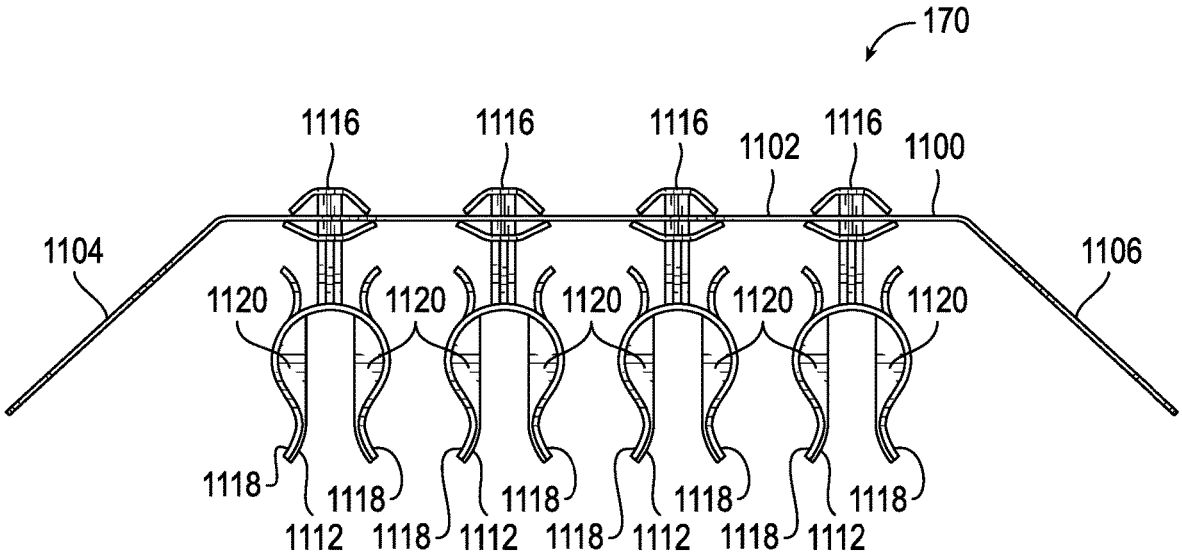
FIG. 48 is a top view of the packaging unit of FIG. 46, according to an exemplary embodiment.
Figure 49:
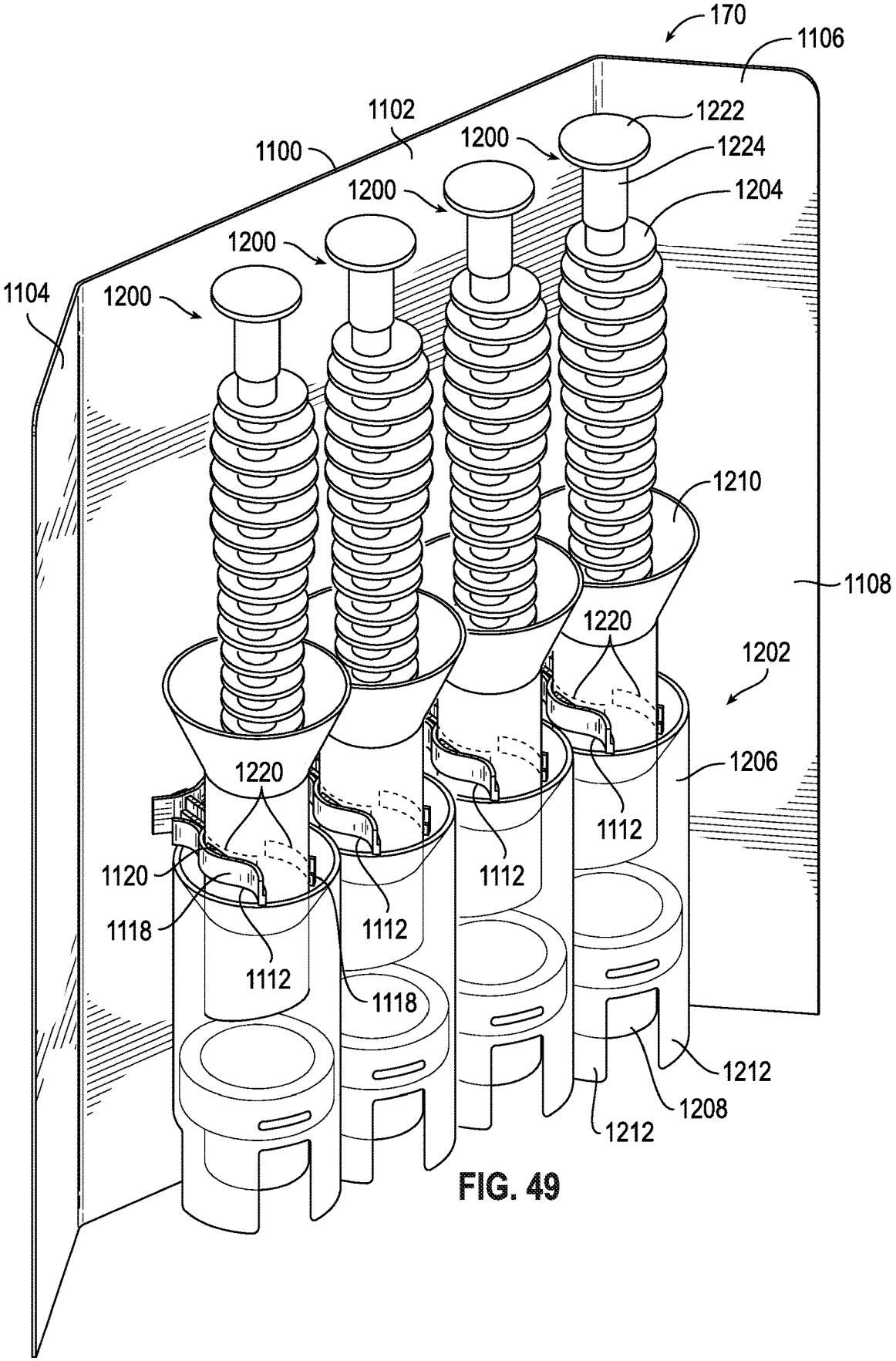
FIG. 49 is a side perspective view of the packaging unit of FIG. 46 holding oral care systems, according to an exemplary embodiment.

Referring to FIGS. 46-50, views of another packaging unit 170 for holding oral care systems, such as the oral care system 100, the oral care system 1000, or the oral care system 1200, are shown, according to exemplary embodiments. FIG. 46 shows a side perspective view of the packaging unit 170. As shown in FIG. 46, the packaging unit 170 is configured similarly to the packaging unit 150, including a single panel 1100 divided into a middle portion 1102 connected to a left flap 1104 and a right flap 1106. As further shown in FIG. 46, as well as FIG. 47 (illustrating a back view of the packaging unit 170) and FIG. 48 (illustrating a top view of the packaging unit 170), the packaging unit 170 further includes clips 1112 configured to hold oral care systems. However, the packaging unit 170 shown in FIGS. 47-50 is wider than the packaging unit 150 shown in FIGS. 40-45 and includes four clips 1112. As such, the packaging unit 170 is configured to hold four oral care systems 1200, as shown in FIG. 49 illustrating a side perspective view of the packaging unit 170, according to an exemplary embodiment.

Figure 50:
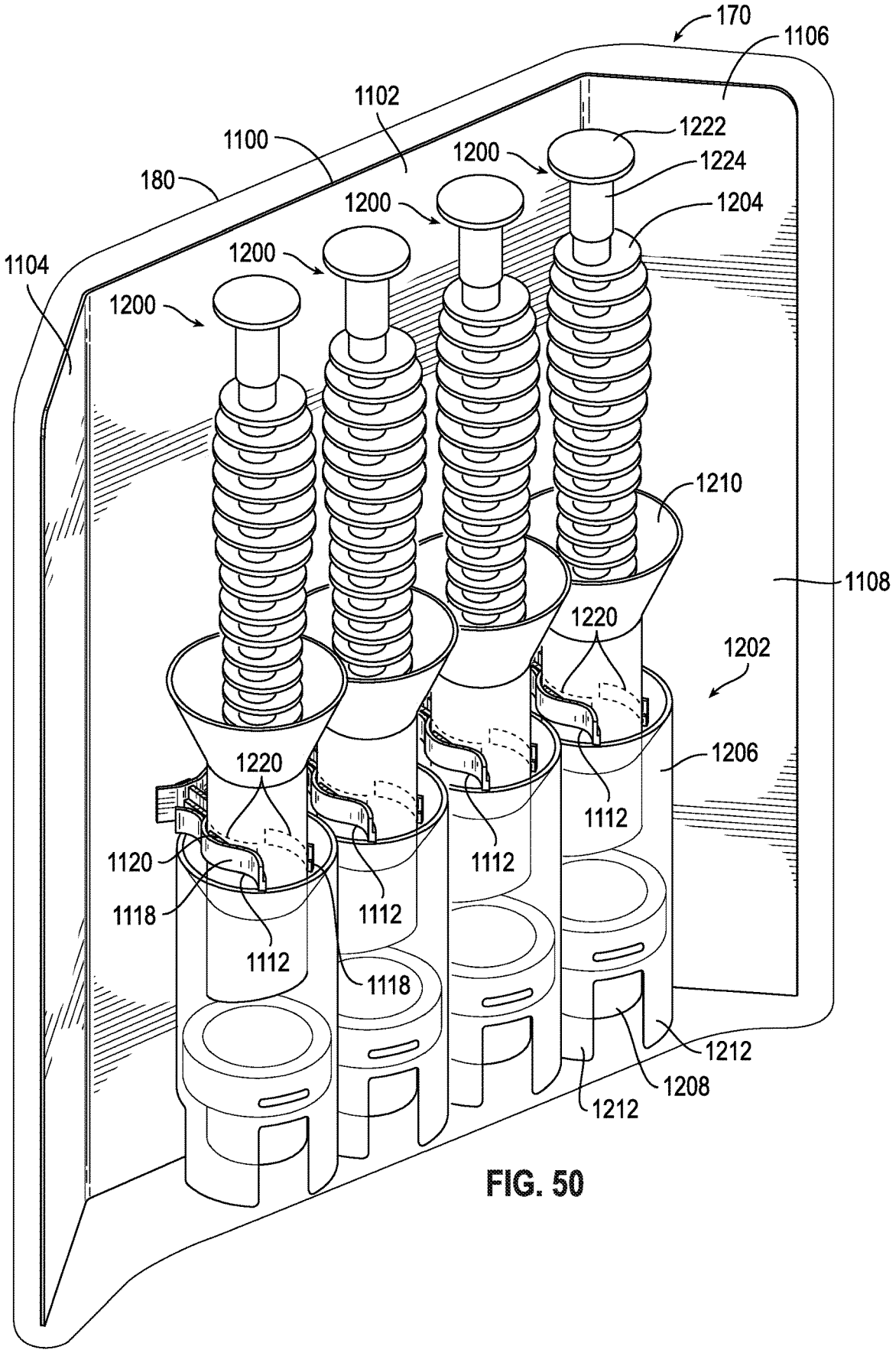
FIG. 50 is a side perspective view of the packaging unit of FIG. 49 contained within a wrapper, according to an exemplary embodiment.

Referring to FIG. 50, a side perspective view of the packaging unit 170 holding oral care systems 1200 therein and contained within a wrapper 180 is shown, according to an exemplary embodiment. The packaging unit 170 may be encased in the wrapper 180 for similar reasons as the packaging unit 120 and the packaging unit 150, as described above, and is removed from the wrapper 180 when used. Additionally, in some embodiments, the packaging unit 170 is provided individually in the wrapper 180 (e.g., as an oral care regiment unit), while in other embodiments, the packaging unit 170 may be provided in a kit similar to 140, including multiple packaging units 170 with frangible connections between the wrappers 180 enclosing the packaging units 170.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using one or more a separate intervening members and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

The construction and arrangement of the elements of the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. The elements and assemblies may be constructed from any of a wide variety of materials that provide sufficient strength or durability, in any of a wide variety of colors, textures, and combinations. Additionally, in the subject description, the word "exemplary" is used to mean serving as an example, instance, or illustration. Any embodiment or design described herein as "exemplary" is not necessarily to be construed as preferred or advantageous over other embodiments or designs. Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

What is claimed is:

1. An oral care regimen kit comprising:

a packaging unit comprising:

an oral care system comprising:

a toothbrush; and an oral fluid container comprising:

a non-moveable portion configured to store an oral fluid and selectively receive the toothbrush, and a moveable portion configured to support the toothbrush; and a clip configured to engage the moveable portion of the oral fluid container such that the toothbrush cannot be depressed into the non-moveable portion of the oral fluid container while the moveable portion of the oral fluid container is engaged by the clip.

2. The oral care regimen kit of claim 1, wherein the packaging unit comprises a mount configured to support the clip.

3. The oral care regimen kit of claim 2, wherein the mount is a panel.

4. The oral care regimen kit of claim 3, wherein:

the panel comprises a backing portion, a left flap, and a right flap; and the panel is configured to stand upright while supported by the backing portion, the left flap, and the right flap.

5. The oral care regimen kit of claim 3, wherein:

the panel comprises a hole;

the clip comprises a projection that is configured to be received in the hole; and the clip is configured to be attached to the panel through an interaction between the projection and the hole.

6. The oral care regimen kit of claim 5, wherein the clip is formed of a pliable plastic.

7. The oral care regimen kit of claim 5, wherein;

the moveable portion comprises a pair of grooves configured to receive a pair of flat portions of the clip; and the clip is configured to engage a portion of the moveable portion of the oral fluid container other than the pair of grooves after the oral care system has been used.

8. The oral care regimen kit of claim 5, further comprising a wrapper encasing the packaging unit.

9. The oral care regimen kit of claim 1, wherein the clip is configured to releasably couple with the moveable portion to engage the moveable portion.

10. The oral care regimen kit of claim 1, wherein the moveable portion comprises a pair of grooves configured to receive a pair of flat portions of the clip.

11. The oral care regimen kit of claim 10, wherein:

the non-moveable portion contains a premeasured amount of oral fluid at a bottom of the oral fluid container; and the pair of grooves are configured such that the toothbrush cannot be depressed into the non-moveable portion of the oral fluid container while the pair of flat portions are received by the pair of grooves.

12. The oral care regimen kit of claim 10, wherein the clip is configured to engage a portion of the moveable portion of the oral fluid container other than the pair of grooves after the oral care system has been used.

13. The oral care regimen kit of claim 1, wherein the toothbrush comprises a suction port and a plunger configured to be removably inserted in the suction port.

14. The oral care regimen kit of claim 1, further comprising a wrapper encasing the packaging unit.

15. A packaging system for an oral care regimen kit, the packaging system comprising:

a packaging unit comprising:

a mount, an attachment element supported by the mount, the attachment element comprising a pair of flat portions, and an oral care system comprising:

a toothbrush, and an oral fluid container comprising:

a non-moveable portion configured to store an oral fluid and selectively receive the toothbrush, and a moveable portion configured to support the toothbrush, the moveable portion defining a pair of grooves configured to receive the pair of flat portions such that when the pair of flat portions are engaged with the pair of grooves, the toothbrush cannot be depressed into the oral fluid container; and a wrapper encasing the packaging unit.

16. The packaging system of claim 15, wherein:

the mount is a panel;

the panel comprises a backing portion, a left flap, and a right flap; and the panel is configured to stand upright while supported by the backing portion, the left flap, and the right flap.

17. The packaging system of claim 15, wherein the attachment element is configured to releasably couple with the moveable portion to engage the moveable portion.

18. The packaging system of claim 15, wherein:

the non-moveable portion contains a premeasured amount of oral fluid at a bottom of the oral fluid container.

19. The packaging system of claim 15, wherein the toothbrush comprises a suction port and a plunger configured to be removably inserted in the suction port.

20. The packaging system of claim 15, wherein the attachment element is a clip.

* * * * *